US007991333B2

(12) United States Patent
Sato

(10) Patent No.: US 7,991,333 B2
(45) Date of Patent: Aug. 2, 2011

(54) IMAGE FORMING APPARATUS AND DEVELOPING AGENT CARTRIDGE

(75) Inventor: Shougo Sato, Seto (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 283 days.

(21) Appl. No.: 11/857,718

(22) Filed: Sep. 19, 2007

(65) Prior Publication Data

US 2008/0075506 A1 Mar. 27, 2008

(30) Foreign Application Priority Data

Sep. 22, 2006 (JP) ..... 2006-257879
Sep. 22, 2006 (JP) ..... 2006-257880
Sep. 22, 2006 (JP) ..... 2006-257881

(51) Int. Cl.
*G03G 15/08* (2006.01)

(52) U.S. Cl. ..... 399/262; 399/111

(58) Field of Classification Search ..... 399/110, 399/111, 119, 262
See application file for complete search history.

(56) References Cited

U.S. PATENT DOCUMENTS 5,260,750 A 11/1993 Ishida et al.
5,534,979 A 7/1996 Ide
5,572,301 A 11/1996 Shiratori
5,890,034 A * 3/1999 Nakano et al. ..... 399/106
7,447,470 B2 * 11/2008 Lee ..... 399/262
7,675,536 B2 * 3/2010 Palumbo et al. ..... 347/263
2003/0185589 A1 * 10/2003 Fujita ..... 399/111
2006/0056875 A1 * 3/2006 Karasawa et al. ..... 399/107
2006/0104673 A1 5/2006 Sasae et al.

FOREIGN PATENT DOCUMENTS

| | | |
|---|---|---|
| EP | 0897138 | 2/1999 |
| JP | 04-372967 | 12/1992 |
| JP | 06-035321 | 2/1994 |
| JP | 06-274029 | 9/1994 |
| JP | 09-006110 | 1/1997 |
| JP | 10-078697 | 3/1998 |
| JP | 2001-083792 | 3/2001 |
| WO | 9216879 | 10/1992 |

OTHER PUBLICATIONS

Search Report for EP Application No. 07017993.2-2209, dated May 13, 2008.
Notice of Reasons for Refusal for Japanese Patent Application No. 2006-257880 mailed May 10, 2010.

* cited by examiner

*Primary Examiner* — David M Gray
*Assistant Examiner* — Barnabas T Fekete
(74) *Attorney, Agent, or Firm* — Banner & Witcoff, Ltd.

(57) ABSTRACT

An image forming apparatus is described. The image forming apparatus may include an image carrier on which an electrostatic latent image is formed; a developing agent carrier that transforms the electrostatic latent image into a visible image by supplying a developing agent to the image carrier; and a developing agent cartridge that accommodates a developing agent to be supplied to the developing agent carrier, arranged so as to be opposed to the developing agent carrier in a longitudinal direction of the developing agent carrier, and formed with an opening for horizontally passing the developing agent in a position horizontally opposed to the developing agent carrier.

26 Claims, 20 Drawing Sheets

(a)

(b)

(a)

(b)

(a)
(b)
(c)
(d)
(e)
UPPER SIDE
LOWER SIDE
LEFT SIDE
RIGHT SIDE
FRONT SIDE
REAR SIDE (a)

(b)

8

(a)

(b)

( a )

( b )

( a )

( b )

IMAGE FORMING APPARATUS AND DEVELOPING AGENT CARTRIDGE

CROSS REFERENCE TO RELATED APPLICATIONS

This application claims priority to Japanese Patent Application No. 2006-257879, Japanese Patent Application No. 2006-257880, and Japanese Patent Application No. 2006-257881, all filed on Sep. 22, 2006, the disclosures of which are hereby incorporated into the present application by reference.

TECHNICAL FIELD

The present invention relates to an image forming apparatus such as a laser printer, and a developing agent cartridge provided therein.

BACKGROUND

Conventionally, there has been known a laser printer including a photosensitive drum on which an electrostatic latent image is formed, a developing roller that transforms the electrostatic latent image into a visible image, and a toner box that accommodates a toner to be supplied onto the developing roller.

As such laser printer, there has been proposed, for example, an image forming apparatus including a photosensitive member, and an image forming unit that is provided around the photosensitive member and sequentially performs respective steps of charging, exposure, and development along with rotation of the photosensitive member.

In the image forming apparatus, a toner cartridge that replenishes a toner to a developing device configuring an image forming unit is replaceably mounted to a casing that accommodates a magnet roller in the developing device. The toner cartridge is arranged in opposed relation to the developing device in a longitudinal direction of the magnet roller in a state of being mounted in the casing. In the state where the toner cartridge is mounted in the casing, a replenishing port formed in the toner cartridge and a supply port formed in the casing are communicated with each other, and a toner is replenished from the toner cartridge to the developing device through the replenishing port and the supply port. Further, during replacement of the toner cartridge, a front cover of an image forming apparatus body is opened, and the toner cartridge is then attached and detached to and from the casing along the longitudinal direction described above.

Further, in such a laser printer, a toner box that is detachably mountable to the laser printer body has been proposed, and a mechanism to prevent toner leakage during attachment and detachment of the toner box has also been proposed together therewith.

For example, there has been proposed a toner replenishing device in which a cover provided in a main body case incorporating a copying mechanism is opened to attach and detach a toner cartridge to and from a toner container provided in the main body case.

In the toner replenishing device, a toner cartridge insertion portion and a toner storage section is provided in the toner container, and further, a shutter member is provided openably/closably between the toner cartridge insertion portion and the toner storage section. The shutter member is engaged with an engaging portion provided in the toner cartridge, and is moved to a closed position when the toner cartridge is moved to an attachment/detachment position. This seals the toner storage section with the shutter member, so that toner leakage from the toner storage section (on the body casing side) can be prevented during attachment/detachment of the toner cartridge.

Further, there has been proposed a color electrophotographic printer including a photosensitive member, and a plurality of developers for developing an electrostatic latent image formed on the photosensitive member.

In the color electrophotographic printer, a toner cartridge is detachably mounted in a developing housing of each developer, and a toner is supplied from a toner discharge port of the toner cartridge to a toner supply port in the developing housing. A cartridge-side shutter for opening/closing the toner discharge port, and a developer-side shutter for opening/closing the toner supply port are provided in the toner cartridge and the developing housing, respectively. The cartridge-side shutter is engaged with a shutter engaging piece formed on the developing housing, and the developer-side shutter is engaged with a shutter engaging piece formed on the toner cartridge. Therefore, when the toner cartridge is pivoted, the cartridge-side shutter and the developer-side shutter are opened/closed together, so that the toner discharge port and the toner supply port are opened/closed. Thus, during attachment/detachment of the toner cartridge, the toner discharge port and the toner supply port are closed by closing the cartridge-side shutter and the developer-side shutter, thereby preventing toner leakage from the toner cartridge and the developer (on the color electrophotographic printer body side).

Further, there has been proposed a laser printer in which a photosensitive member is provided in an apparatus body, a developer is arranged around the photosensitive member, and an electrostatic latent image formed on a surface of the photosensitive member is transformed into a visible image.

In the laser printer, a toner cartridge is detachably mounted to the developer, and a toner is supplied from the toner cartridge to the developer through an opening provided in the toner cartridge and a replenishing port provided in a developing chamber of the developer. The toner cartridge has a shutter for opening/closing the opening, and the shutter is opened/closed by opening/closing an upper structure, which is a cover of an apparatus body, after the toner cartridge is attached to the developer. Thus, during attachment/detachment of the toner cartridge, the opening is closed by closing the shutter, thereby preventing toner leakage from the toner cartridge.

In the image forming apparatus, since the toner cartridge is arranged in opposed relation to the developing device in the longitudinal direction of the magnet roller, the size of the image forming apparatus can be reduced in the up and down direction, as compared with a case where the toner cartridge is arranged in opposed relation to the developing device in the up and down direction that intersects a longitudinal direction of the toner cartridge.

However, in the image forming apparatus, in a state where the toner cartridge is mounted in the casing of the developing device, the replenishing port is positioned above the supply port, and a toner in the toner cartridge is accommodated at a position above the replenishing port. Therefore, the toner cartridge and the image forming apparatus increase in size in the up and down direction, so that miniaturization of the image forming apparatus in the up and down direction is limited.

Further, in the image forming apparatus, the toner cartridge is attached and detached to and from the casing of the developing device along the longitudinal direction of the magnet roller during replacement. For this reason, when the longitudinal size of the image forming apparatus body is limited, the longitudinal size of the toner cartridge needs to be reduced. In that case, there is a possibility that a sufficient amount of toner can not be accommodated in the toner cartridge.

In the image forming apparatus of a toner cartridge replaceable type, it is desirable to be able to easily replace the toner cartridge.

In the toner replenishing device, a user needs to directly operate the toner cartridge when opening/closing the shutter member. Therefore, in order to open/close the shutter member, the user should first open the cover, and then operate the toner cartridge. Further, after opening/closing the shutter member, the user need to close the cover, which is laborsome.

In the color electrophotographic printer, a user has to directly operate the toner cartridge when opening/closing the cartridge-side shutter and the developer-side shutter, which requires similar labor if the printer includes a structure equivalent to the cover described above.

In the laser printer, the shutter of the toner cartridge is opened/closed in conjunction with opening/closing of the upper structure, thereby achieving laborsaving in opening/closing of the shutter. However, there is no shutter for opening/closing the replenishing port in the developer, so that toner leakage from the developer (on the apparatus body side) is a concern during attachment/detachment of the toner cartridge.

SUMMARY

One aspect of the present invention may provide an image forming apparatus that can reliably attain miniaturization, and a developing agent cartridge mounted therein.

Another aspect of the present invention may provide an image forming apparatus capable of keeping a sufficient amount of developing agent in the developing agent cartridge while achieving miniaturization, and further improving operability.

Another aspect of the present invention may provide an image forming apparatus capable of easily opening/closing a shutter member of a casing, and a shutter member of the developing agent cartridge.

The same or different aspect of the present invention may provide an image forming apparatus including: an image carrier on which an electrostatic latent image is formed; a developing agent carrier that transforms the electrostatic latent image into a visible image by supplying a developing agent to the image carrier; and a developing agent cartridge that accommodates the developing agent to be supplied to the developing agent carrier, arranged so as to be opposed to the developing agent carrier in a longitudinal direction of the developing agent carrier, and formed with an opening for horizontally passing the developing agent in a position horizontally opposed to the developing agent carrier.

One or more aspects of the present invention provide a developing agent cartridge accommodating a developing agent to be supplied to a developing agent carrier, and configured to be detachably mounted to a casing of an image forming apparatus, wherein the developing agent cartridge is arranged so as to be opposed to the developing agent carrier in a longitudinal direction of the developing agent carrier, and formed with an opening for horizontally passing the developing agent in a position horizontally opposed to the developing agent carrier, and the developing agent cartridge includes: a developing agent passing portion in which the opening is formed, allowing passage of the developing agent to the opening; and a developing agent accommodating portion that is horizontally extended from the developing agent passing portion toward a direction orthogonal to the longitudinal direction of the developing agent carrier, and accommodates the developing agent.

One or more aspects of the present invention provide an image forming apparatus including: a casing; an image carrier on which an electrostatic latent image is formed; a developing agent carrier that is arranged in opposed relation to the image carrier and forms a developing agent image by supplying a developing agent to the image carrier to transform the electrostatic latent image into a visible image; a transfer member that is arranged in opposed relation to the image carrier and transfers the developing agent image to a recording medium; a fixing unit that is arranged on the opposite side to the developing agent carrier with respect to the image carrier, and fixes the developing agent image transferred on the recording medium, onto the recording medium; a recording-medium ejecting section which is arranged on the opposite side to the image carrier with respect to the fixing unit and to which the recording medium is ejected; and a developing agent cartridge that is arranged so as to be opposed to the developing agent carrier in a longitudinal direction of the developing agent carrier, extended along an arranging direction from the developing agent carrier to the recording-medium ejecting section, configured to be detachably mountable to the casing from a recording-medium ejecting section side in the arranging direction, and accommodates the developing agent to be supplied to the developing agent carrier.

One or more aspects of the present invention provide an image forming apparatus including: an image carrier on which an electrostatic latent image is formed; a developing agent carrier that transforms the electrostatic latent image into a visible image by supplying a developing agent to the image carrier; a casing that accommodates the developing agent carrier and is formed with a first opening; a first shutter member provided in the casing, and opening and closing the first opening; a developing agent cartridge formed with a second opening that communicates with the first opening, configured to be attached to and detached from the casing, and accommodating the developing agent to be supplied to the developing agent carrier; a second shutter member provided in the developing agent cartridge, and opening and closing the second opening; a cover openably covering a third opening formed in a position opposed to the developing agent cartridge in an attachment/detachment direction of the developing agent cartridge in the casing in order to pass the developing agent cartridge attached to and detached from to the casing, wherein the first shutter member and the second shutter member are opened and closed in conjunction with an opening/closing operation of the cover.

Figure 1:
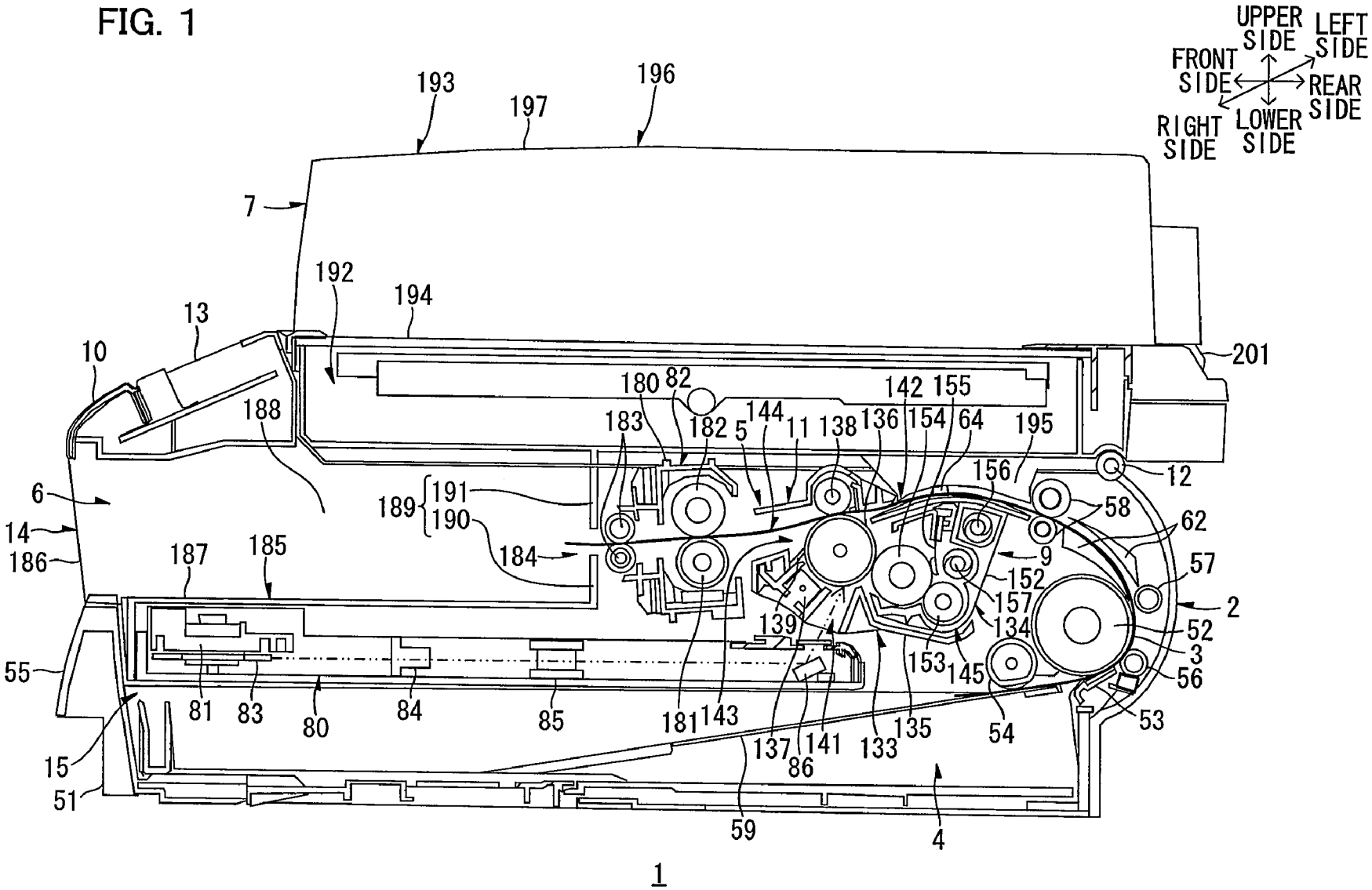
FIG. 1 shows a side sectional view of the major portion of an illustrative aspect of a laser printer as an example of an image forming apparatus of one or more aspects of the present invention, showing a mode in which a scanning unit described later is closed.
Figure 5:
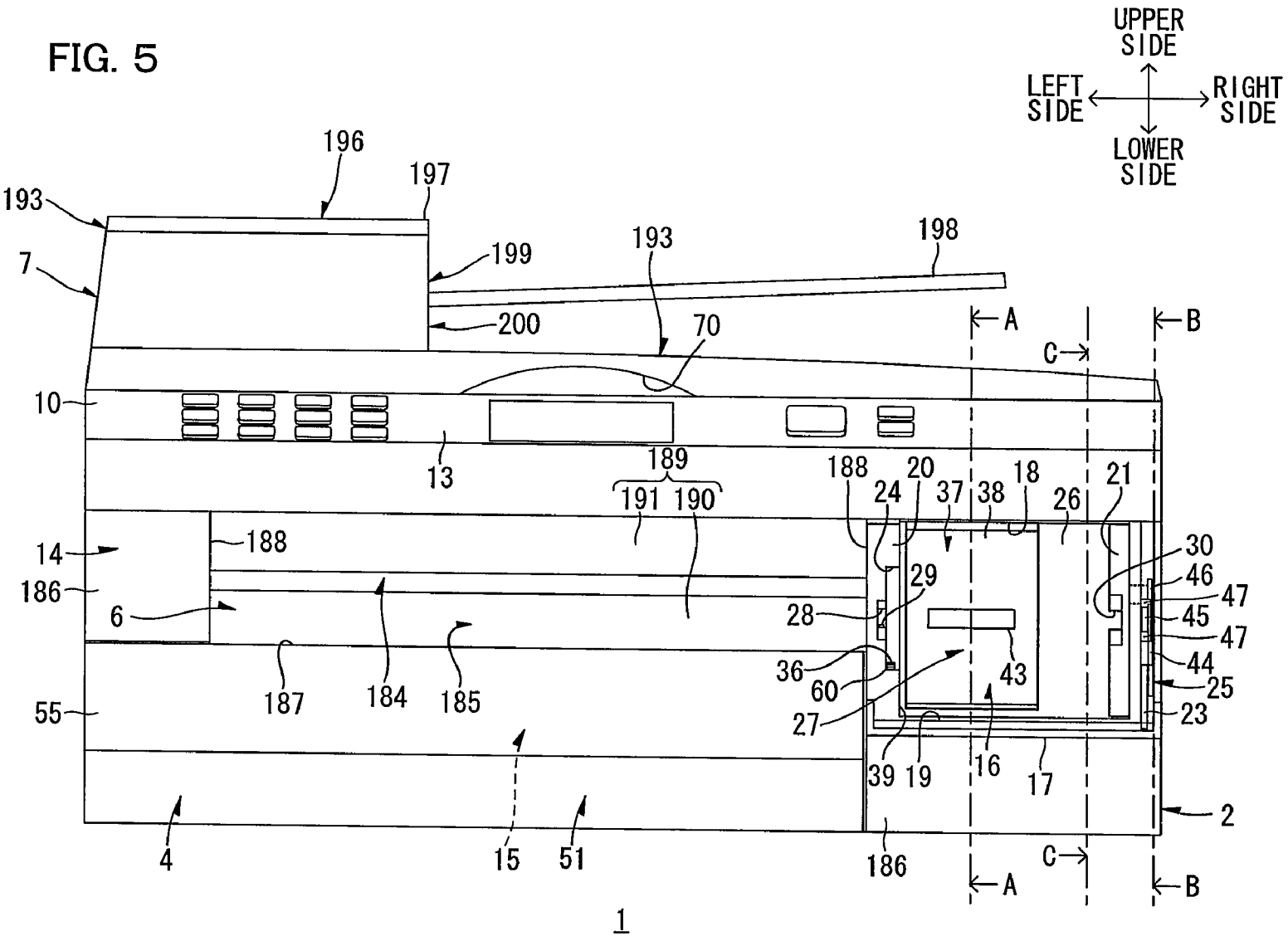
FIG. 5 shows a front view of the laser printer in a state where the cover is in the cover open position.
Figure 7:
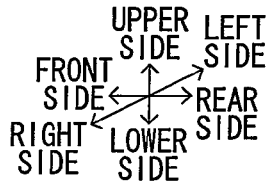
Figure 7:
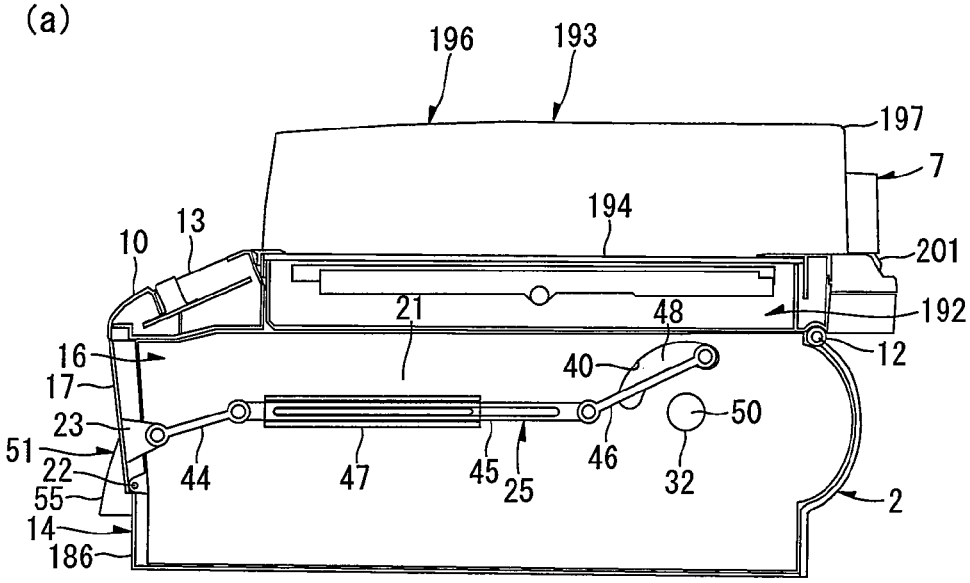
Figure 7:
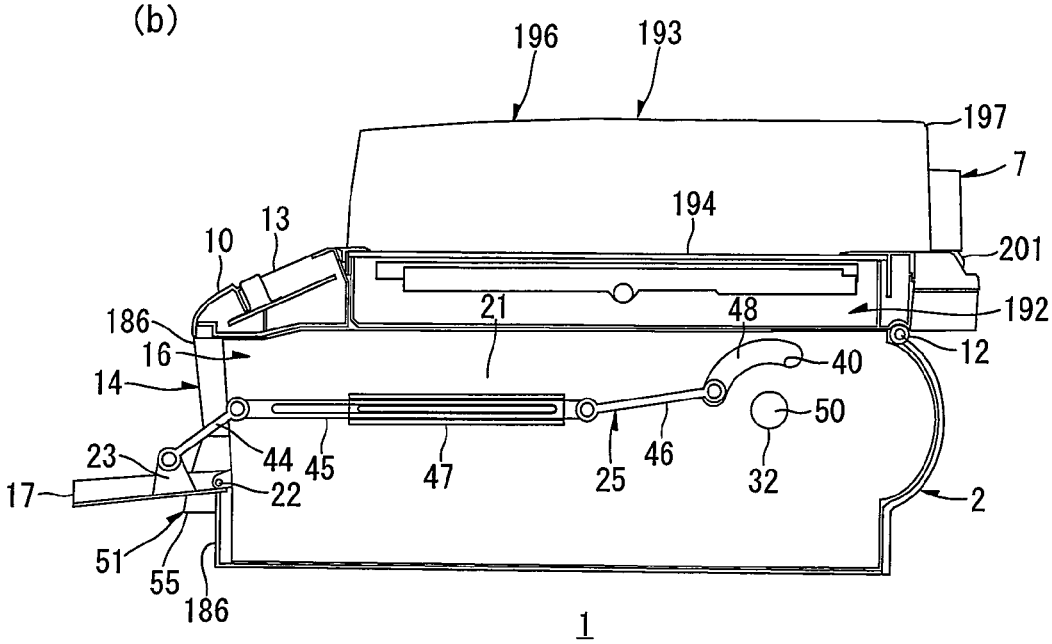
Figure 8:
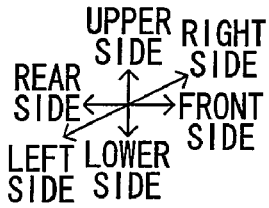
Figure 8:
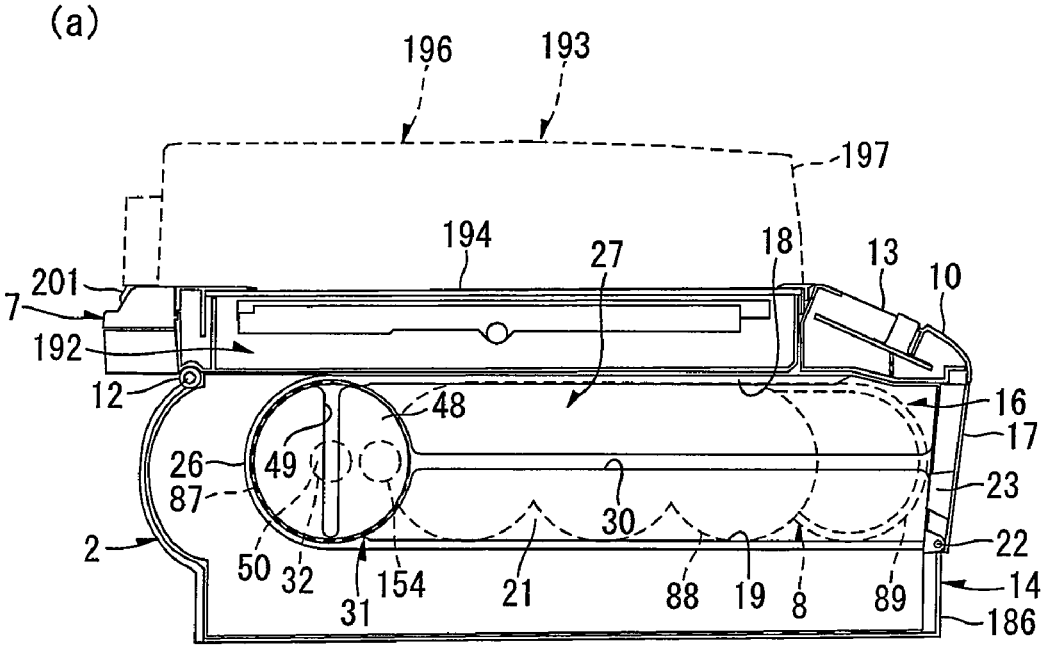
Figure 8:
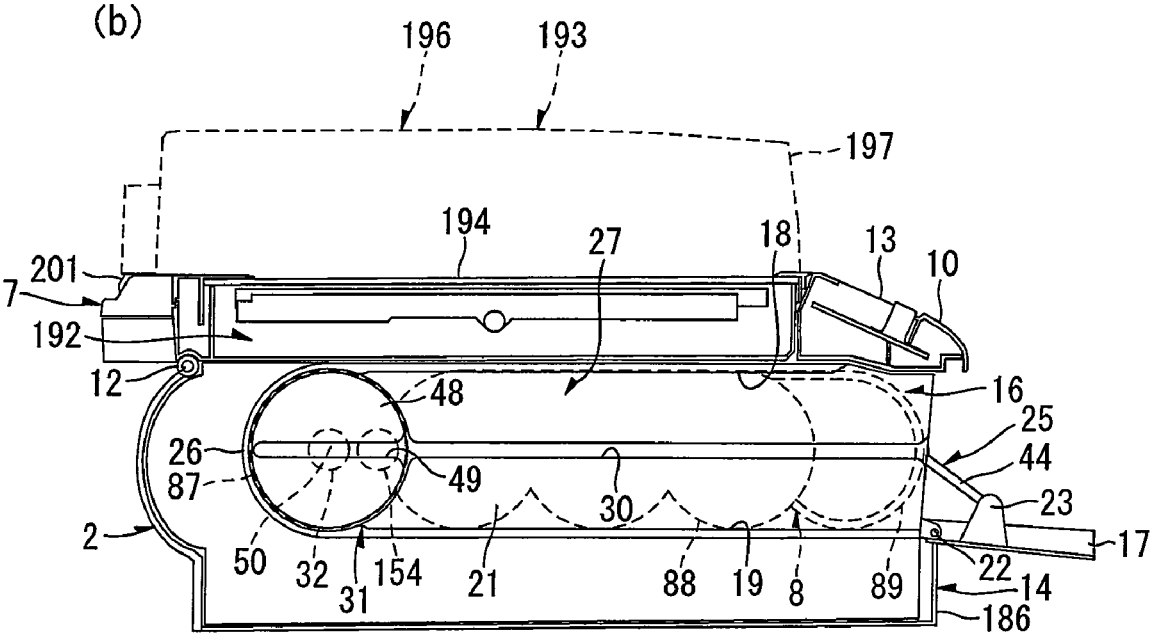
Figure 9:
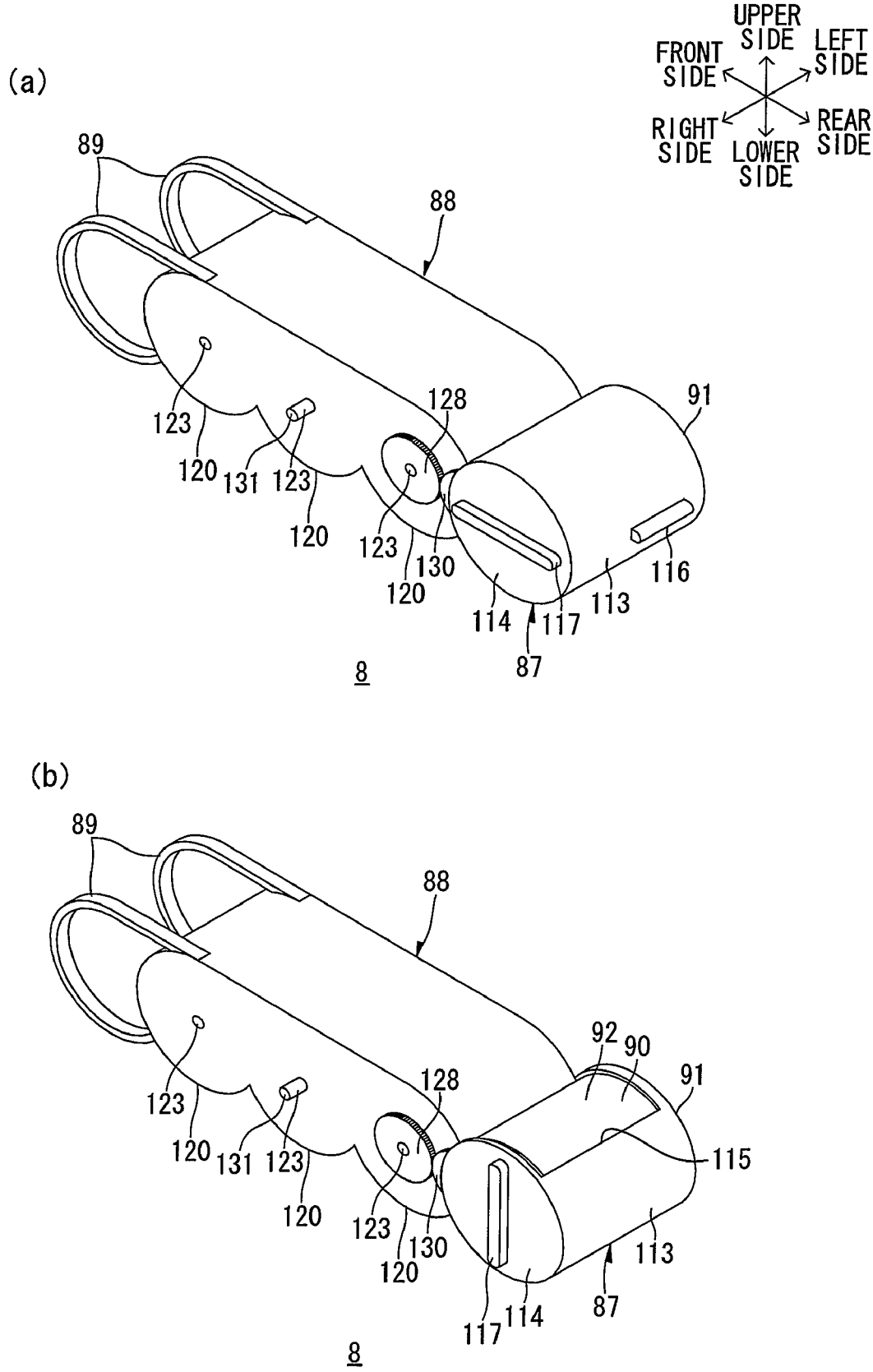
Figure 10:
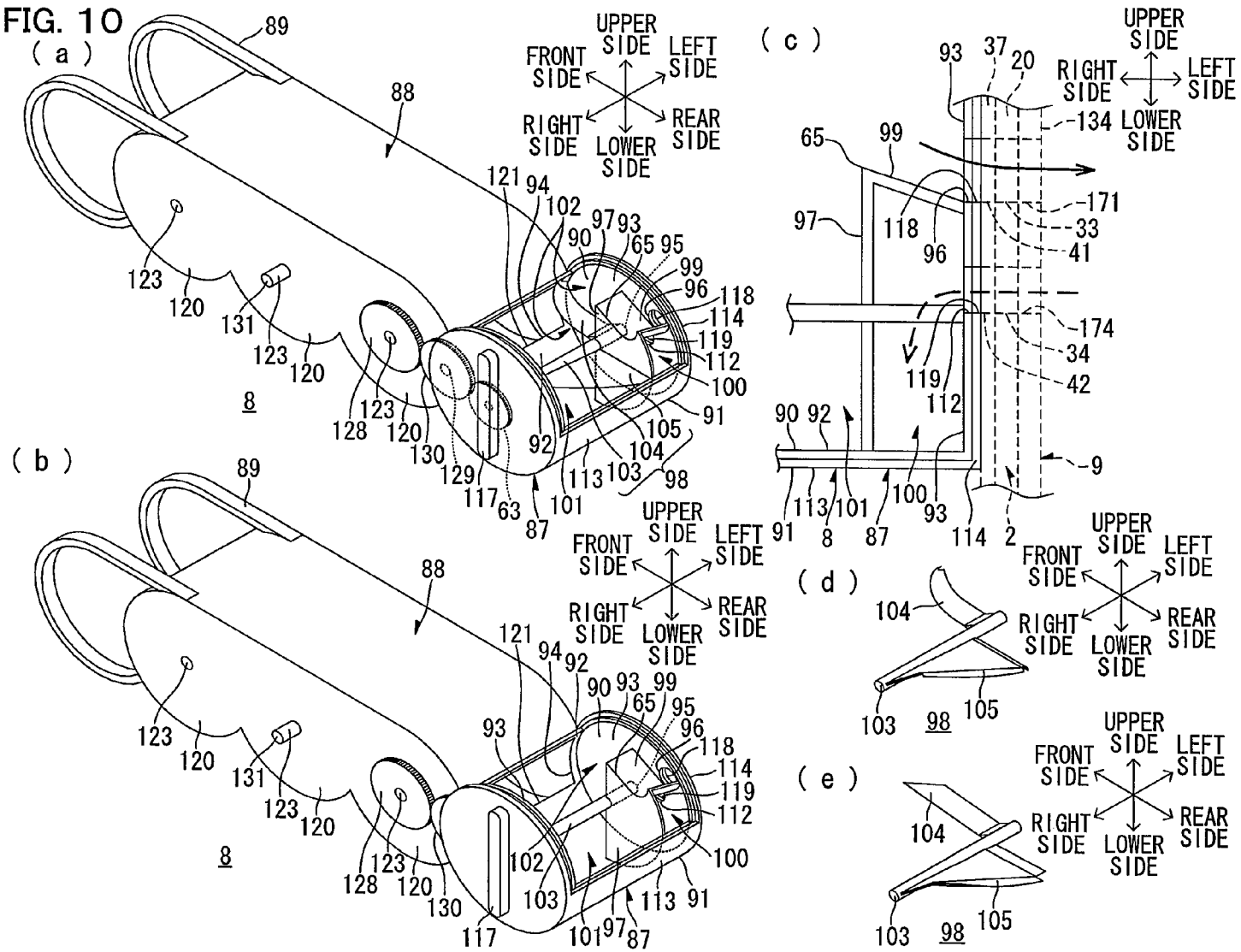
Figure 11:
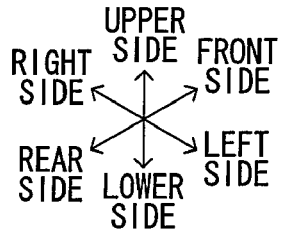
Figure 11:
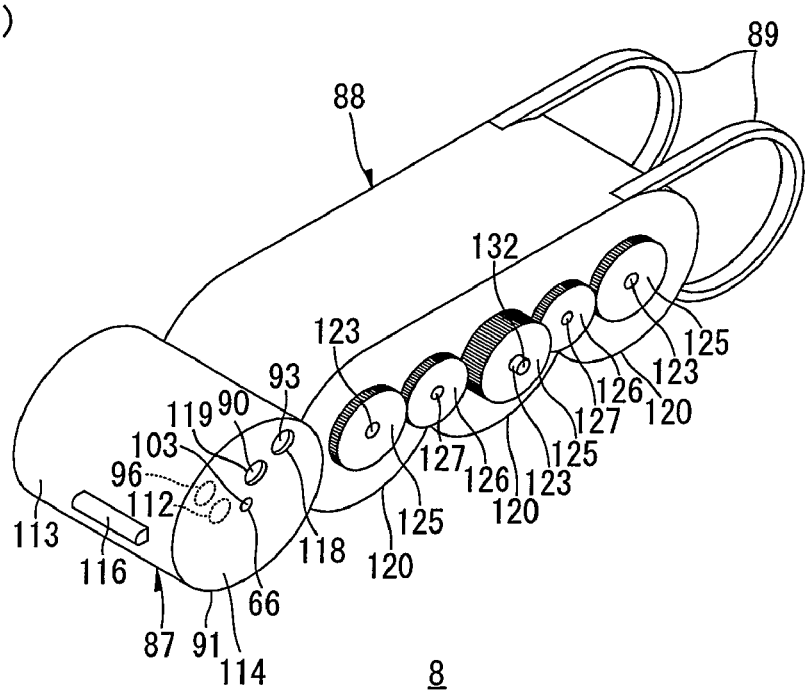
Figure 11:
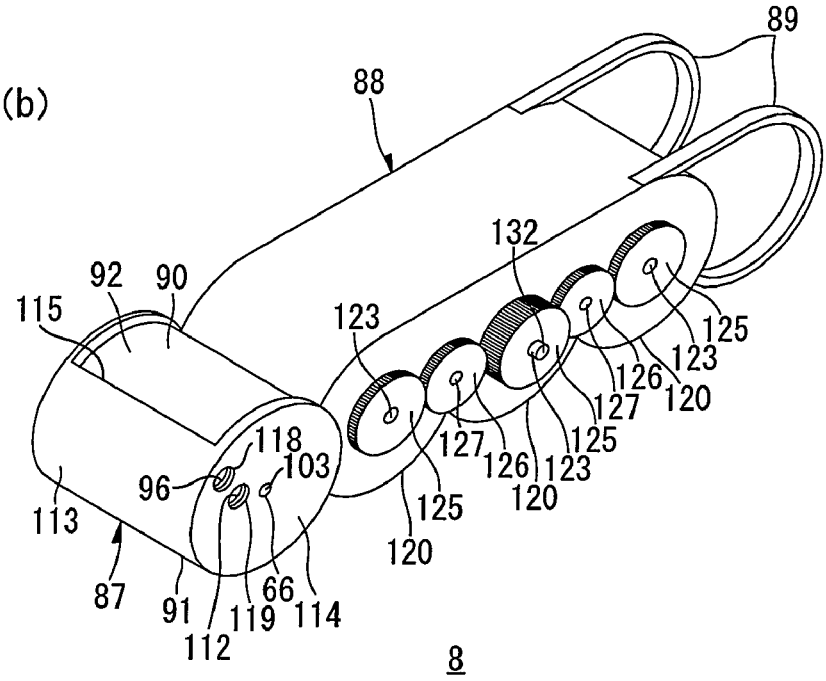
Figure 12:
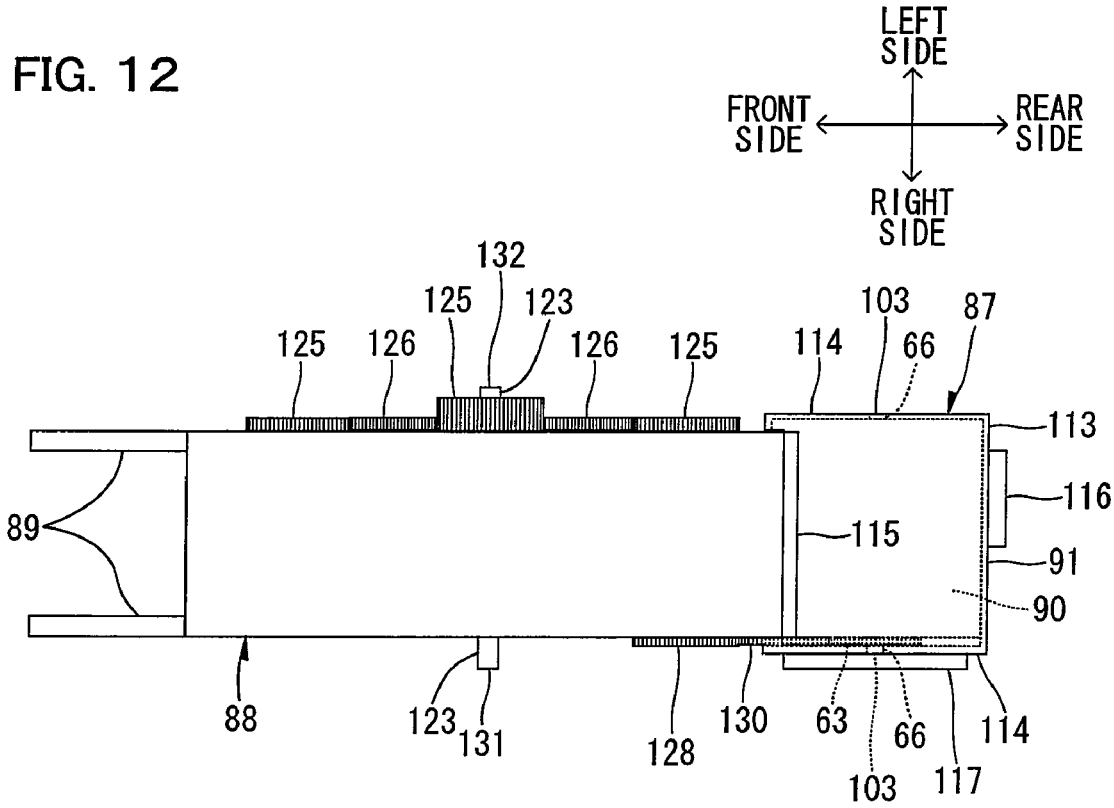
Figure 13:
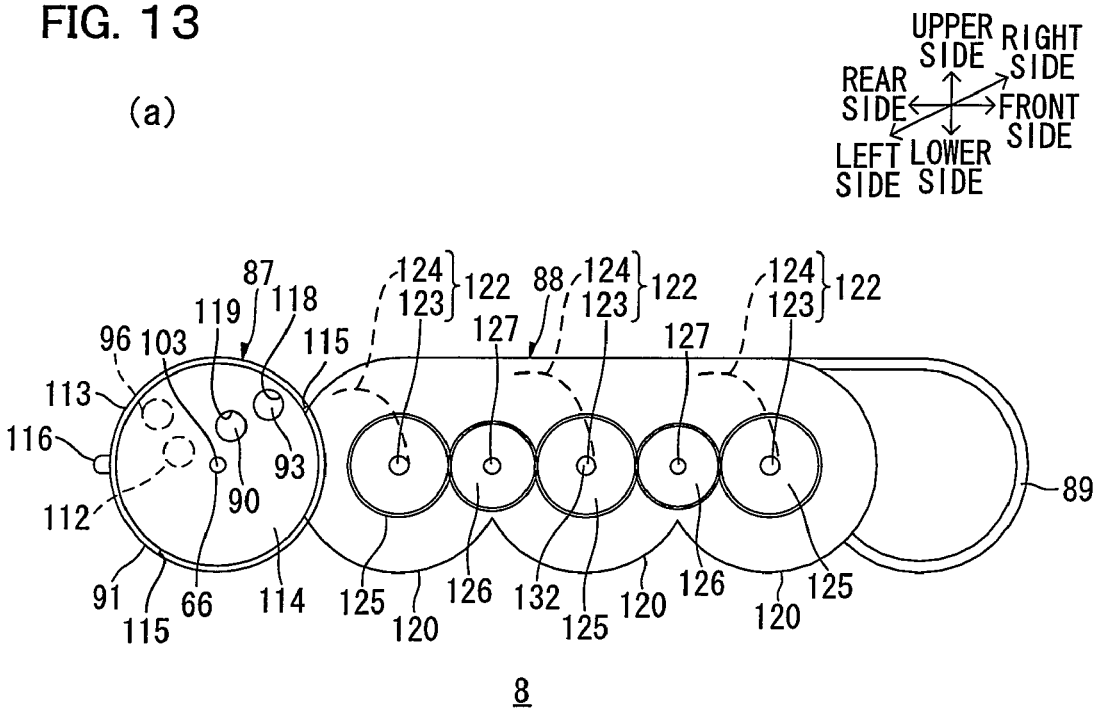
Figure 13:
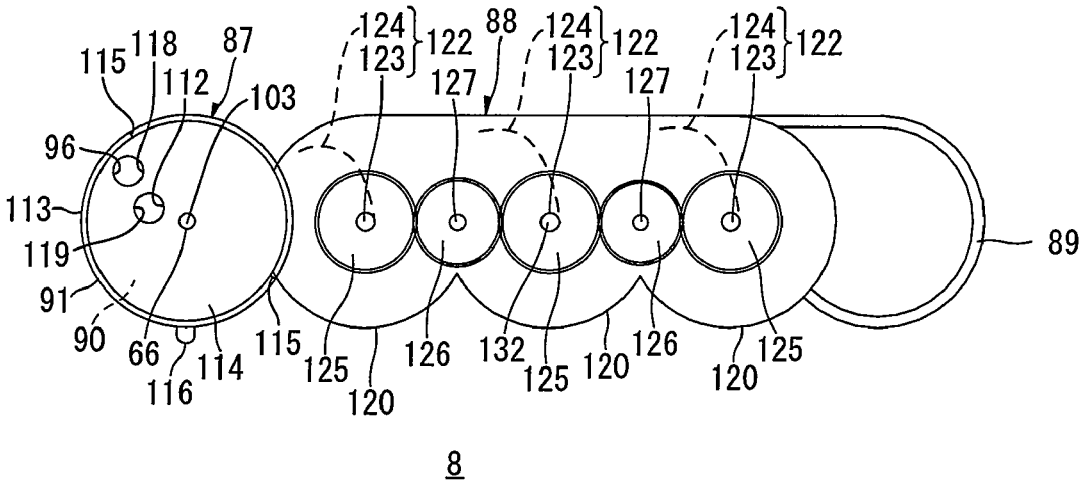
Figure 14:
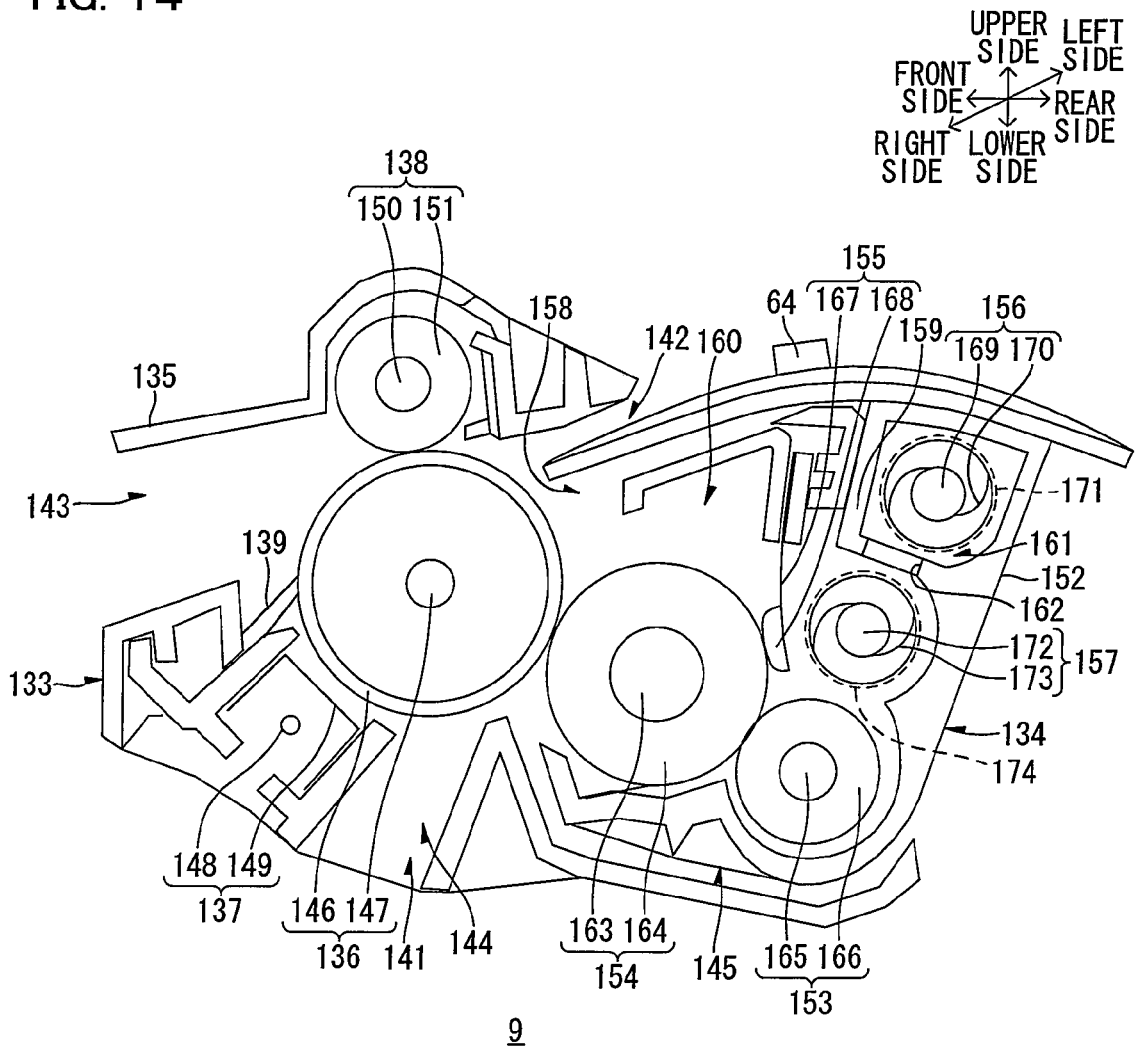
Figure 15:
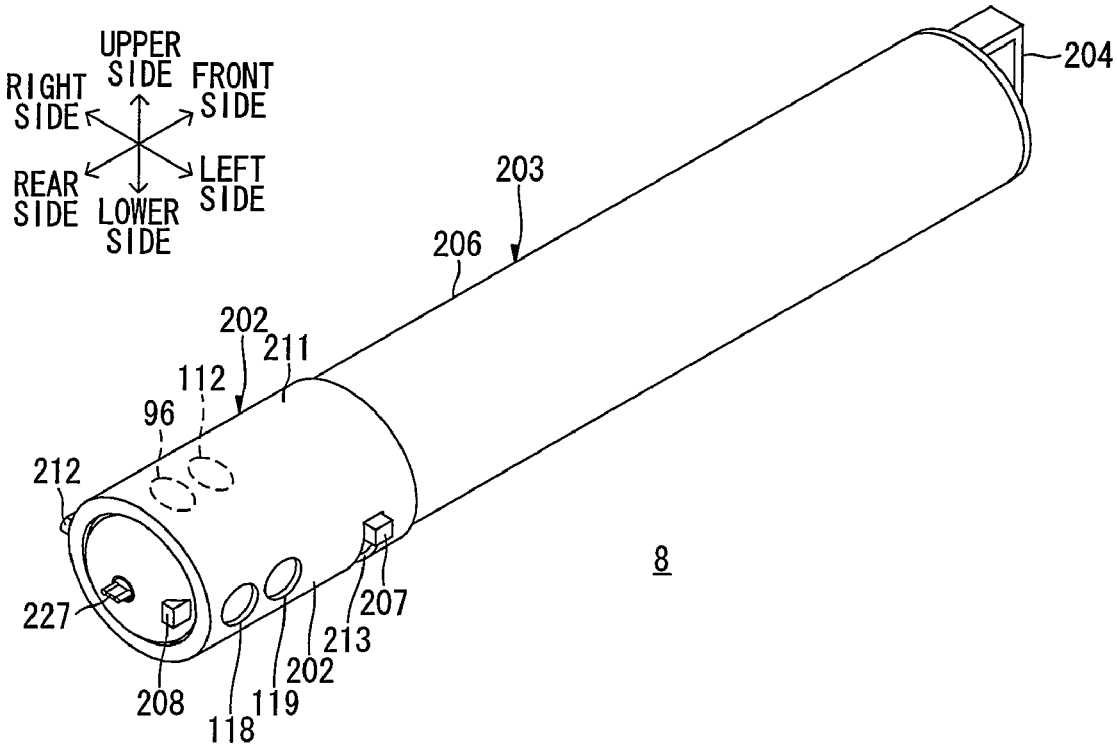
Figure 15:
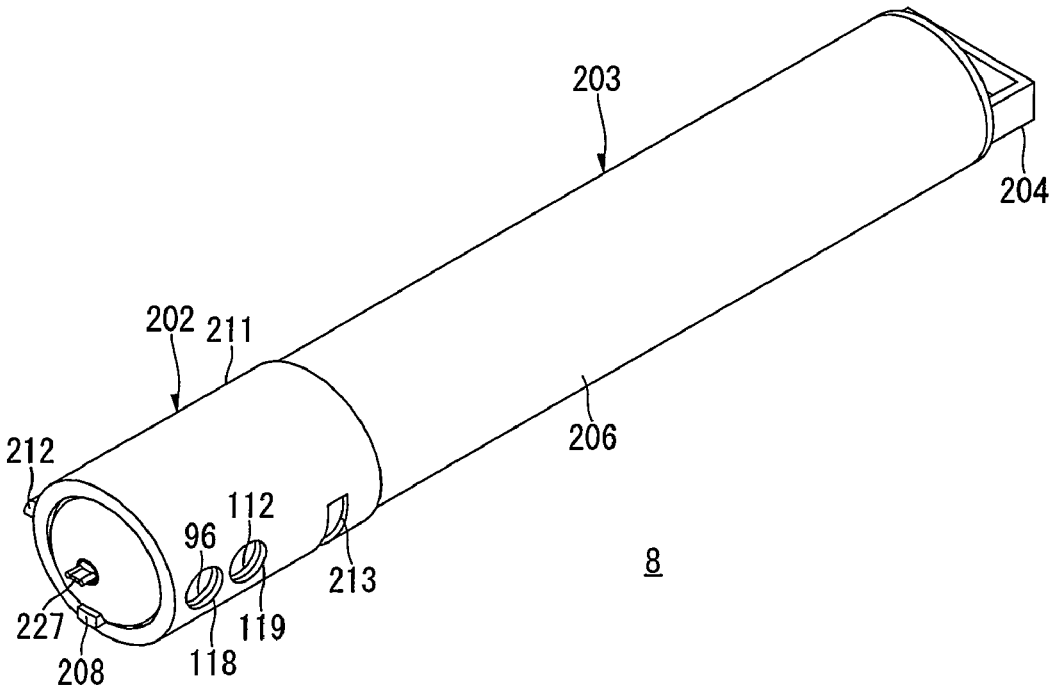
Figure 16:
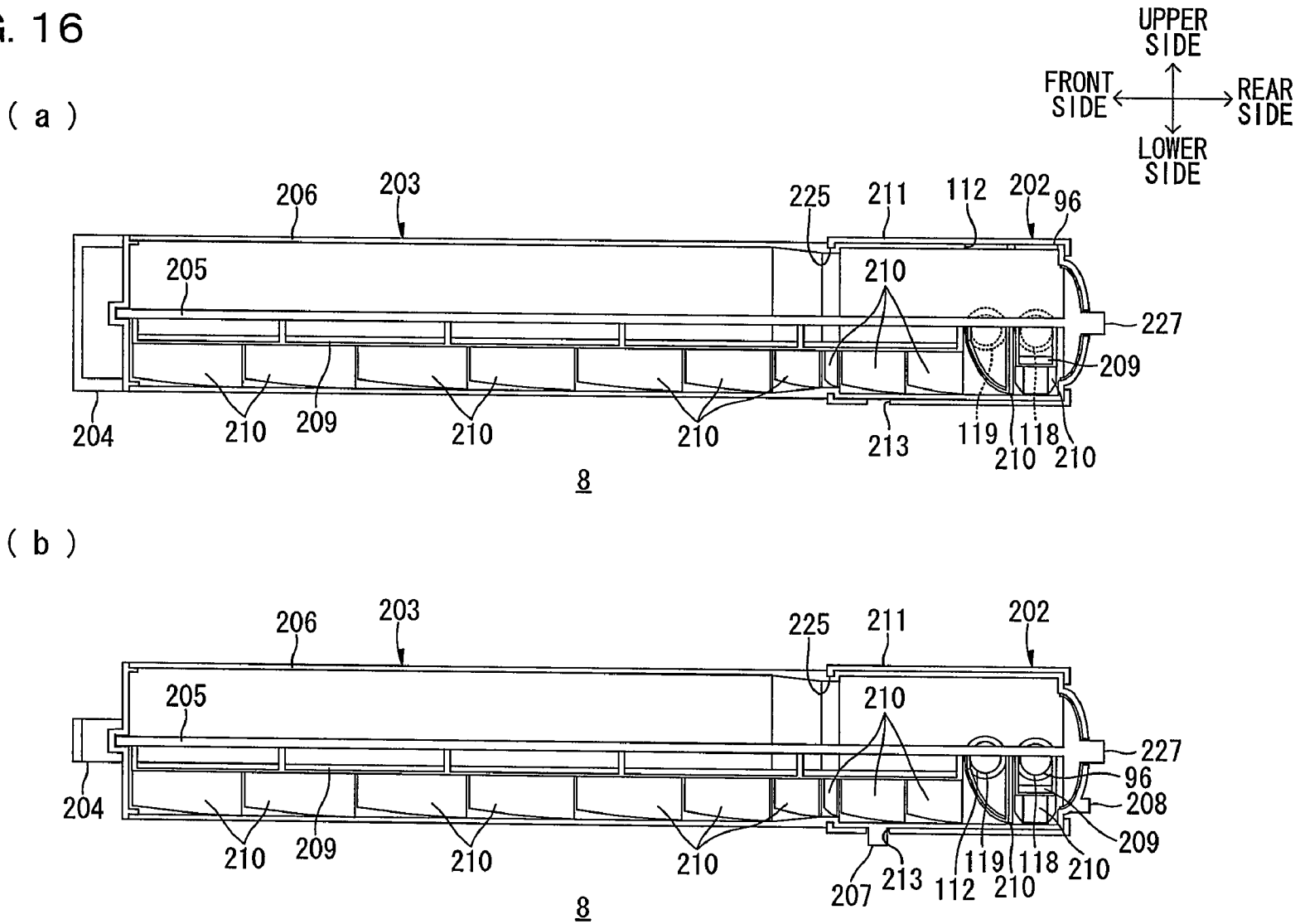
Figure 17:
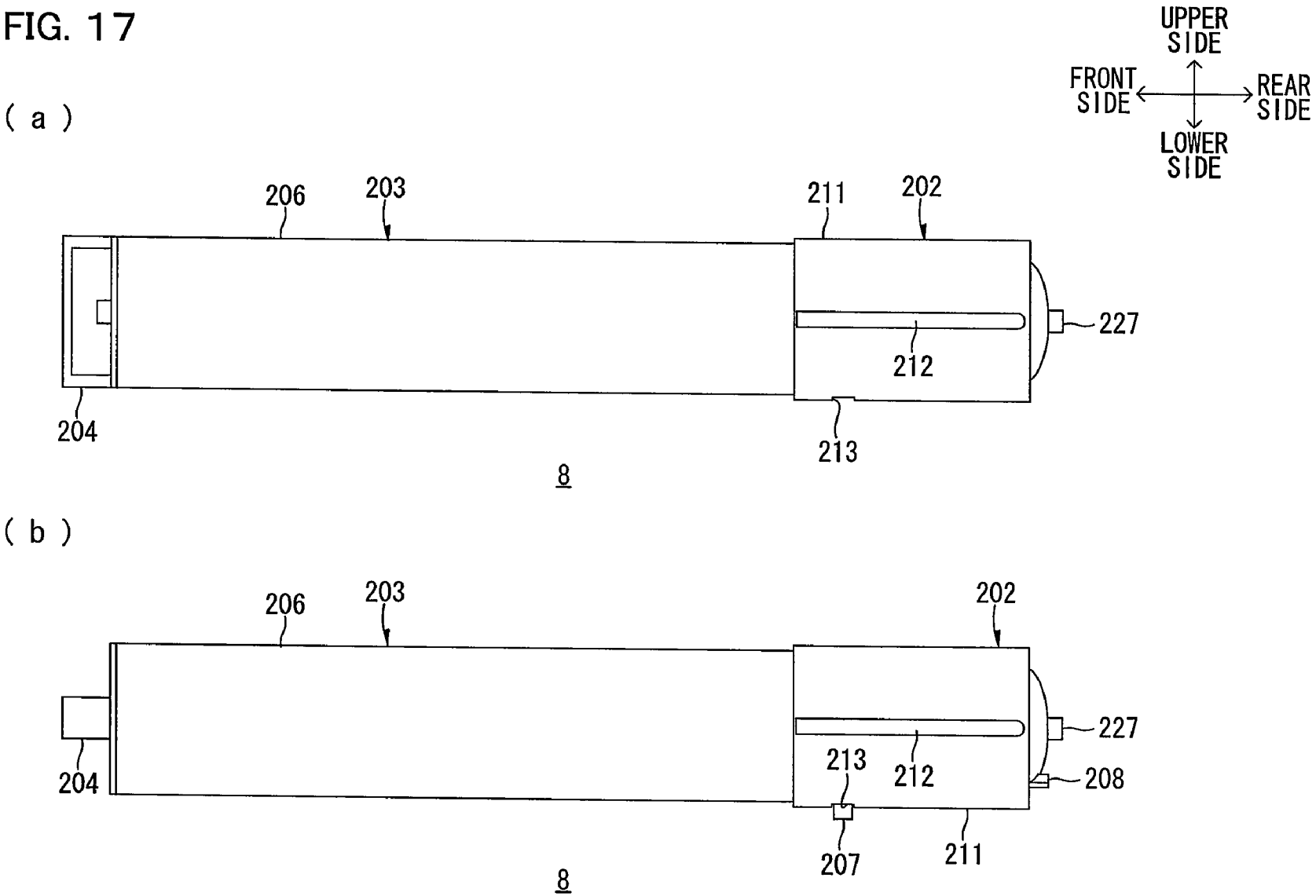
Figure 18:
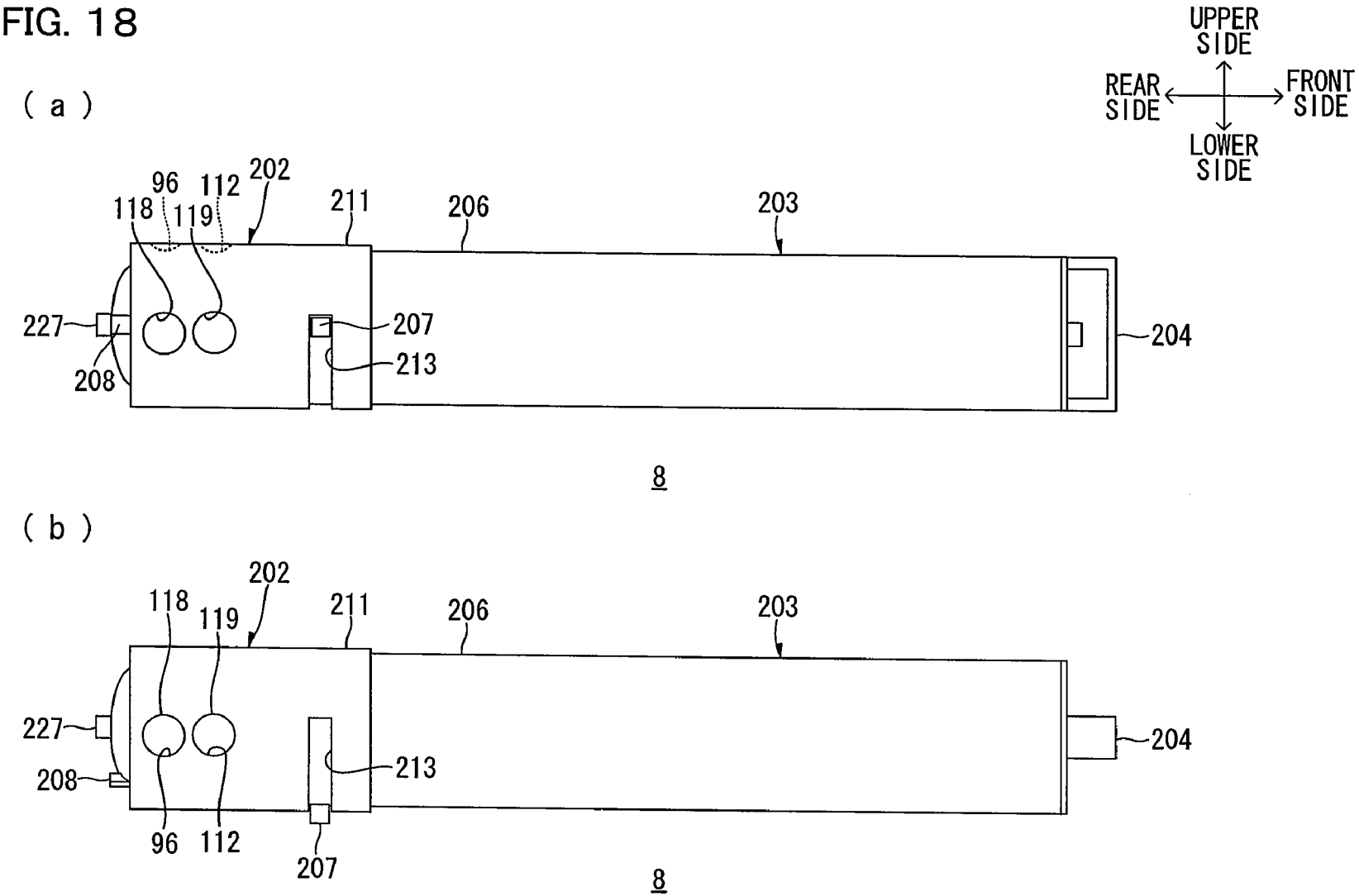
Figure 19:
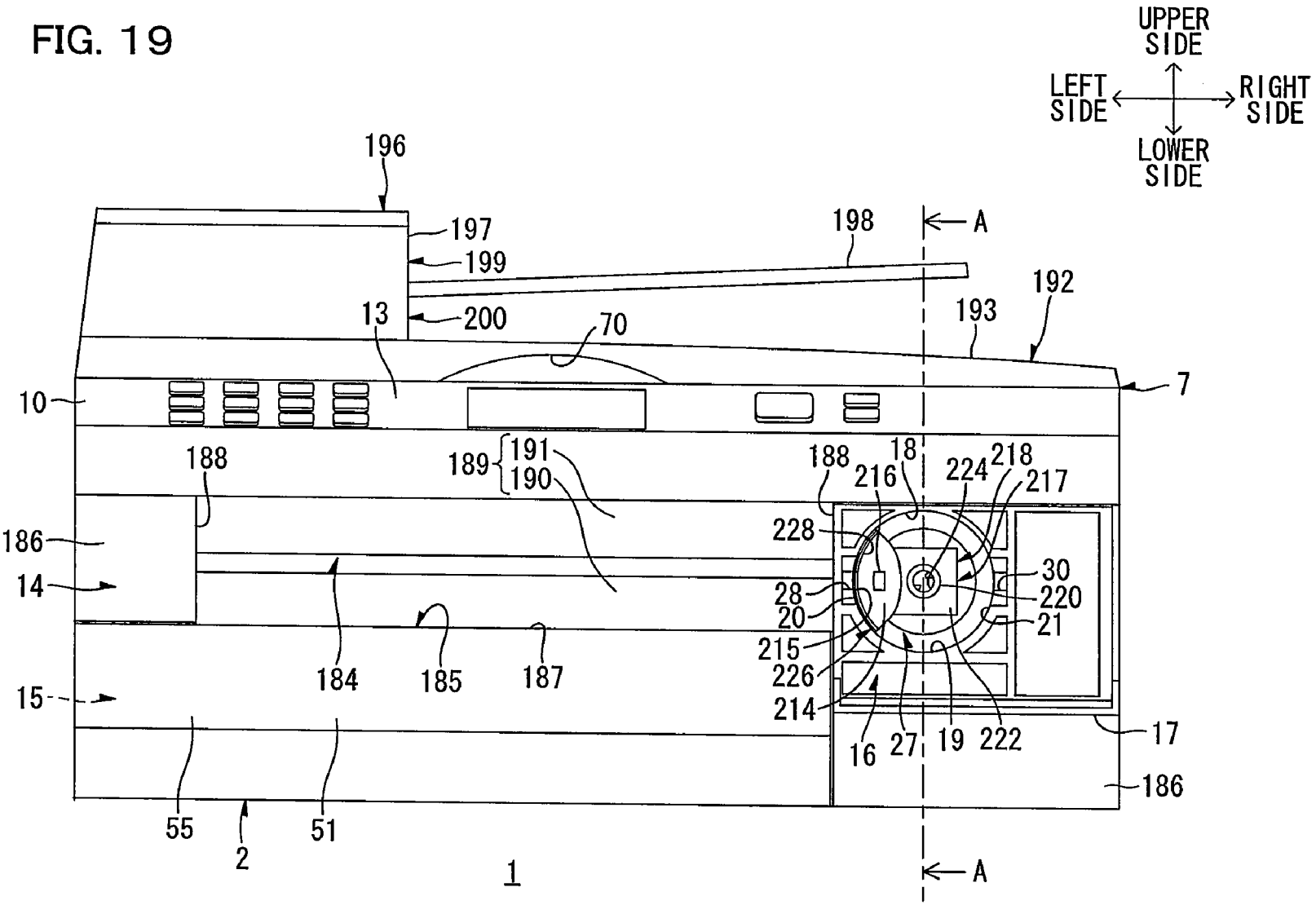
Figure 20:
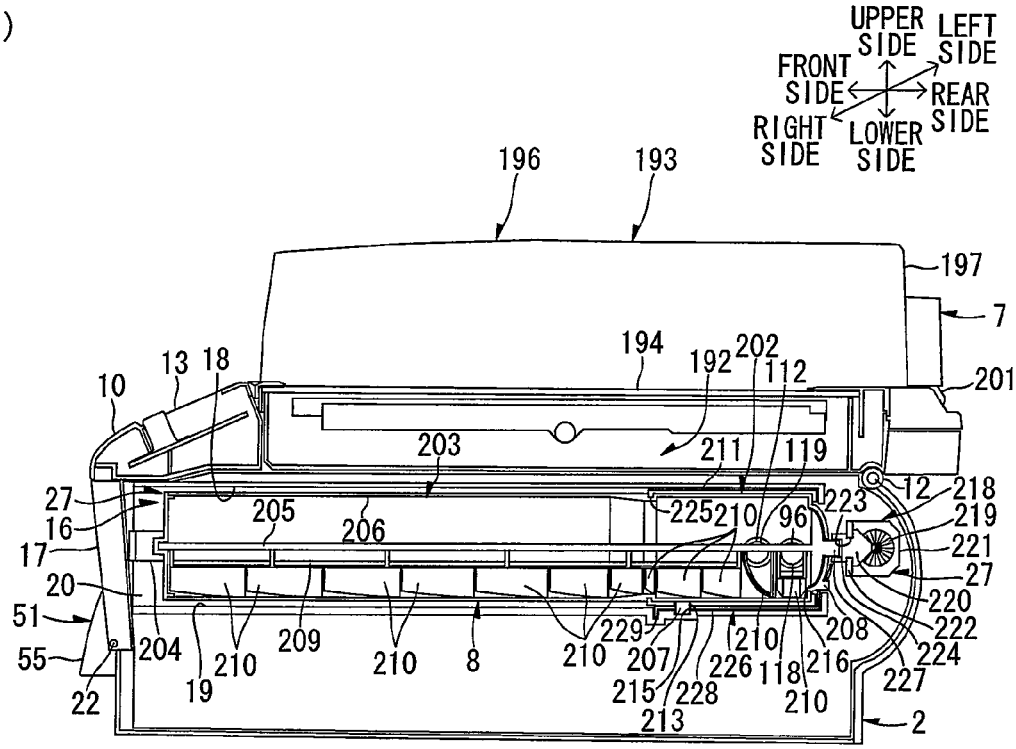
Figure 20:
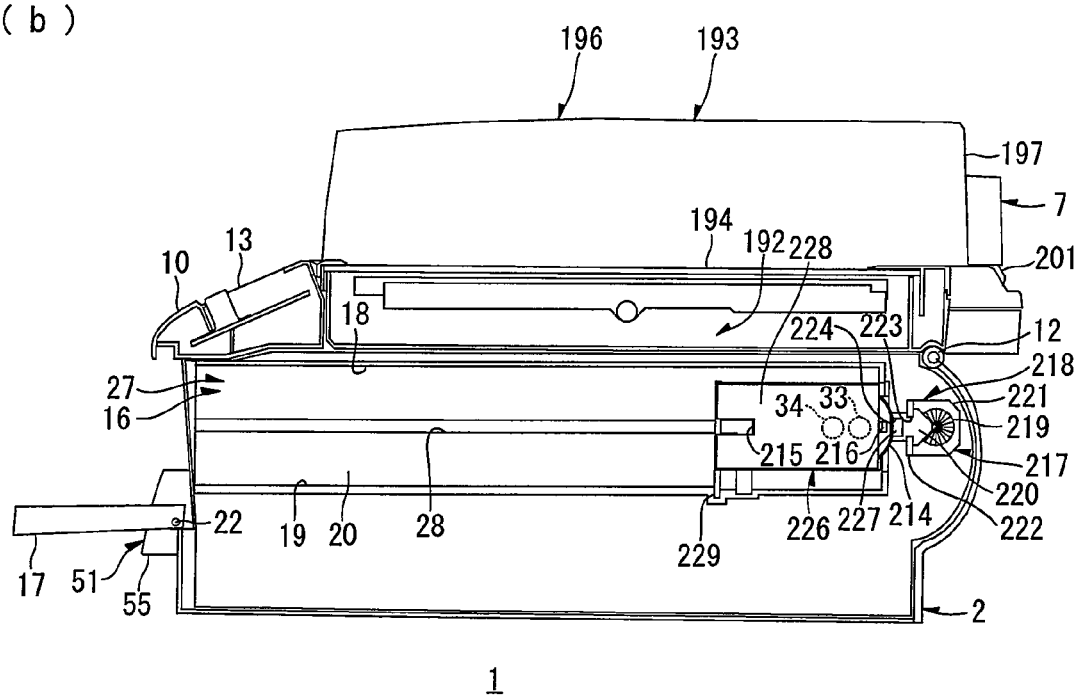

(*a*) illustrates a state where the cover is in a cover closed position; and (*b*) illustrates a state where the cover is in the cover open position;

FIG. 7 shows views along a line B-B in FIG. 5:

(*a*) illustrates a state where the cover is in the cover closed position; and (*b*) illustrates a state where the cover is in the cover open position;

FIG. 8 shows views along a line C-C in FIG. 5:

(*a*) illustrates a state where the cover is in the cover closed position; and (*b*) illustrates a state where the cover is in the cover open position;

FIG. 9 shows perspective views of a toner cartridge seen from obliquely above in the rear right thereof:

(*a*) illustrates a state where an outer cylindrical portion is in a cartridge shutter closed position; and (*b*) illustrates a state where the outer cylindrical portion is in a cartridge shutter open position;

FIG. 10 shows views for explaining an inner portion of the toner cartridge in FIG. 9(*b*):

(*a*) illustrates an inner portion of an inner cylindrical portion;

(*b*) illustrates a state where an agitating mechanism is removed in (*a*);

(*c*) illustrates a sectional view of the periphery of a partition wall seen from its rear side;

(*d*) illustrates the agitating mechanism in (*a*) excerpted with a flexible film bent; and (*e*) illustrates the agitating mechanism in (*d*) excerpted with the flexible film not bent;

FIG. 11 shows perspective views of the toner cartridge seen from obliquely above in the rear left thereof:

(*a*) illustrates a state where the outer cylindrical portion is in the cartridge shutter closed position; and (*b*) illustrates a state where the outer cylindrical portion is in the cartridge shutter open position;

FIG. 12 shows a plan view of the toner cartridge in a state where the outer cylindrical portion is in the cartridge shutter closed position (it should be noted that the major portion of a developing agent passing portion is shown as a sectional view);

FIG. 13 shows left side views of the toner cartridge:

(*a*) illustrates a state where the outer cylindrical portion is in the cartridge shutter closed position; and (*b*) illustrates a state where the outer cylindrical portion is in the cartridge shutter open position;

FIG. 14 shows a processing section excerpted from FIG. 1;

FIG. 15 shows perspective views of the toner cartridge seen from obliquely above in the rear left thereof according to a third embodiment:

(*a*) illustrates a state where a developing agent accommodating portion is in a cartridge shutter closed position; and (*b*) illustrates a state where the developing agent accommodating portion is in a cartridge shutter open position;

FIG. 16 shows right-side sectional views of the toner cartridge according to a third embodiment:

(*a*) illustrates a state where the developing agent accommodating portion is in the cartridge shutter closed position; and (*b*) illustrates a state where the developing agent accommodating portion is in the cartridge shutter open position;

FIG. 17 shows right side views of the toner cartridge according to a third embodiment:

(*a*) illustrates a state where the developing agent accommodating portion is in the cartridge shutter closed position; and (*b*) illustrates a state where the developing agent accommodating portion is in the cartridge shutter open position;

FIG. 18 shows left side views of the toner cartridge according to a third embodiment:

(*a*) illustrates a state where the developing agent accommodating portion is in the cartridge shutter closed position; and (*b*) illustrates a state where the developing agent accommodating portion is in the cartridge shutter open position;

FIG. 19 shows a front view of a laser printer to which a cartridge receiving space is applied according to the third embodiment; and FIG. 20 shows views along a line A-A in FIG. 19:

(*a*) illustrates a state where the toner cartridge is accommodated in the cartridge receiving space and a cover is in a cover closed position; and (*b*) illustrates a state where the toner cartridge is not accommodated in the cartridge receiving space and the cover is in a cover open position.

DETAILED DESCRIPTION

The embodiments of the present invention will be described below while referring to the drawings.

First Embodiment

1. General Structure of Laser Printer

Figure 2:
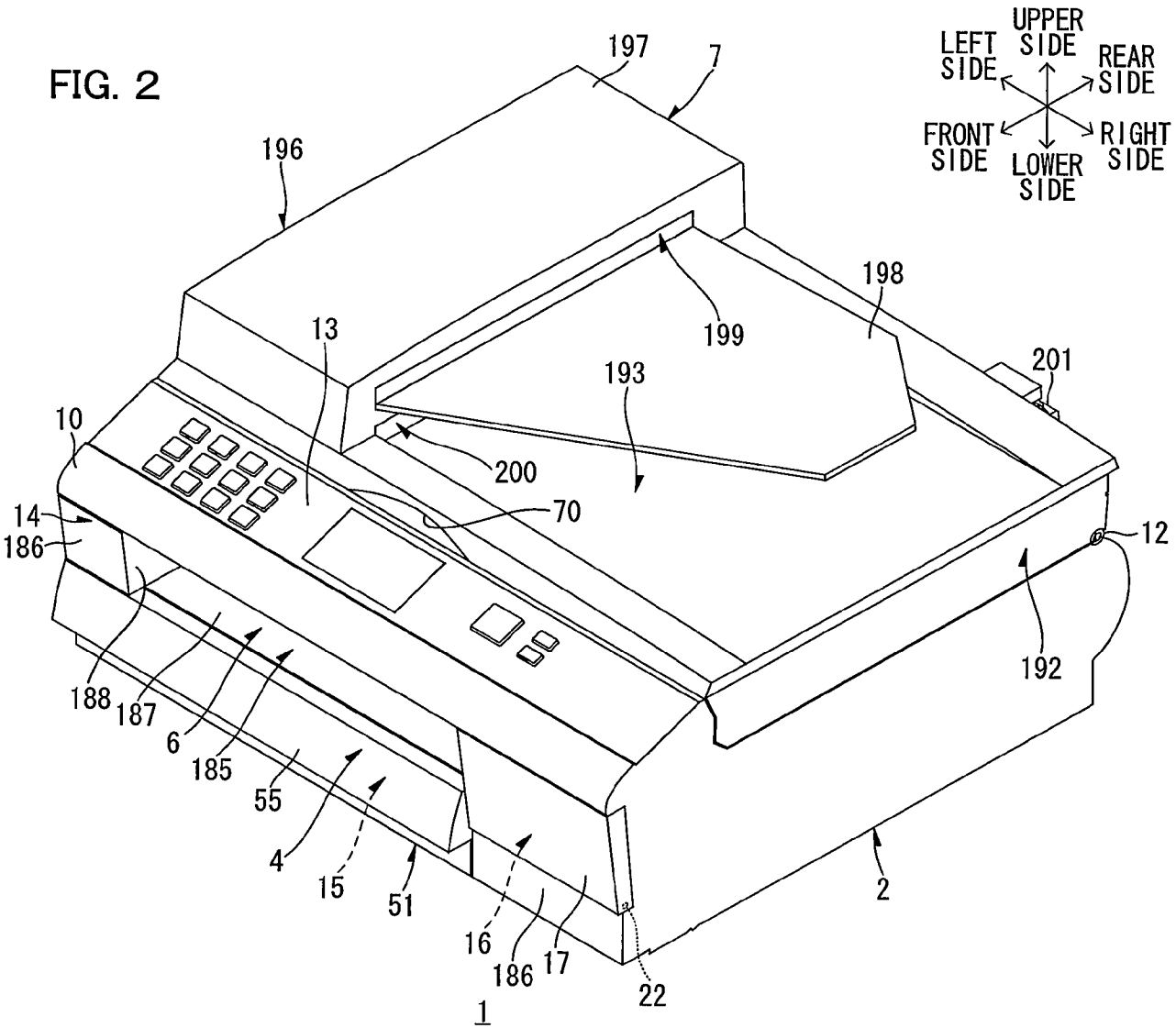
FIG. 2 shows a perspective view of the laser printer shown in FIG. 1, seen from obliquely above in the front right thereof.
Figure 3:
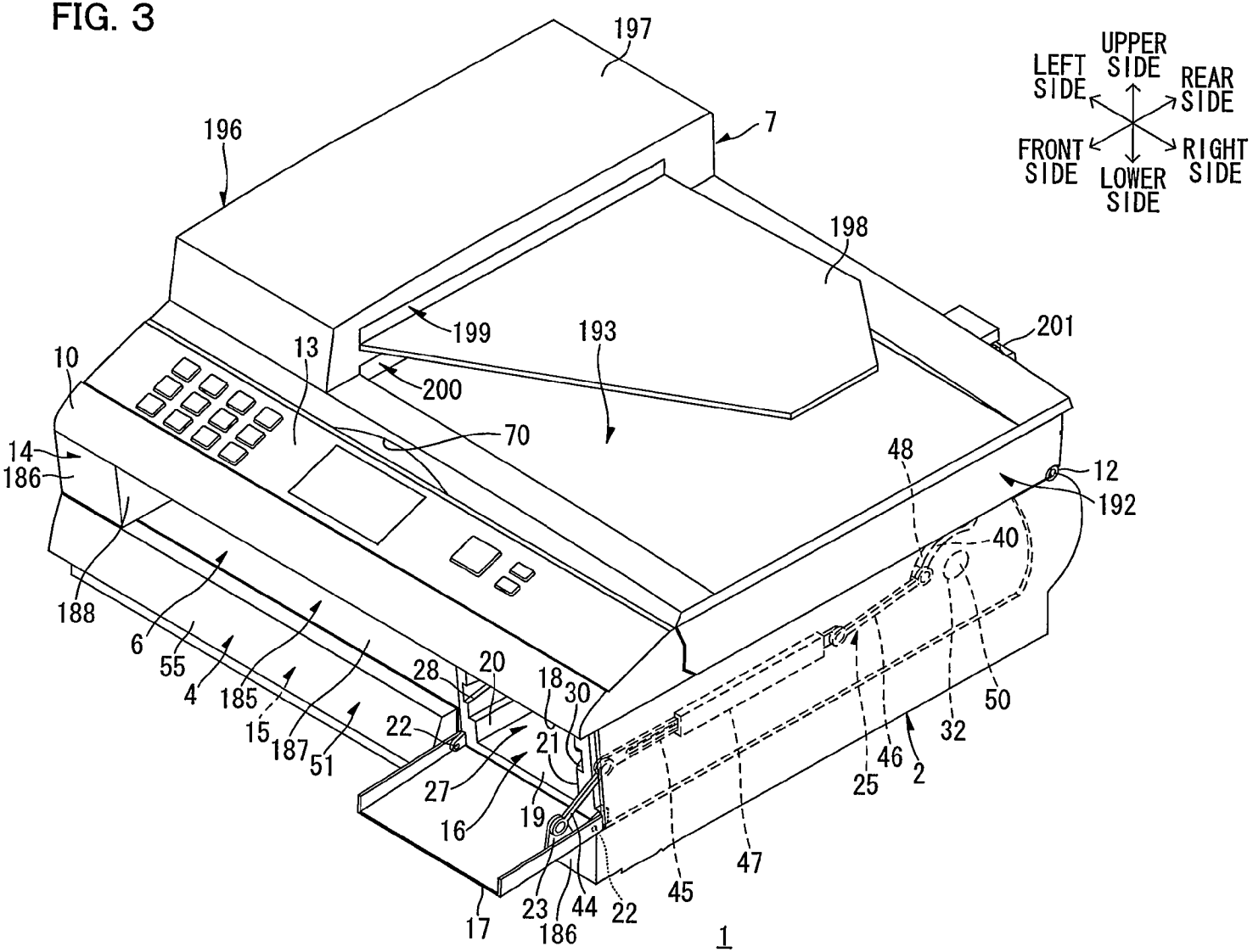
FIG. 3 shows a state where a cover in FIG. 2 is in a cover open position.

FIG. 1 shows a side sectional view of the major portion of an illustrative aspects of a laser printer as an example of an image forming apparatus of one or more aspects of the present invention, showing a mode in which a scanning unit described later is closed. FIG. 2 shows a perspective view of the laser printer shown in FIG. 1, seen from obliquely above in the front right thereof. FIG. 3 shows a state where a cover in FIG. 2 is in a cover open position.

As shown in FIG. 1, the laser printer 1 is a multifunction machine, and includes a main body casing 2 as an example of a casing, a sheet feeding section 4 and an image forming section 5 both accommodated in the main body casing 2, an ejecting section 6 formed in the main body casing 2, and a scanning unit 7 as an example of an image reading unit provided above the main body casing 2.

The sheet feeding section 4 is equipped for feeding a sheet 3 as an example of a recording medium. The image forming section 5 is equipped for forming an image on the sheet 3 fed. The scanning unit 7 is equipped for reading image information described in a document.

In the following description, in a state where a toner cartridge 8 as an example of a developing agent cartridge and a processing section 9 are mounted in the main body casing 2, both described later, the left side of the paper plane of FIG. 1 will be referred to as the frontal (front) side, and the right side thereof will be referred to as the back (rear) side. Further, the near side in the paper thickness direction of FIG. 1 will be referred to as the right side, while the far side therein will be referred to as the left side. The right and left direction may be called as the width direction.

(1) Main Body Casing

As shown in FIG. 1, the main body casing 2 is formed in a hollow, generally box-like shape. An upper wall 10 having a shape of a generally rectangular frame in plan view is formed in the upper end portion of the main body casing 2.

The upper wall 10 is provided with an operation panel 13 as an example of an operation section at the front portion thereof. The operation panel 13 includes a liquid crystal panel for displaying an operating state of the laser printer 1, etc., user operable buttons for setting operation conditions of the laser printer 1, and the like.

A processing section mounting port 11, a sheet feeding tray mounting port 15, and a cartridge mounting port 16 (see FIG. 3) as an example of a third opening and of a casing-side opening are formed in the main body casing 2.

(1-1) Processing Section Mounting Port

The processing section mounting port 11 is formed in a generally rectangular shape in plan view in the upper wall 10. The scanning unit 7 is arranged so as to open/close the processing section mounting port 11. The scanning unit 7 is swingably supported by a support shaft 12 provided along the width direction in the rear end upper portion of the main body casing 2. Therefore, when the scanning unit 7 is made to swing around the support shaft 12 as a fulcrum so that the front end portion of the scanning unit 7 comes into contact with the upper wall 10, the scanning unit 7 closes the processing section mounting port 11. On the other hand, when the scanning unit 7 is made to swing around the support shaft 12 as the fulcrum so that the front end portion of the scanning unit 7 is spaced away from the upper wall 10, the processing section mounting port 11 is opened obliquely upwardly forward. Through the processing section mounting port 11 thus opened, the processing section 9 can be attached and detached to and from the main body casing 2 along obliquely upwardly forward.

(1-2) Sheet Feeding Tray Mounting Port

As shown in FIG. 2, the sheet feeding tray mounting port 15 is formed at a generally center position of the lower half portion of a frontal side wall 14 of the main body casing 2. The sheet feeding tray mounting port 15 is formed in a rectangular shape longer in the width direction, and a sheet feeding tray 51 described later as an example of a recording medium feeding section can be anteroposteriorly attached and detached to and from the main body casing 2 through the sheet feeding tray mounting port 15.

(1-3) Cartridge Mounting Port

As shown in FIG. 3, the cartridge mounting port 16 is formed on the right side of the sheet feeding tray mounting port 15 in the frontal side wall 14. The cartridge mounting port 16 is formed in a rectangular shape longer in the width direction which is longer in the up and down direction and shorter in the width direction than the sheet feeding tray mounting port 15. A cover 17 that openably covers the cartridge mounting port 16 is provided on the cartridge mounting port 16.

The cover 17 is formed in a rectangular shape in front view slightly larger than the cartridge mounting port 16. The cover 17 has a support shaft 22 inserted through both lateral end portions of its lower end portion, and is pivotable between a cover closed position (see FIG. 2) and a cover open position (see FIG. 3) around the support shaft 22 as a fulcrum. When the cover 17 is in the cover closed position, the cover 17 is in a generally upright state as shown in FIG. 2 to close the cartridge mounting port 16 from the front side. On the other hand, when the cover 17 is in the cover open position, the cover 17 is inclined along a generally horizontal direction to open the cartridge mounting port 16 to the front side, as shown in FIG. 3. A connecting portion 23 is provided in the middle of the right end portion of the cover 17. The connecting portion 23 has a shape of a plate along the right end portion of the cover 17, and is formed in a generally triangular shape tapering to the cartridge mounting port 16 side in the opening/closing direction. A transmission member 25 described later is coupled to the cover 17 through the connecting portion 23.

A receiving section upper side wall 18, a receiving section lower side wall 19, a receiving section left side wall 20, and a receiving section right side wall 21, all generally horizontally extending rearward from the periphery of the cartridge mounting port 16, are provided in the main body casing 2. That is, the receiving section upper sidewall 18 is extended from the upper end edge of the cartridge mounting port 16 formed in the rectangular shape. Similarly, the receiving section lower side wall 19, the receiving section left side wall 20, and the receiving section right side wall 21 are extended from the lower end edge of the cartridge mounting port 16, the left end edge thereof, and the right end edge thereof, respectively.

Figure 4:
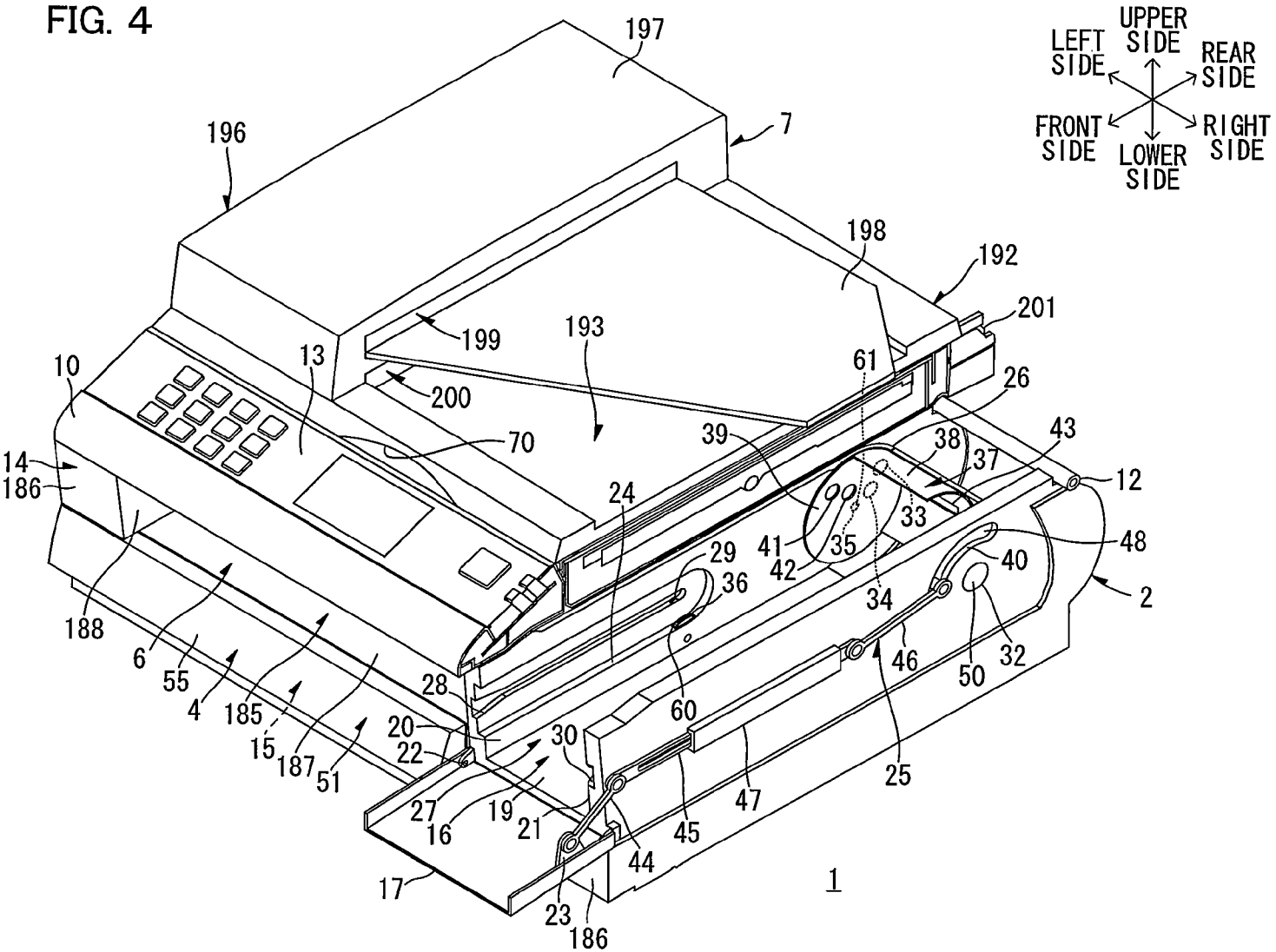
FIG. 4 shows a state where an inner portion of a cartridge receiving space in FIG. 3 is exposed.
Figure 6:
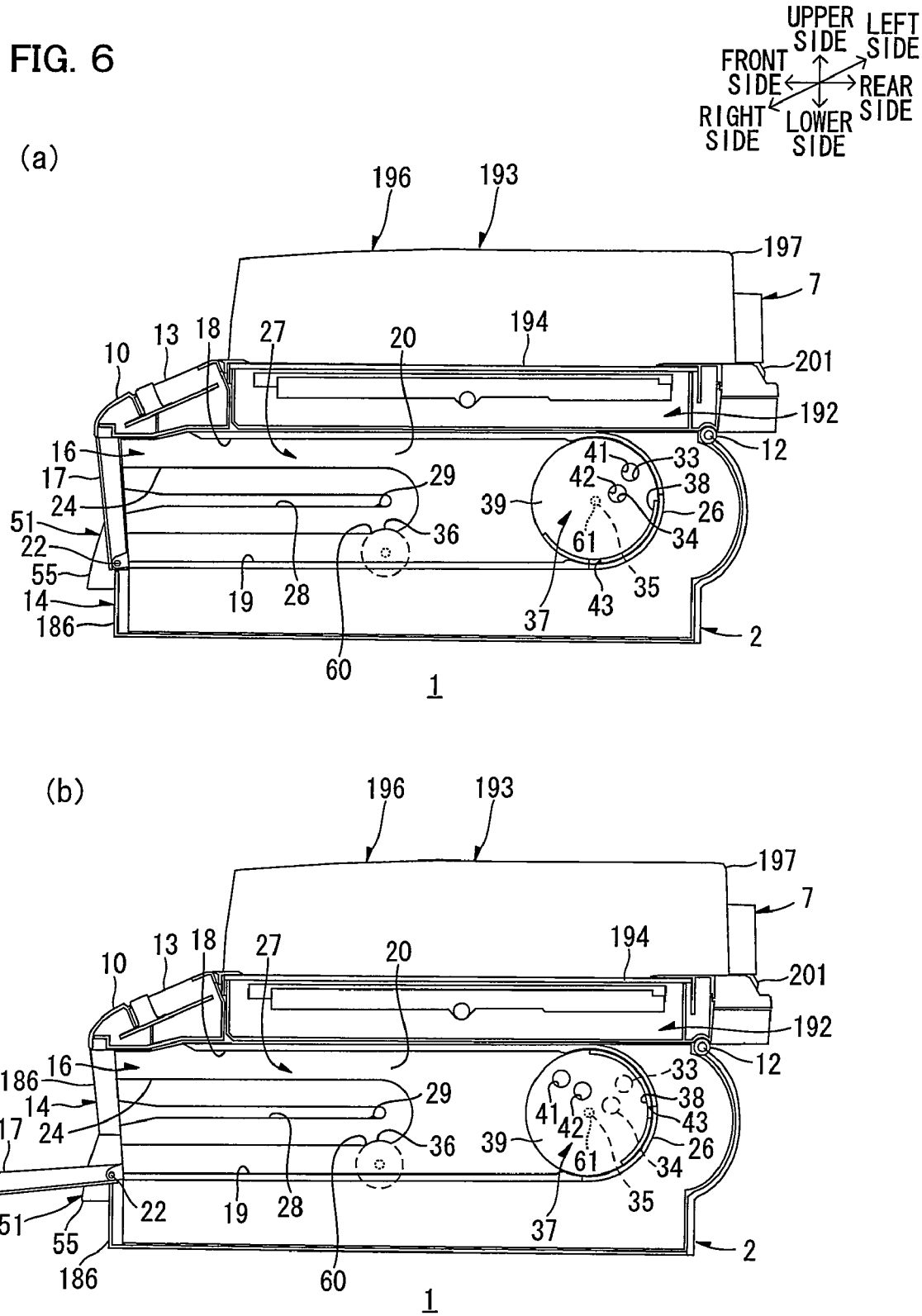
FIG. 6 shows views along a line A-A in FIG. 5.

FIG. 4 shows a state where an inner portion of a cartridge receiving space in FIG. 3 is exposed. FIG. 5 shows a front view of the laser printer in a state where the cover is in the cover open position. FIG. 6 shows a view along a line A-A in FIG. 5: (*a*) illustrates a state where the cover is in the cover closed position; and (*b*) illustrates a state where the cover is in the cover open position. FIG. 7 shows a view along a line B-B in FIG. 5: (*a*) illustrates a state where the cover is in the cover closed position; and (*b*) illustrates a state where the cover is in the cover open position. FIG. 8 shows a view along a line C-C in FIG. 5: (*a*) illustrates a state where the cover is in the cover closed position; and (*b*) illustrates a state where the cover is in the cover open position.

As shown in FIG. 4, the receiving section left side wall 20 and the receiving section right side wall 21 are each formed in a generally rectangular shape longer in the front and rear direction with its rear end portion expanded in a semicircular shape toward the rear side. The rear end portion of the receiving section left side wall 20 has a shaft hole 35 formed in the center of a circle in the semicircular shaped portion. In the rear end portion of the receiving section left side wall 20, a casing feed hole 33 as an example of a first opening is formed at about 2 o'clock position relative to the shaft hole 35 in right side view. A casing return hole 34 is formed at a position obliquely downwardly forward from the casing feed hole 33 between the casing feed hole 33 and the shaft hole 35 in spaced relation therefrom, in the rear end portion of the receiving section left side wall 20. Both the casing feed hole 33 and the casing return hole 34 are round holes in generally the same size penetrating the receiving section left side wall 20 in the width direction. The receiving section left side wall 20 also has a gear receiving groove 24 generally horizontally extending from the generally center position of its front end edge in the up and down direction to the generally center position of the receiving section left side wall 20 in the front and rear direction.

The gear receiving groove 24 is formed in a band-like shape that is recessed to the left side from the receiving section left side wall 20 with its rear end portion expanded in a semicircular shape toward the rear side. The lower-side groove wall of the gear receiving groove 24 has a gear exposing hole 60 having a rectangular shape in plan view formed at a position generally equal to the center of the circle in the semicircular-shaped rear end portion described above. In the gear receiving groove 24, a left guide groove 28 generally horizontally extending from the front end edge of the receiving section left side wall 20 to the vicinity of the anteroposterior position of the gear exposing hole 60 is also formed at the center position of the gear receiving groove 24 in the up and down direction. The anteroposterior length of the left guide groove 28 is equivalent to about a half of that of the receiving section left side wall 20.

The left guide groove 28 is formed in a recess that is recessed from the gear receiving groove 24 to the left side, such that the front end portion thereof has a groove width narrowing toward the rear side, and the subsequent portion (the rear side from the front end portion described above) has a constant width. The lower-side groove wall of the left guide groove 28 is provided with a positioning projection 29 slightly protruded upward at a position generally anteroposteriorly equal to the gear exposing hole 60.

As shown in FIG. 5, a right guide groove 30 having generally the same shape and the same groove width as the left guide groove 28 is formed in a position opposed to the left guide groove 28 in the width direction in the receiving section right side wall 21.

As shown in FIG. 8, the right guide groove 30 is generally horizontally extended from the front end edge of the receiving section right side wall 21 to the rear side, with an anteroposterior length equivalent to about ¾ of that of the receiving section right side wall 21. The right guide groove 30 is formed such that the front end portion thereof has a groove width narrowing toward the rear side and the subsequent portion (the rear side from the front end portion described above) has a constant width. On the rear side of the right guide groove 30, a pivot-plate accommodating section 31 is formed in the receiving section right side wall 21.

The pivot-plate accommodating section 31 has a circular shape in side view and is recessed to the right side. A portion equivalent to the rear half portion of the pivot-plate accommodating section 31 in the receiving section right side wall 21 is the rear end portion formed in the semicircular shape in the receiving section right side wall 21, as described above. In the portion equivalent to the pivot-plate accommodating section 31 in the receiving section right side wall 21, a shaft hole 32 that penetrates the receiving section right side wall 21 in the width direction is formed at the circle center of the pivot-plate accommodating section 31. As shown in FIG. 7, the portion equivalent to the pivot-plate accommodating section 31 in the receiving section right side wall 21 also has a penetration hole 40 of a generally circular-arc shape penetrating the receiving section right side wall 21 in the width direction over a range from about 9 o'clock position to about 1 o'clock position relative to the shaft hole 32 in right side view.

As shown in FIG. 6, the receiving section upper side wall 18 and the receiving section lower side wall 19 are each formed in a generally rectangular shape longer in the front and rear direction, with the rear end portion thereof coupled via a curved wall 26.

The curved wall 26 is formed in a shape of a generally semicircular-arc thin plate recessed to the rear side in side view. The left end edge and the right end edge of the curved wall 26 are connected to the periphery of the aforementioned semicircular shape of the rear end portion of the receiving section left side wall 20, and the periphery of the aforementioned semicircular shape of the rear end portion of the receiving section right side wall 21, respectively (see FIG. 8). Also, the upper end edge and the lower end edge of the curved wall 26 are connected to the rear end edge of the receiving section upper side wall 18, and the rear end edge of the receiving section lower side wall 19, respectively. Thus, a cartridge receiving space 27 having a generally rectangular parallelepiped shape defined by the receiving section upper side wall 18, the receiving section lower side wall 19, the receiving section left side wall 20, the receiving section right side wall 21, and the curved wall 26 to communicate with the cartridge mounting port 16, is formed in the main body casing 2. The anteroposterior depth of the cartridge receiving space 27 is equivalent to about ⅘ of the anteroposterior dimension of the main body casing 2.

The cartridge receiving space 27 is provided with a driving force input gear 36 and a casing shutter 37 as an example of a first shutter member. The transmission member 25 (see FIG. 5) is also provided on the right side from the cartridge receiving space 27 in the main body casing 2.

(1-4) Driving Force Input Gear

The driving force input gear 36 is a spur gear having gear teeth formed on the outer circumferential surface thereof, and is arranged so that its upper end portion is exposed from the gear exposing hole 60 of the gear receiving groove 24. The rotating shaft of the driving force input gear 36 is rotatably supported on the receiving section left side wall 20 while a left end portion thereof, which is not shown, is exposed to the left side from the receiving section left side wall 20 and is coupled to a drive motor (not shown). When the drive motor (not shown) is driven, the driving force input gear 36 rotates clockwise in right side view.

(1-5) Casing Shutter

The casing shutter 37 is arranged on the rear-end side in the cartridge receiving space 27. The casing shutter 37 integrally includes a casing shutter circular wall 38 and a casing shutter side wall 39.

As shown in FIG. 4, the casing shutter circular wall 38 is formed in a shape of a semicircular-arc thin plate in side view along the curved wall 26. A fitting hole 43 (see FIG. 5) of a rectangular shape longer in the width direction as viewed in front, is formed in a position slightly shifted to the left side in the circumferentially center portion of the casing shutter circular wall 38.

The casing shutter side wall 39 is formed in a disc-like shape as viewed in side, with a half of the outer circumference thereof connected to the left end edge of the casing shutter circular wall 38.

The casing shutter side wall 39 is integrally provided with a pivot shaft 61 protruding to the left side at its circle center. The casing shutter side wall 39 has a casing shutter feed hole 41 and a casing shutter return hole 42 formed at midway positions in a radial direction relative to the pivot shaft 61 as a center. The casing shutter return hole 42 is spaced inward in the radial direction described above with respect to the casing shutter feed hole 41. The casing shutter feed hole 41 and the casing shutter return hole 42 are round holes of generally the same size as the casing feed hole 33 and the casing return hole 34, both penetrating the casing shutter side wall 39 in the width direction.

The pivot shaft 61 is inserted through the shaft hole 35 of the receiving section left side wall 20, so that the casing shutter 37 is pivotably supported on the receiving section left side wall 20. Specifically, the casing shutter 37 is pivotable between a casing shutter closed position (see FIG. 6(*b*)) and a casing shutter open position (see FIG. 6(*a*)). When the casing shutter 37 is in the casing shutter closed position, the casing feed hole 33 and the casing return hole 34 are closed from the right side by a portion of the casing shutter side wall 39 other than the casing shutter feed hole 41 and casing shutter return hole 42, as shown in FIG. 6(*b*). On the other hand, a position in which the casing shutter 37 is pivoted from the casing shutter closed position about 90° clockwise in right side view is the casing shutter open position shown in FIG. 6(*a*). When the casing shutter 37 is in the casing shutter open position, the casing shutter feed hole 41 and the casing feed hole 33 are opposed to and in communication with each other in the width direction. At the same time, the casing shutter return hole 42 and the casing return hole 34 are opposed to and in communication with each other in the width direction.

(1-6) Transmission Member

As shown in FIG. 5, in the main body casing 2, the transmission member 25 is arranged between the receiving section right side wall 21 and the right side wall of the main body casing 2.

The transmission member 25 is a so-called link device, and includes a first connecting rod 44, a slide rod 45, a second connecting rod 46, a rod support portion 47, and a pivot plate 48, as shown in FIG. 7.

The rod support portion 47 is formed in a rectangular shape in front view, and in a shape of a hollow square pillar longer in the front and rear direction. An opening for bringing a hollow portion of the rod support portion 47 into communication with outside is formed at each of the front end portion and the rear end portion of the rod support portion 47. The rod support portion 47 is sandwiched between the receiving section right side wall 21 and the right side wall of the main body casing 2 (see FIG. 5).

The slide rod 45 is formed longer in the front and rear direction than the rod support portion 47, and smaller in front view than the front shape of the hollow portion of the rod support portion 47. The slide rod 45 is anteroposteriorly slidably supported by the rod support portion 47 so that the both anteroposterior end portions thereof are exposed from the anteroposterior openings in the rod support portion 47, respectively.

The rear end portion of the first connecting rod 44 is coupled to the front end portion of the slide rod 45, and the front end portion of the first connecting rod 44 is coupled to the connecting portion 23 of the cover 17. The first connecting rod 44 is swingable around a portion coupled to the slide rod 45, and a portion coupled to the connecting portion 23, respectively.

As shown in FIG. 8, the pivot plate 48 is formed in a disc-like shape in side view having a slightly smaller diameter than the shape of the side surface of the pivot-plate accommodating section 31, and is accommodated in the pivot-plate accommodating section 31 in the cartridge receiving space 27. A pivot-plate guide groove 49 is formed in the left side surface of the pivot plate 48. The pivot-plate guide groove 49 extends in a diametral direction through the circle center of the pivot plate 48, and is recessed to the right side and has a groove with generally equal to the groove width of the right guide groove 30. A support shaft 50 protruding to the right side is formed at the center of the circle of the pivot plate 48. The support shaft 50 is inserted through the shaft hole 32 of the pivot-plate accommodating section 31, whereby the pivot plate 48 is pivotably supported on the receiving section right side wall 21 in the pivot-plate accommodating section 31. Specifically, the pivot plate 48 is pivotable between a pivot plate closed position (see FIG. 8 (*b*)) and a pivot plate open position (see FIG. 8(*a*)). Specifically, when the pivot plate 48 is in the pivot plate closed position, the right guide groove 30 and the pivot-plate guide groove 49 are connected to each other along the front and rear direction, as shown in FIG. 8(*b*). On the other hand, a position in which the pivot plate 48 is pivoted from the pivot plate closed position about 90° counterclockwise in left side view is the pivot plate open position. When the pivot plate 48 is in the pivot plate open position, the right guide groove 30 and the pivot-plate guide groove 49 are not connected to each other, and the pivot-plate guide groove 49 is generally orthogonal to the right guide groove 30, as shown in FIG. 8 (*a*). In a state where the pivot plate 48 is supported on the receiving section right side wall 21, the left side surface of the pivot plate 48 and the left side surface of the portion of the receiving section right side wall 21 forward from the pivot plate accommodating section 31 are flush with each other in front view.

As shown in FIG. 7, the second connecting rod 46 is longer than the first connecting rod 44, with its front end portion coupled to the rear end portion of the slide rod 45. The rear end portion of the second connecting rod 46 is coupled to a point spaced radially outward from the support shaft 50 on the right side surface of the pivot plate 48 through the penetration hole 40 of the receiving section right side wall 21. The second connecting rod 46 is swingable around both a portion coupled to the slide rod 45 and a portion coupled to the pivot plate 48.

Next, the operation of the transmission member 25 will be described.

As shown in FIG. 7(*b*), when the cover 17 is in the cover open position, the slide rod 45 is in the foremost position in a state of being supported by the rod support portion 47. The pivot plate 48 is in a pivot plate closed position (see FIG. 8(*b*)). At this time, the cover 17 is pivoted from the cover open position to the cover closed position (see FIG. 7 (*a*)). Thus, a power for pivoting the cover 17 acts on the first connecting rod 44 so as to press the first connecting rod 44 rearward. The power is then transmitted to the slide rod 45 through the first connecting rod 44, thereby sliding the slide rod 45 to the rear side. The power is further transmitted to the second connecting rod 46 through the slide rod 45, thereby moving the second connecting rod 46 to the rear side while swinging the second connecting rod 46 around the portion thereof coupled to the slide rod 45 counterclockwise in right side view. This moves the portion of the second connecting rod 46 coupled to the pivot plate 48 along a circular arc of the penetration hole 40, so that the power is transmitted to the pivot plate 48 through the second connecting rod 46, whereby the pivot plate 48 is pivoted counterclockwise in left side view from the pivot plate closed position (see FIG. 8(*b*)) to the pivot plate open position (see FIG. 8(*a*)).

As described above, in conjunction with the pivot of the cover 17 from the cover open position (see FIG. 8(*b*)) to the cover closed position (see FIG. 8(*a*)), the pivot plate 48 is pivoted from the pivot plate closed position to the pivot plate open position. When the pivot of the cover 17 to the cover closed position (pivot of the pivot plate 48 to the pivot plate open position) is completed, the slide rod 45 is positioned on the rearmost side in a state of being supported by the rod support portion 47, as shown in FIG. 7(*a*).

On the other hand, the cover 17 in the cover closed position is pivoted to the cover open position. Thus, the power for pivoting the cover 17 acts on the first connecting rod 44 so as to pull the first connecting rod 44 forward. The power is then transmitted to the slide rod 45 through the first connecting rod 44, thereby sliding the slide rod 45 to the front side. The power is further transmitted to the second connecting rod 46 through the slide rod 45, thereby moving the second connecting rod 46 to the front side while swinging the second connecting rod 46 around the portion thereof coupled to the slide rod 45 clockwise in right side view. This moves the portion of the second connecting rod 46 coupled to the pivot plate 48 along a circular arc of the penetration hole 40, so that the power is transmitted to the pivot plate 48 through the second connecting rod 46, whereby the pivot plate 48 is pivoted clockwise in left side view from the pivot plate open position (see FIG. 8(*a*)) to the pivot plate closed position (see FIG. 8(*b*)).

As described above, in conjunction with the pivot of the cover 17 from the cover closed position (see FIG. 8(*a*)) to the cover open position (see FIG. 8(*b*)), the pivot plate 48 is pivoted from the pivot plate open position to the pivot plate closed position.

(2) Sheet Feeding Section

As shown in FIG. 1, the sheet feeding section 4 includes the sheet feeding tray 51, a separation roller 52, a separation pad 53, and a sheet feeding roller 54.

The sheet feeding tray 51 is arranged at the bottom portion in the main body casing 2, and is detachably mounted to the main body casing 2 from the front side along the front and rear direction. The sheet feeding tray 51 has a box-like shape opened on the upper side, and integrally includes a grasp portion 55 on the frontal side thereof.

The separation roller 52 and the separation pad 53 are provided above the rear end portion of the sheet feeding tray 51.

The sheet feeding roller 54 is provided in front of the separation roller 52.

The sheet feeding section 4 also includes a sheet dust removing roller 56 and a guide roller 57.

The sheet dust removing roller 56 is arranged in opposed relation to the separation roller 52, and is provided rearward above the separation pad 53.

The guide roller 57 is arranged in opposed relation to the separation roller 52 above the sheet dust removing roller 56.

A pair of registration rollers 58 are provided above the separation roller 52. A transport path 62 for guiding transport of the sheet 3 to the registration roller 58 is provided between the guide roller 57 and the registration rollers 58.

A sheet pressing plate 59 capable of placing sheets 3 in a stacked manner is provided in the inner portion of the sheet feeding tray 51. When the sheet feeding tray 51 is detached from the main body casing 2 through the sheet feeding tray mounting port 15, the sheet 3 can be placed on the sheet pressing plate 59.

On the other hand, when the sheet feeding tray 51 is attached to the main body casing 2, the sheets 3 on the sheet pressing plate 59 are pressed by the sheet feeding roller 54. Then, the rotation of the sheet feeding roller 54 starts sheet feeding toward a separation position between the separation roller 52 and the separation pad 53.

When the sheets 3 thus sent out toward the separation position by the sheet feeding roller 54 are sandwiched between the separation roller 52 and the separation pad 53 by rotation of the separation roller 52, the sheets 3 are separated and fed one by one. The sheet 3 thus fed passes between the sheet dust removing roller 56 and the separation roller 52, and sheet dust is removed from the sheet 3 therebetween. Thereafter, the sheet 3 is guided by the guide roller 57 and the transport path 62, thereby being folded back to the front side along a generally U-shape, and is then transported toward the registration rollers 58.

After the registration of the sheet 3, the registration rollers 58 transport the sheet 3 to a transfer position between a photosensitive drum 136 as an example of an image carrier described later and a transfer roller 138 as an example of a transfer member. At the transfer position, a toner image on the photosensitive drum 136 is transferred onto the sheet 3.

(3) Image Forming Section

The image forming section 5 includes a scanning section 80, the toner cartridge 8 and the processing section 9, both described above, and a fixing section 82 as an example of a fixing unit.

(3-1) Scanning Section

In the main body casing 2, the scanning section 80 is arranged adjacent to the sheet feeding tray 51 so as to be overlapped above the sheet feeding tray 51 over a range from the front end portion of the sheet feeding tray 51 to slightly the rear side from the middle of the sheet feeding tray 51 in the front and rear direction. The scanning section 80 is further arranged adjacent to a sheet ejection tray 185 described later as an example of a recording medium ejecting section so that the front half portion thereof is overlapped below the sheet ejection tray 185. The scanning section 80 anteroposteriorly includes a laser light source 81, a polygonal mirror 83 rotationally driven, a fθ lens 84, a lens 85, and a reflecting mirror 86. Laser beams emitted from the laser light source 81 based on image data are deflected by the polygonal mirror 83 and then pass through the fθ lens 84, as indicated by a chain line. Thereafter, the laser beams further pass through the lens 85, and when an optical path thereof is bent by the reflecting mirror 86, the laser beams are irradiated onto the surface of the photosensitive drum 136 of the processing section 9.

(3-2) Toner Cartridge

FIG. 9 shows perspective views of the toner cartridge seen from obliquely above in the rear right thereof: (*a*) illustrates a state where an outer cylindrical portion is in a cartridge shutter closed position; and (*b*) illustrates a state where the outer cylindrical portion is in a cartridge shutter open position. FIG. 10 shows views for explaining an inner portion of the toner cartridge in FIG. 9(*b*): (*a*) illustrates an inner portion of an inner cylindrical portion; (*b*) illustrates a state where an agitating mechanism is removed in (*a*); (*c*) illustrates a sectional view of the periphery of a partition wall seen from its rear side; (*d*) illustrates the agitating mechanism in (*a*) excerpted with a flexible film bent; and (*e*) illustrates the agitating mechanism in (*d*) with the flexible film not bent. FIG. 11 shows perspective views of the toner cartridge seen from obliquely above in the rear left thereof: (*a*) illustrates a state where the outer cylindrical portion is in the cartridge shutter closed position; and (*b*) illustrates a state where the outer cylindrical portion is in the cartridge shutter open position. FIG. 12 shows a plan view of the toner cartridge with the outer cylindrical portion in the cartridge shutter closed position. It should be noted that the major portion of a developing agent passing portion is shown as a sectional view. FIG. 13 shows left side views of the toner cartridge: (*a*) illustrates a state where the outer cylindrical portion is in the cartridge shutter closed position; and (*b*) illustrates a state where the outer cylindrical portion is in the cartridge shutter open position.

As shown in FIG. 9, the toner cartridge 8 is formed so as to be longer in the front and rear direction, specifically, formed such that the maximum dimensions thereof in the front and rear, the right and left, and the up and down directions are slightly smaller than those of the cartridge receiving space 27 (see FIG. 4). The toner cartridge 8 includes the developing agent passing portion 87, a developing agent accommodating portion 88, and a grip 89.

(3-2-1) Developing Agent Passing Portion

The developing agent passing portion 87 is formed in a generally cylindrical shape along the curved wall 26 (see FIG. 6) in the cartridge receiving space 27, and includes an inner cylindrical portion 90, and an outer cylindrical portion 91 as an example of a second shutter member.

The inner cylindrical portion 90 is formed in a hollow, generally cylindrical shape smaller than the outer shape of the developing agent passing portion 87, and integrally includes inner cylindrical wall 92 and inner side walls 93, as shown in FIG. 10(*b*).

The inner cylindrical wall 92 forms a circumference surface of the inner cylindrical portion 90, and the front end portion thereof has a passing-portion-side communication hole 94 of a generally rectangular shape in rear view.

The two inner side walls 93 are each formed in a circular shape in side view, and are provided so as to close both axial (width) end portions of the inner cylindrical wall 92 respectively, thereby forming the side end surfaces of the inner cylindrical portion 90 in the width direction. A shaft hole 95 that penetrates the inner side wall 93 in the width direction is formed at the center of a circle of each inner side wall 93. In the inner side wall 93 on the left side, a cartridge feed hole 96 as an example of a feed-side opening and a second opening is formed at about 2 o'clock position relative to the shaft hole 95 in right side view. Further, in the left-side inner side wall 93, a cartridge return hole 112 as an example of a return-side opening is formed at a position closer to the shaft-hole 95 side than the cartridge feed hole 96 between the cartridge feed hole 96 and the shaft hole 95 so as to be spaced away from them. The cartridge feed hole 96 and the cartridge return hole 112 are round holes of generally the same size as the casing shutter feed hole 41 and the casing shutter return hole 42, function as examples of an opening, and both penetrate the left-side inner side wall 93 in the width direction.

As shown in FIG. 10(*a*), the partition wall 97, the agitating mechanism 98, and a transport wall 99 as an example of a transport member are provided in the inner portion of the inner cylindrical portion 90.

As shown in FIG. 10(*b*), the partition wall 97 is formed in a shape of a generally semicircular thin plate that is generally equal in size to a shape of a rear half portion of the inner cylindrical portion 90 in side view, and is arranged on the left side from the middle of the inner cylindrical portion 90 in the width direction. A notch 65 is formed in the upper end portion of the partition wall 97. The notch 65 is generally U-shaped in side view so as to be recessed downward toward the rear side.

A portion defined in side view by the inner peripheral surface of the inner cylindrical wall 92 and the partition wall 97 is referred to as a communication area 102. In the inner portion of the inner cylindrical portion 90, a left-side region from the partition wall 97 and the communication area 102 is referred to as a return-side area 100, and a right-side region from the partition wall 97 and the communication area 102 is referred to as a feed-side area 101. The return-side area 100 and the feed-side area 101 are in communication with each other through the communication area 102.

As shown in FIG. 10(*a*), the agitating mechanism 98 includes a passing-portion-side rotating shaft 103, a return-side agitator 104 as an example of a return-side agitating member, and a feed-side agitator 105 as an example of a feed-side agitating member.

The passing-portion-side rotating shaft 103 is extended along the width direction, and both end portions thereof are inserted through the shaft holes 95 of the inner side walls 93 on the right and the left sides respectively, thereby being rotatably supported on the inner side walls 93 respectively. The right end portion of the passing-portion-side rotating shaft 103 is protruded to the right side from the right-side inner side wall 93, and the protruded portion thereof is provided with a passing-portion-side agitator gear 63 (see FIG. 12).

In the passing-portion-side rotating shaft 103, a left-side portion from the partition wall 97 is provided with the return-side agitator 104, and a right-side portion from the partition wall 97 is provided with the feed-side agitator 105. The return-side agitator 104 is made of a film having flexibility, and is formed so as to extend in the radial direction with the passing-portion-side rotating shaft 103 as a center and so as to be warped in a clockwise direction in right side view as shown in FIG. 10(*d*). The feed-side agitator 105 consists of a flexible film provided so as to rub on the inner cylindrical wall 92, and a flexible film provided so as to rub on the partition wall 97, on a resin plate extended in the radial direction with the passing-portion-side rotating shaft 103 as a center. Specifically, the return-side agitator 104 is formed in a generally rectangular shape longer in the radial direction described above, and the feed-side agitator 105 is formed in a generally triangular shape such that the radially outer end edge thereof is inclined radially outward toward the partition wall 97 (left side).

As shown in FIGS. 10(*b*) and 10(*c*), the transport wall 99 is extended so as to be inclined obliquely leftwardly downward along the end edge of the notch 65 of the partition wall 97, and the left end edge of the transport wall 99 is connected to the right side surface of the left-side inner side wall 93. As shown in FIG. 10(*c*), the left end edge of the rear-side portion of the transport wall 99, particularly of a portion equivalent to the most recessed position toward the lower side in the notch 65 described above, is formed along the lower periphery of the cartridge feed hole 96.

As shown in FIG. 9, the outer cylindrical portion 91 has a hollow, generally cylindrical shape along the inner cylindrical portion 90, forms the outer shape of the developing agent passing portion 87, and integrally includes an outer cylindrical wall 113 and an outer side walls 114 as examples of outer members.

The outer cylindrical wall 113 forms a circumferential surface of the outer cylindrical portion 91. In the state shown in FIG. 9(*b*), a notch 115 having a generally rectangular shape in front view is formed in an upper portion of the generally front half of the outer cylindrical wall 113. In the state shown in FIG. 9(*a*), a cartridge projection 116 protruding to the rear side as an example of a first projection is provided at a position slightly shifted to the left side of the rear end portion of the outer cylindrical wall 113. The cartridge projection 116 is formed in a rectangular shape longer in the width direction in rear view.

The outer sidewall 114 is formed in a circular shape in side view, and is provided two so as to close both axial (lateral) ends of the outer cylindrical wall 113, thereby forming side end surfaces of the outer cylindrical portion 91 in the width direction. A cartridge ridge 117 as an example of a second projection is provided on the right side surface of the right-side outer side wall 114, and passes across its circle center and protrudes to the right side. The cartridge ridge 117 is formed in a rectangular shape extending longer in the diametral direction of the right-side outer side wall 114 in right side view, and the rear end portion thereof is close to the cartridge projection 116, as shown in FIG. 9(*a*). As shown in FIG. 11, the left-side outer side wall 114 has a cartridge shutter feed hole 118 and a cartridge shutter return hole 119 formed at midway positions in a radial direction relative to the circle center thereof. The cartridge shutter return hole 119 is spaced inward in the radial direction described above from the cartridge shutter feed hole 118. The cartridge shutter feed hole 118 and the cartridge shutter return hole 119 are round holes of generally the same size as the cartridge feed hole 96 and the cartridge return hole 112, both penetrating the left-side outer side wall 114 in the width direction. A shaft hole 66 is formed in the circle center position of each outer side wall 114, and as shown in FIG. 12, both end portions of the passing-portion-side rotating shaft 103 described above in the width direction are pivotably fitted to the respective shaft holes 66.

As shown in FIG. 11, the outer cylindrical portion 91 accommodates the inner cylindrical portion 90. The outer cylindrical portion 91 is pivotably supported by the inner cylindrical portion 90 through the passing-portion-side rotating shaft 103 by sliding the inner circumferential surface of the outer cylindrical wall 113 on the outer circumferential surface of the inner cylindrical wall 92 of the inner cylindrical portion 90. Specifically, the outer cylindrical portion 91 is pivotable between the cartridge shutter closed position (see FIG. 11(*a*)) and the cartridge shutter open position (see FIG. 11(*b*)). When the outer cylindrical portion 91 is in the cartridge shutter closed position, the cartridge feed hole 96 and the cartridge return hole 112 are closed from the left side by a portion of the left-side outer side wall 114 other than the cartridge shutter feed hole 118 and the cartridge shutter return hole 119, as shown in FIG. 11(*a*). Further, the cartridge projection 116 is positioned at the rear end of the developing agent passing portion 87 (see FIG. 13 (*a*)), and as shown in FIG. 9(*a*), the cartridge ridge 117 is along the front and rear direction.

On the other hand, a position in which the outer cylindrical portion 91 is pivoted from the cartridge shutter closed position about 90° clockwise in right side view is the cartridge shutter open position. When the outer cylindrical portion 91 is in the cartridge shutter open position, the cartridge feed hole 96 and the cartridge shutter feed hole 118 are opposed to and in communication with each other in the width direction, as shown in FIG. 11(*b*). At the same time, the cartridge return hole 112 and the cartridge shutter return hole 119 are opposed to and in communication with each other in the width direction. Further, the cartridge projection 116 is positioned at the lower end of the developing agent passing portion 87 (see FIG. 13(*b*)), and as shown in FIG. 9(*b*), the cartridge ridge 117 is along the up and down direction.

When the outer cylindrical portion 91 pivots between the cartridge shutter closed position and the cartridge shutter open position, the passing-portion-side communication hole 94 (see FIG. 10(*b*)) of the inner cylindrical portion 90 is normally positioned within a pivot range of the notch 115 of the outer cylindrical portion 91.

(3-2-2) Developing Agent Accommodating Portion

The developing agent accommodating portion 88 is formed by anteroposteriorly coupling three hollow members each in a generally cylindrical shape (referred to as sub-cylinders 120) to one another, and the upper surface thereof is horizontally formed flat. The inner portions of the sub-cylinders 120 are in communication with one another. As a developing agent, a positively-chargable, non-magnetic, single-component polymerized toner is stored in the developing agent accommodating portion 88.

As shown in FIG. 13, each sub-cylinder 120 includes a receiving-section-side agitator mechanism 122.

The receiving-section-side agitator mechanism 122 includes a receiving-section-side rotating shaft 123 and a receiving-section-side agitator 124.

The receiving-section-side rotating shaft 123 is rotatably supported on both side walls of each sub-cylinder 120 in the width direction, and its left end portion is protruded from the left side wall of the corresponding sub-cylinder 120 to the left side. Specifically, the receiving-section-side rotating shaft 123 in the sub-cylinder 120 positioned in the middle protrudes to the leftmost side so as to be exposed from a receiving-section-side agitator gear 125 described later (see FIG. 12). As shown in FIG. 9, in the rearmost and middle sub-cylinders 120, the right end portion of the receiving-section-side rotating shaft 123 protrudes from the right side wall of the corresponding sub-cylinders 120 to the right side. Specifically, the receiving-section-side rotating shaft 123 in the middle sub-cylinder 120 protrudes more to the right side than that in the rearmost sub-cylinder 120 (see FIG. 12). As shown in FIG. 11, the receiving-section-side agitator gear 125 is relatively unrotatably attached to a portion protruded from the left side wall of the sub-cylinder 120 in the left end portion of each receiving-section-side rotating shaft 123. The receiving-section-side agitator gear 125 of the sub-cylinder 120 positioned in the middle is formed broader than those of the other sub-cylinders 120 in the width direction. Intermediate gears 126 are provided each between the receiving-section-side agitator gears 125 adjoined anteroposteriorly. Each of the intermediate gears 126 is rotatably supported by a support shaft 127 provided on the left side wall of each sub-cylinder 120, and meshes with the corresponding receiving-section-side agitator gear 125 on each of both anteroposterior sides.

As shown in FIG. 9, an agitator transmission gear 128 is relatively unrotatably attached to a portion protruded from the right side wall of the rearmost sub-cylinder 120 in the right end portion of the receiving-section-side rotating shaft 123 of the rearmost sub-cylinder 120.

As shown in FIG. 13, the receiving-section-side agitator 124 is provided on each receiving-section-side rotating shaft 123. The receiving-section-side agitator 124 is made of a film having flexibility, or the like, and is formed in a generally rectangular shape longer in the radial direction with the receiving-section-side rotating shaft 123 as a center, and is warped in a counterclockwise direction as viewed from the left side.

As shown in FIG. 10(*b*), a receiving-section-side communication hole 121 having a generally rectangular shape in rear view is formed in the rear end portion of the rearmost sub-cylinder 120. The developing agent accommodating portion 88 is connected to the inner cylindrical portion 90 of the developing agent passing portion 87 so that the receiving-section-side communication hole 121 and the passing-portion-side communication hole 94 of the inner cylindrical portion 90 communicate with each other. That is, the inner portion of the developing agent accommodating portion 88 is in communication with the inner portion of the inner cylindrical portion 90 of the developing agent passing portion 87 through the receiving-section-side communication hole 121 and the passing-portion-side communication hole 94.

A support shaft 129 protruding to the right side is provided in a connection portion between the developing agent accommodating portion 88 and the inner cylindrical portion 90, specifically a connection portion between the right side wall of the rearmost sub-cylinder 120 and the right-side inner side wall 93 of the inner cylindrical portion 90 (see FIG. 10(*a*)) The support shaft 129 has an intermediate gear 130 rotatably attached thereto. The intermediate gear 130 meshes with the agitator transmission gear 128 and the passing-portion-side agitator gear 63, as shown in FIG. 12.

(3-2-3) Grip

As shown in FIG. 9, the grip 89 is formed in a ring shape as viewed in side and is narrow in the width direction, and is provided on each of both lateral end portions of the front-side portion (the downstream end portion of the toner cartridge 8 in a detachment direction with respect to the main body casing 2) of the foremost sub-cylinder 120. Specifically, each grip 89 horizontally extends toward the front side from the upper end portion of the foremost sub-cylinder 120, and then gently circles downward to be connected to a portion between the front end portion and the lower end portion of this sub-cylinder 120.

(3-2-4) Attachment/Detachment of Toner Cartridge to and from Main Body Casing (3-2-4-1) Attachment of Toner Cartridge to Main Body Casing First, as shown in FIG. 3, the cover 17 of the main body casing 2 is pivoted to the cover open position described above to open the cartridge mounting port 16. As shown in FIG. 9(*a*), the grip 89 of the toner cartridge 8 where the outer cylindrical portion 91 is in the cartridge shutter closed position is held. While the toner cartridge 8 is kept in a horizontal posture, the cartridge ridge 117 and the right end portion (referred to as a right guide portion 131) of the receiving-section-side rotating shaft 123 in the middle sub-cylinder 120 are made to be received in the right guide groove 30 (see FIG. 3) of the receiving section right side wall 21. As shown in FIG. 11(*a*), the receiving-section-side agitator gear 125 of the middle sub-cylinder 120 is then made to be received in the gear receiving groove 24 (see FIG. 4), and thereafter, the left end portion (referred to as a left guide portion 132) of the receiving-section-side rotating shaft 123 in the middle sub-cylinder 120 is made to be received in the left guide groove 28 (see FIG. 3) of the receiving section left side wall 20.

The toner cartridge 8 is then pushed to the rear side to be inserted into the cartridge receiving space 27 (see FIG. 4). At this time, the cartridge ridge 117 and the right guide portion 131 (see FIG. 12) are guided along the right guide groove 30 (see FIG. 8(*b*)), and the left guide portion 132 (see FIG. 12) is guided along the left guide groove 28 (see FIG. 6(*b*)). This moves the toner cartridge 8 horizontally to the rear side in the cartridge receiving space 27.

Subsequently, when the toner cartridge 8 is pressed rearward, the cartridge ridge 117 (see FIG. 12) passes through the right guide groove 30 (see FIG. 8(*b*)), and then received in the pivot-plate guide groove 49 of the pivot plate 48 in the pivot plate closed position.

When the toner cartridge 8 is further pressed rearward, the left guide portion 132 (see FIG. 12) climbs over the positioning projection 29 (see FIG. 6(*b*)), and then comes into contact with the rear end edge of the left guide groove 28. At the same time, the cartridge projection 116 (see FIG. 12) is fitted to the fitting hole 43 (see FIG. 5) of the casing shutter 37 in the casing shutter closed position. The cartridge ridge 117 (see FIG. 12) is in a state of being received in the pivot-plate guide groove 49 (see FIG. 8(*b*)) without any protrusion from the pivot-plate guide groove 49. That is, the cartridge ridge 117 is received in the pivot-plate guide groove 49, whereby the outer cylindrical portion 91 (see FIG. 9(*a*)) of the toner cartridge 8 and the cover 17 (see FIG. 3) are coupled by the transmission member 25.

Further, a portion of the receiving-section-side agitator gear 125 (FIG. 11(*a*)) on the middle sub-cylinder 120, which is protruded more to the left side than the other receiving-section-side agitator gears 125, meshes with the driving force input gear 36 (see FIG. 4). This completes the receiving of the toner cartridge 8 into the cartridge receiving space 27. At this time, in the developing agent passing portion 87 (specifically, the left-side inner side wall 93 of the outer cylindrical portion 91), the toner cartridge 8 is opposed to a developing roller 154 (see FIG. 1) described later as an example of a developing agent carrier in the longitudinal direction (axial direction, i.e., width direction) thereof (see FIG. 8).

In a state where the toner cartridge 8 is completely received in the cartridge receiving space 27, the cover 17 in the cover open position is pivoted to the cover closed position, as shown in FIG. 8(*b*). Thus, as described above, the pivot plate 48 in the pivot plate closed position is pivoted to the pivot plate open position shown in FIG. 8(*a*). In a state where the cartridge ridge 117 is received in (in engagement with) the pivot-plate guide groove 49 of the pivot plate 48, the outer cylindrical portion 91 (see FIG. 9(*a*)) is pivoted to the cartridge shutter open position (see FIG. 9(*b*)), in conjunction with the pivot of the pivot plate 48 to the pivot plate open position, (i.e., since a power generated by the pivot of the cover 17 is transmitted). Then, as shown in FIG. 6(*b*), in a state where the cartridge projection 116 (see FIG. 13(*a*)) of the outer cylindrical portion 91 is fitted in (in engagement with) the fitting hole 43, the casing shutter 37 is pivoted to the casing shutter open position as shown in FIG. 6(*a*), in conjunction with the pivot of the outer cylindrical portion 91 to the cartridge shutter open position (see FIG. 13(*b*)).

In this state, the casing feed hole 33 of the main body casing 2 communicates with the cartridge feed hole 96 through the casing shutter feed hole 41 and the cartridge shutter feed hole 118 of the toner cartridge 8, as shown in FIG. 10(*c*). Also, the casing return hole 34 of the main body casing 2 communicates with the cartridge return hole 112 through the casing shutter return hole 42 and the cartridge shutter return hole 119 of the toner cartridge 8.

The cartridge mounting port 16 is closed with the cover 17 in the cover closed position, whereby attachment of the toner cartridge 8 to the main body casing 2 is completed. At this time, the grip 89 of the toner cartridge 8 is anteroposteriorly opposed to and adjacent to the cover 17 in the cover closed position (see FIG. 8(*a*)).

(3-2-4-2) Detachment of Toner Cartridge from Main Body Casing

The cover 17 in the cover closed position is pivoted to the cover open position to open the cartridge mounting port 16 (see FIG. 8(*b*)). This exposes the grip 89 from the cartridge mounting port 16, and pivots the pivot plate 48 in the pivot plate open position to the pivot plate closed position. In a state where the cartridge ridge 117 is received in (in engagement with) the pivot-plate guide groove 49 of the pivot plate 48, the outer cylindrical portion 91 is pivoted to the cartridge shutter closed position (see FIG. 9(*a*)), in conjunction with the pivot of the pivot plate 48 to the pivot plate closed position (i.e., since a power generated by the pivot of the cover 17 is transmitted). Then, in a state where the cartridge projection 116 (see FIG. 9) of the outer cylindrical portion 91 is fitted in (in engagement with) the fitting hole 43, the casing shutter 37 is pivoted to the casing shutter closed position (see FIG. 6(*b*)), in conjunction with the pivot of the outer cylindrical portion 91 to the cartridge shutter closed position.

Thus, the casing feed hole 33 and the casing return hole 34 both in the main body casing 2 are closed with the casing shutter 37 (see FIG. 6(*b*)), and the cartridge feed hole 96 and the cartridge return hole 112 both in the toner cartridge 8 are closed with the outer cylindrical portion 91 (see FIG. 13(*a*)). Therefore, the casing feed hole 33 and the cartridge feed hole 96 are no longer in communication with each other, and similarly, the casing return hole 34 and the cartridge return hole 112 are no longer in communication with each other.

Thereafter, the grip 89 is held to draw the toner cartridge 8 to the front side (see FIG. 8(*b*)). Thus, the left guide portion 132 (see FIG. 12) climbs over the positioning projection 29 (see FIG. 4), and is then guided to the front side along the left guide groove 28. The cartridge ridge 117 and the right guide portion 131 (see FIG. 12) are guided along the right guide groove 30 (see FIG. 8(*b*)) (the cartridge ridge 117 is also guided along the pivot-plate guide groove 49). This moves the toner cartridge 8 horizontally to the front side in the cartridge receiving space 27.

Then, the left guide portion 132 (see FIG. 12) leaves the left guide groove 28 (see FIG. 4), and the cartridge ridge 117 and the right guide portion 131 (see FIG. 12) leave the right guide groove 30 (see FIG. 4). Further, when the receiving-section-side agitator gear 125 (see FIG. 12) in the middle leaves the gear receiving groove 24 (see FIG. 4), the toner cartridge 8 is taken out from the cartridge receiving space 27.

This completes the detachment of the toner cartridge 8 from the main body casing 2.

(3-3) Processing Section

In the following description, the description is given in a state where the toner cartridge 8 is attached in the main body casing 2. That is, as shown in FIG. 10(*c*), in this state, the casing feed hole 33 of the main body casing 2 is in communication with the cartridge feed hole 96 of the toner cartridge 8, and the casing return hole 34 of the main body casing 2 is in communication with the cartridge return hole 112 of the toner cartridge 8.

The processing section 9 is arranged on the left side from the cartridge receiving space 27 in the main body casing 2. As shown in FIG. 1, the processing section 9 is also arranged so that the front portion thereof is overlapped with the scanning section 80 from above, and further so that the rear portion thereof is overlapped with the sheet feeding tray 51 from above.

As described above, the processing section 9 is detachably mounted to the main body casing 2, and integrally includes a drum section 133 and a developing section 134.

(3-3-1) Drum Section

FIG. 14 shows the processing section excerpted from FIG. 1.

As shown in FIG. 14, the drum section 133 is provided with a drum casing 135, and further includes the photosensitive drum 136, a scorotron charger 137, the transfer roller 138, and a cleaning brush 139, all provided in the drum casing 135.

The drum casing 135 has a box-like shape which is longer in the width direction and is opened on the front side and on the rear side.

A laser beam entrance port 141 for irradiating the photosensitive drum 136 described later with laser beams from the scanning section 80 (see FIG. 1) is formed in the midway of the bottom wall of the drum casing 135 in the front and rear direction. A first passing port 142 is opened between the rear end edge of the ceiling wall (upper wall) of the drum casing 135 and the front end edge of the ceiling wall of the developer casing 152 of the developing section 134 described later. A second passing port 143 is opened in the front wall of the drum casing 135. The first passing port 142 and the second passing port 143 are each formed in a rectangular shape longer in the width direction.

In the drum casing 135, a portion defined with respective front half portions of the left side wall, the right side wall and the bottom wall, the front wall, and the ceiling wall, is a drum receiving section 144. The drum receiving section 144 accommodates the photosensitive drum 136, the scorotron charger 137, the transfer roller 138, and the cleaning brush 139.

Also, in the drum casing 135, a portion defined with respective rear half portions of the left side wall, the right side wall and the bottom wall is a developer arrangement section 145. The developer arrangement section 145 has a developing section 134 arranged therein. The developer arrangement section 145 is formed in a bottomed frame shape of a flat-bottomed U-shape in front sectional view opened on the upper side.

The drum receiving section 144 and the developer arrangement section 145 are in communication with each other.

The photosensitive drum 136 is formed in a cylindrical shape, and includes a drum body 146 and a drum shaft 147. The drum body 146 is formed of a positive charging photosensitive layer with an outermost surface layer of polycarbonate, or the like. The drum shaft 147 is made of metal, and is extended along the axial direction (width direction) of the drum body 146 at the axial center of the drum body 146.

Both axial end portions of the drum shaft 147 are respectively supported on both side walls of the drum casing 135 in the width direction, and the drum body 146 is rotatably supported with respect to the drum shaft 147. Thus, the photosensitive drum 136 is provided in the drum casing 135 so as to be rotatable around the drum shaft 147. Further, the photosensitive drum 136 is rotationally driven by being input with a driving force from a drive motor (not shown).

The scorotron charger 137 is supported on the bottom wall of the drum casing 135 at a position obliquely forward below the photosensitive drum 136, and is spaced from and opposed to the photosensitive drum 136 without contact with the photosensitive drum 136. The scorotron charger 137 includes a discharge wire 148 and a grid 149. The discharge wire 148 is arranged so as to be spaced from and opposed to the photosensitive drum 136. The grid 149 is provided between the discharge wire 148 and the photosensitive drum 136, and controls the amount of charge from the discharge wire 148 to the photosensitive drum 136.

In the scorotron charger 137, a bias voltage is applied to the grid 149, and at the same time, a high voltage is applied to the discharge wire 148 to cause corona discharge in the discharge wire 148, thereby charging the surface of the photosensitive drum 136 with a uniform positive polarity.

In the drum casing 135, the transfer roller 138 is provided above the photosensitive drum 136, is opposed thereto in contact relation in the up and down direction, and is arranged so as to form a nip between itself and the photosensitive drums 136. This nip serves as the transfer position between the photosensitive drum 136 and the transfer roller 138, both described above.

The transfer roller 138 includes a roller shaft 150 and a rubber roller 151. The roller shaft 150 is made of metal, and is rotatably supported on both side walls of the drum casing 135 in the width direction. The rubber roller 151 is formed of an electrically-conductive rubber material for covering the roller shaft 150.

A transfer bias is applied to the transfer roller 138 during transfer. The transfer roller 138 is rotationally driven by being input with a driving force from a drive motor (not shown).

The cleaning brush 139 is attached to the front wall of the drum casing 135, and is arranged on the front side of the photosensitive drum 136 and obliquely on the front side above the scorotron charger 137 so as to be in contact with the photosensitive drum 136.

(3-3-2) Developing Section

The developing section 134 is integral to the drum section 133 in the developer arrangement section 145 of the drum casing 135.

The developing section 134 includes a developer casing 152, and further includes a feed roller 153, the developing roller 154, a layer-thickness regulating blade 155, a feed auger 156, and a return auger 157, all provided in the developer casing 152.

The developer casing 152 is formed in a generally rectangular shape in side view and in a box-like shape longer in the width direction. The front wall of the developer casing 152 has a developer communication hole 158 having a rectangular shape longer in the width direction in front view. The ceiling wall (upper wall) of the developer casing 152 is formed in a circular-arc shape in side view upwardly convex-curved. A spacer 64 protruded upward is provided at each of both lateral end portions of the ceiling wall of the developer casing 152. In the inner portion of the developer casing 152, a developer partition wall 159 having a generally L-shape in side sectional view and extending in the width direction is formed, and the inner portion of the developer casing 152 is divided by the developer partition wall 159 into a developing chamber 160 and a toner feed chamber 161.

The toner feed chamber 161 is positioned in the rear end portion and the upper end portion of the developer casing 152, and has a generally rectangular shape in side sectional view. A toner communication hole 162 penetrating the developer partition wall 159 in the up and down direction is formed in the lower end portion of the left end portion of the developer partition wall 159, and the developing chamber 160 and the toner feed chamber 161 are in communication with each other through the toner communication hole 162. The developing roller 154, the feed roller 153, the layer-thickness regulating blade 155, and the return auger 157 are arranged in the developing chamber 160, while the feed auger 156 is arranged in the toner feed chamber 161.

The developing roller 154 is arranged in the front-side portion of the developing chamber 160, and the front end portion thereof is exposed to the front side through the developer communication hole 158, and pressed into contact with the photosensitive drum 136 from the rear side. The developing roller 154 is obtained by covering a metal developing roller rotating shaft 163 with a rubber roller 164 made of an elastic member, such as an electrically-conductive rubber material. The developing roller rotating shaft 163 is rotatably supported on both lateral side walls of the developer casing 152. The developing roller 154 is rotationally driven by inputting a driving force from a drive motor (not shown) into the developing roller rotating shaft 163. During image forming operation, a developing bias from a high-voltage circuit board, which is not shown, provided in the main body casing 2 is applied to the developing roller 154.

The feed roller 153 is opposed to the developing roller 154 from an obliquely lower rear side, and is pressed into contact with the developing roller 154. The feed roller 153 is obtained by covering a metal feed roller rotating shaft 165 with a sponge roller 166 made of an electrically-conductive sponge member. The feed roller rotating shaft 165 is rotatably supported on both lateral side walls of the developer casing 152. The feed roller 153 is rotationally driven by inputting a driving force from a drive motor (not shown) into the feed roller rotating shaft 165.

The layer-thickness regulating blade 155 includes a blade body 167 and a pressuring portion 168. The blade body 167 has a proximal end portion supported on the ceiling wall of the developer casing 152, and is made of a metal leaf spring member. The pressuring portion 168 is provided in the distal end portion of the blade body 167, and is formed in a generally rectangular shape in section made of an insulating silicone rubber. In the layer-thickness regulating blade 155, above the feed roller 153, the pressuring portion 168 is pressed into contact with the surface of the developing roller 154 by an elastic force of the blade body 167.

The feed auger 156 integrally includes a feed-side rotating shaft 169 longer in the width direction and a feed-side transport portion 170. The feed-side rotating shaft 169 is rotatably supported on the both lateral side walls of the developer casing 152. The feed-side transport portion 170 is formed in a spiral manner along the axial direction of the feed-side rotating shaft 169, on the outer circumferential surface of the feed-side rotating shaft 169. In the left end portion of the feed-side rotating shaft 169, a gear portion (not shown) is provided, through which a driving force of a drive motor (not shown) in the main body casing 2 is transmitted. This rotationally drives the feed auger 156. A developer feed hole 171 for bringing the inner portion of the toner feed chamber 161 into communication with the outside is formed in a portion, which is opposed to the feed auger 156, of the right side wall of the developer casing 152. In a state where the processing section 9 is mounted in the main body casing 2, the developer feed hole 171 is opposed to and in communication with the casing feed hole 33 in the width direction (see FIG. 10(*c*)).

The return auger 157 is arranged above the feed roller 153 and below the feed auger 156, and integrally includes a return-side rotating shaft 172 longer in the width direction and a return-side transport portion 173. The return-side rotating shaft 172 is rotatably supported on the both lateral side walls of the developer casing 152. The return-side transport portion 173 is formed in a spiral manner (spiral in the reverse direction to the feed-side transport portion 170) along the axial direction of the return-side rotating shaft 172 on the outer circumferential surface of the return-side rotating shaft 172. In the left end portion of the return-side rotating shaft 172, a gear portion (not shown) is provided, through which a driving force of a drive motor (not shown) in the main body casing 2 is transmitted. This rotationally drives the return auger 157. A developer return hole 174 for bringing the inner portion of the developing chamber 160 into communication with the outside is formed in a portion, which is opposed to the return auger 157, of the right side wall of the developer casing 152. In a state where the processing section 9 is mounted in the main body casing 2, the developer return hole 174 is opposed to and in communication with the casing return hole 34 in the width direction (see FIG. 10(*c*))

(3-3-3) Development/Transfer Operation

During image forming operation, a drive motor (not shown) is driven to rotate the driving force input gear 36 (see FIG. 6(*a*)) clockwise in right side view. This transmits the driving force from the driving force input gear 36 to the receiving-section-side agitator gear 125 (see FIG. 13(*b*)) of the middle sub-cylinder 120 that meshes with the driving force input gear 36, so that the receiving-section-side agitator gear 125 is rotationally driven clockwise in left side view. This driving force is transmitted to the respective receiving-section-side agitator gears 125 of the foremost and the rearmost sub-cylinders 120 through the intermediate gears 126, as shown in FIG. 13(*b*). Thus, in each of the sub-cylinders 120, the receiving-section-side agitator gear 125 is rotationally driven clockwise in left side view, and the receiving-section-side rotating shaft 123 and the receiving-section-side agitator 124 are rotated clockwise in left side view together with the receiving-section-side agitator gear 125. Therefore, in each of the sub-cylinders 120, the toner is agitated by the receiving-section-side agitator 124 and then moved rearward. That is, when the entire developing agent accommodating portion 88 is considered, the toner is moved from the front side to the rear side, and as shown in FIG. 10(*a*), the toner is supplied to the inner portion of the inner cylindrical portion 90 of the developing agent passing portion 87 through the passing-portion-side communication hole 94 and the receiving-section-side communication hole 121.

In the rearmost sub-cylinder 120, the agitator transmission gear 128 is rotated counterclockwise in right side view along with rotation of the receiving-section-side rotating shaft 123. A driving force for rotating the agitator transmission gear 128 is transmitted to the passing-side agitator gear 63 through the intermediate gear 130 (see FIG. 12), thereby rotationally driving the passing-side agitator gear 63 counterclockwise in right side view. This rotates the passing-portion-side rotating shaft 103, the return-side agitator 104, and the feed-side agitator 105 counterclockwise in right side view together with the passing-side agitator gear 63. Therefore, in the inner cylindrical portion 90, the toner in the feed-side area 101 is agitated by the feed-side agitator 105, and is then supplied onto the transport wall 99 through the notch 65 in the partition wall 97. The toner thus supplied onto the transport wall 99 moves downwardly rearward to the left side along the transport wall 99 by its own weight, and is then transported to the cartridge feed hole 96. The toner thus transported is supplied from the cartridge feed hole 96, as indicated by the solid arrow of FIG. 10(*c*), and then horizontally passes through the cartridge shutter feed hole 118, the casing shutter feed hole 41, the casing feed hole 33, and the developer feed hole 171 to the left side to be released into the toner feed chamber 161 of the processing section 9 (see FIG. 14).

On the other hand, the toner in the return-side area 100 is agitated by the return-side agitator 104, and is then supplied to the feed-side area 101 through the communication area 102 (see FIG. 10(*a*)).

The toner thus released into the toner feed chamber 161 is transported to the left side in the toner feed chamber 161 by the feed-side transport portion 170 of the feed auger 156 rotationally driven, as shown in FIG. 14. In the left end portion of the toner feed chamber 161, the toner thus transported moves down through the toner communication hole 162, and is then transported to the developing chamber 160, to be supplied to the left end portion of the return auger 157. The toner thus supplied to the left end portion of the return auger 157 is supplied to the feed roller 153 arranged below the return auger 157, while being transported to the right side by the return-side transport portion 173 of the return auger 157 rotationally driven.

As indicated by a dashed arrow of FIG. 10(*c*), a toner reached the developer return hole 174 without being supplied to the feed roller 153, horizontally passes to the right side through the casing return hole 34, the casing shutter return hole 42, and the cartridge shutter return hole 119. Thereafter, the toner passes through the cartridge return hole 112, and is then received in the return-side area 100 of the toner cartridge 8. As described above, the toner thus received in the return-side area 100 is supplied to the feed-side area 101, and is again transported to the toner feed chamber 161. That is, the toner that has not been supplied to the feed roller 153 is circulated between the developing section 134 (see FIG. 14) and the toner cartridge 8. The toner reached the developer return hole 174 includes one transported by the return-side transport portion 173 through the circulation of the toner described above, and one remaining in the developing chamber 160 but transported by the return-side transport portion 173 to reach the developer return hole 174.

As shown in FIG. 14, the toner supplied to the feed roller 153 is then supplied to the developing roller 154 by rotation of the feed roller 153. At this time, the toner is positively triboelectrically charged between the feed roller 153 and the developing roller 154 to which a developing bias is applied. The toner thus triboelectrically charged enters between the pressuring portion 168 of the layer-thickness regulating blade 155 and the rubber roller 164 of the developing roller 154, along with the rotation of the developing roller 154. Then, the toner forms a thin layer having a uniform thickness, which is carried on the rubber roller 164 of the developing roller 154.

On the other hand, the scorotron charger 137 generates corona discharge to uniformly positively charge the surface of the drum body 146 of the photosensitive drum 136 by application of a charging bias. Along with the rotation of the drum body 146, the surface thereof is uniformly positively charged by the scorotron charger 137, and exposed by high-speed scanning of the laser beam emitted from an emission window (not shown) of the scanning section 80 (see FIG. 1) and entered through the laser beam entrance port 141. Thus, an electrostatic latent image corresponding to an image to be formed on the sheet 3 is formed thereon.

As the drum body 146 further rotates, the developing roller 154 subsequently rotates to come in contact with the photosensitive drum 136 in opposed relation. At this time, the positively charged toner carried on the surface of the developing roller 154 is supplied to the electrostatic latent image formed on the surface of the drum body 146. Thus, the toner transforms the electrostatic latent image on the drum body 146 into a visible image, whereby the drum body 146 carries on its surface a toner image by reversal developing.

Thereafter, the toner image carried on the surface of the photosensitive drum 136 is transferred onto the sheet 3 by the transfer bias applied to the transfer roller 138 while the sheet 3 that has been transported by the registration rollers 58 (see FIG. 1) and entered from the first passing port 142 into the drum casing 135, passes through the transfer position between the photosensitive drum 136 and the transfer roller 138.

As shown in FIG. 1, the sheet 3 is turned around the separation roller 52 to the front side in a generally U-shape, and then travels to above the processing section 9. The sheet 3 then passes through a gap between the upper surface of the ceiling wall of the developing section 134 and the lower surface of the scanning unit 7, and thereafter, reaches the transfer position through the first passing port 142 of the drum section 133. The gap is defined by abutting the spacer 64 of the developing section 134 against the lower surface (sheet transport guide 195 described later) of the scanning unit 7. The size of the gap is equivalent to the amount of protrusion of the spacer 64.

The sheet 3 on which the toner image has been transferred, is ejected out of the drum casing 135 from the second passing port 143 (see FIG. 14), and is then transported to the fixing section 82.

A toner remaining on the photosensitive drum 136 after the transfer operation is recovered by the developing roller 154. Further, sheet dust deposited on the photosensitive drum 136 from the sheet 3 after the transfer operation is removed by the cleaning brush 139.

(3-4) Fixing Section

The fixing section 82 is arranged adjacent to the scanning section 80 so as to overlap the scanning section 80 from above, and is provided on the front side (i.e., the opposite side to the developing roller 154 with respect to the photosensitive drum 136) of the processing section 9. The fixing section 82 includes a fixing frame 180 in which a heating roller 181, a pressure roller 182, and the sheet ejecting rollers 183 are provided.

The heating roller 181 includes a metal tube whose surface is coated with fluorocarbon resin, and a halogen lamp inserted into the metal tube for heating. The heating roller 181 is rotationally driven by being input with a driving force from a drive motor (not shown).

The pressure roller 182 is arranged above the heating roller 181 in opposed relation thereto so as to press the heating roller 181. The pressure roller 182 includes a metal roller shaft, and a rubber roller made of a rubber material and covering the roller shaft. The pressure roller 182 is driven in accordance with the rotation drive of the heating roller 181.

The sheet ejecting rollers 183 include a pair of rollers, and are arranged on the downstream side (front side) of the transport direction of the sheet 3 with respect to the heating roller 181 and the pressure roller 182.

In the fixing section 82, the toner image transferred onto the sheet 3 at the transfer position is thermally fixed onto the sheet 3 while the sheet 3 passes between the heating roller 181 and the pressure roller 182. The sheet 3 on which the toner image has been fixed is transported toward the sheet ejection tray 185 through an ejecting port 184 by the sheet ejecting rollers 183, as described next.

(4) Ejecting Section

The ejecting section 6 includes the ejecting port 184 and the sheet ejection tray 185 on the front side (i.e., the opposite side to the photosensitive drum 136 with respect to the fixing section 82) of the main body casing 2.

As shown in FIG. 2, the frontal side wall 14 of the main body casing 2 includes a pair of frontal end walls 186 on both end portions thereof in the width direction. The cartridge mounting port 16 described above is formed in the right-side frontal end wall 186. The sheet ejection tray 185 recessed rearward is formed in a portion of the frontal side wall 14, the portion sandwiched between the pair of frontal end walls 186 in the width direction. As shown in FIG. 1, the sheet ejection tray 185 is arranged so as to overlap the front-side portions of the sheet feeding tray 51 and the scanning section 80.

Specifically, the sheet ejection tray 185 includes an ejection bottom wall 187, a pair of ejection side walls 188, and an ejection rear wall 189. The ejection bottom wall 187 is formed in a shape of a rectangular plate in plan view continuously extending rearward from the upper end edge of the widthwise sandwiched portion by the pair of frontal end walls 186 in the frontal side wall 14.

The pair of ejection side walls 188 are extended upward from both lateral end edges of the ejection bottom wall 187 and are opposed to each other.

The ejection rear wall 189 is formed in a shape of a rectangular plate in front view continuously extending upward from the rear end edge of the ejection bottom wall 187, and extended between the ejection side walls 188. The ejection rear wall 189 includes a first ejection rear wall 190 that forms the lower half portion thereof, and a second ejection rear wall 191 that forms the upper half portion thereof. The ejection rear wall 189 is adjacent to and forward of the fixing section 82.

The upper end edge of the first ejection rear wall 190 is spaced from and opposed to the lower end edge of the second ejection rear wall 191 in the up and down direction. This spacing is larger than the thickness of the sheet 3, and serves as the ejecting port 184 for bringing the fixing section 82 and the sheet ejection tray 185 into communication with each other.

The sheet 3 thermally fixed in the fixing section 82 is ejected onto the ejection bottom wall 187 of the sheet ejection tray 185 through the ejecting port 184 by the sheet ejecting rollers 183.

The sheet ejection tray 185 is opened to the front side when the scanning unit 7 is closed and the processing section mounting port 11 of the main body casing 2 is closed. In addition to this, the sheet ejection tray 185 is also opened to the upper side when the scanning unit 7 is opened to open the processing section mounting port 11.

(5) Scanning Unit (5-1) General Structure of Scanning Unit

The scanning unit 7 includes a document board 192 and a document pressing cover 193 openably supported on the document board 192.

The document board 192 has a shape of a rectangular thick plate in plan view, on the upper surface of which a glass surface 194 where a document is placed is formed, and on the lower surface of which the sheet transport guide 195 is formed.

The glass surface 194 is formed by embedding a glass plate in the document board 192 so that the upper surface of the document board 192 becomes flat. The glass surface 194 has a rectangular shape in plan view, and is arranged so that its longitudinal direction is along the longitudinal direction of the document board 192.

The document board 192 also has a CCD sensor (not shown) for reading a document, and a scanning motor (not shown) for scanning the CCD sensor (not shown) in an opposed state to the glass surface 194, both of which are provided therein.

The CCD sensor (not shown) is supported on the inner side (lower side) of the glass surface 194 so as to be movable in the right and left direction, and is normally positioned at the left end of the glass surface 194. During usual document reading, the scanning motor (not shown) scans a document from the left side toward the right side in an opposed state to the glass surface 194.

The sheet transport guide 195 is formed longer in the right and left direction, and upwardly convex-curved so as to be along the upper surface of the ceiling wall of the developer casing 152 in the developing section 134 in spaced relation in a state where the scanning unit 7 is closed and the processing section mounting port 11 in the upper portion of the main body casing 2 is accordingly closed.

As shown in FIG. 2, the document pressing cover 193 is formed in a shape of a rectangular thin plate in plan view having the same shape as the document board 192, and an ADF (auto document feeder) device 196 for automatically reading a document is provided at the left side end on the upper surface thereof. The ADF device 196 includes a casing 197, a document transport roller (not shown), a document transport motor (not shown), and a document detection sensor (not shown). The casing 197 has a box-like shape longer in the front and rear direction, in which the document transport roller (not shown) and the document transport motor (not shown) are provided. A standby document tray 198 is provided in the center portion in the up and down direction on the right side wall of the casing 197. The standby document tray 198 has a shape of a generally trapezoidal thin plate in plan view, the base portion of the generally trapezoid is supported by the ADF device 196 as a proximal edge, and the distal end portion thereof is generally horizontally extended toward the right side, and the standby document tray 198 allows documents to be set in a stacked manner.

In the right side wall of the casing 197, a document importing port 199 opened for importing a document into the casing 197 is formed above the standby document tray 198. In the right side wall of the casing 197, a document ejecting port 200 for ejecting a document from the casing 197 is formed below the standby document tray 198. Both the document importing port 199 and the document ejecting port 200 are each formed in a rectangular shape longer in the front and rear direction.

The rear end portion of the document pressing cover 193 is swingably supported on the rear end portion of the document board 192 through a hinge 201, and the front end portion thereof has a grasp portion 70 formed by a recess.

As shown in FIG. 1, the front end portion of the document pressing cover 193 swings in the up and down direction around the hinge 201 in the rear end portion thereof as a fulcrum. When the front end portion of the document pressing cover 193 is lifted upward by holding the grasp portion 70, the glass surface 194 of the document board 192 is opened. When the front end portion of the document pressing cover 193 is lowered, the glass surface 194 of the document board 192 is covered. Thus, the document pressing cover 193 openably covers the glass surface 194 of the document board 192.

(5-2) Usual Document Reading in Scanning Unit

The front end portion of the document pressing cover 193 is lifted upward and is set so that a document is placed on the glass surface 194. Thereafter, the front end portion of the document pressing cover 193 is lowered, and a button on the operation panel 13 of the main body casing 2 is operated. Then, a scanning motor (not shown) allows the CCD sensor (not shown) to scan a document placed on the glass surface 194 from the left side to the right side in an opposed state to the document, so that the image information of the document is read.

After the reading of the document, the front end portion of the document pressing cover 193 is again lifted upward to remove the document from the glass surface 194. When the scanning is finished, the scanning motor (not shown) allows the CCD sensor (not shown) to automatically move to the left end of the glass surface 194, and then the CCD sensor (not shown) stands by thereat.

(5-3) Automatic Document Reading in Scanning Unit

In automatic document reading with ADF device 196, when the document detection sensor (not shown) detects that a document has been set on the standby document tray 198, unlike the usual document reading described above, the CCD sensor (not shown) is fixed in an automatic document reading position, which is not shown. Then, when a button on the operation panel 13 is operated, the document transport motor (not shown) is driven, and a driving force thus generated rotates the document transport roller (not shown). The document is moved to the left side by rotation of the document transport roller (not shown), and is then imported in the casing 197 through the document importing port 199 shown in FIG. 2. The document thus imported passes through a document transport path (not shown), and when the document is opposed to the CCD sensor (not shown), the CCD sensor (not shown) scans the document to read the image information thereof. Thereafter, the document thus scanned is transported to the right side from the document ejecting port 200, and is then ejected onto the upper surface of the document board pressing cover 193.

(5-4) Image Formation Based on Image Information of Read Document

In the image forming section 5 shown in FIG. 1, image data is created based on the aforementioned image information of the document thus read by the CCD sensor (not shown), and an image is formed on a sheet 3 as described above.

2. Operations and Effects (1) Operations and Effects 1

In the laser printer 1, the toner cartridge 8 is arranged in opposed relation to the developing roller 154 in the width direction (longitudinal direction of the developing roller 154) (see FIG. 8). This allows the size of the laser printer 1 in the up and down direction to be reduced, as compared with a case where the toner cartridge 8 is arranged in opposed relation to the developing roller 154 in the up and down direction (an intersecting direction that intersects the longitudinal direction of the developing roller 154). Thus, the size of the laser printer 1 can be reduced.

A toner can be supplied to the developing roller 154 by horizontally passing through the cartridge feed hole 96 of the toner cartridge 8 (see FIG. 10(*c*)). For this reason, as compared with a case where a toner is supplied to the developing roller 154 by dropping the toner from the cartridge feed hole 96, the size of the toner cartridge 8 and the laser printer 1 in the up and down direction can be reduced. Thus, the size of the laser printer 1 can be further reduced. In addition, the size of the toner cartridge 8 can also be reduced.

In the toner cartridge 8, the developing agent accommodating portion 88 that accommodates a toner is anteroposteriorly extended from the developing agent passing portion 87. This suppresses upsizing of the laser printer 1 in the up and down direction, and at the same time, a sufficient amount of toner can be accommodated in the toner cartridge 8 (see FIG. 9).

By a simple operation of only pivoting the outer cylindrical portion 91, the cartridge feed hole 96 and the cartridge return hole 112, both formed in the inner side wall 93 of the inner cylindrical portion 90, can be opened/closed, thereby allowing or restricting passage of the developing agent through the cartridge feed hole 96 and the cartridge return hole 112 (see FIG. 11).

If the agitating mechanism 98 is provided in the inner cylindrical portion 90, a specific structure for preventing the agitating mechanism 98 from pivoting in conjunction with the pivot of the inner cylindrical portion 90 may be required (see FIG. 10). However, with this toner cartridge 8, the outer cylindrical portion 91 is pivoted without pivoting of the inner cylindrical portion 90 to open/close the cartridge feed hole 96 and the cartridge return hole 112, thereby enabling simplification of the agitating mechanism 98.

A toner is supplied to the developing roller 154 through the cartridge feed hole 96, and is received from the developing roller 154 through the cartridge return hole 112. This allows the toner to be circulated between the developing roller 154 and the toner cartridge 8 (see FIG. 10(*c*)). Therefore, the toner can be efficiently used. Further, in the developing section 134, it is possible to suppress stagnation of the toner that has been worn out or deteriorated, in one place. Since the toner cartridge 8 and the developing roller 154 are horizontally positioned at generally the same height, it is not necessary to transport the toner against gravity both on the toner supply side (for supplying a toner to the developing roller 154) and on the toner return side (for receiving a toner from the developing roller 154).

A toner can be reliably supplied from the cartridge feed hole 96 to the developing roller 154 by transporting the toner to the cartridge feed hole 96 with the transport wall 99 (see FIG. 10(*c*)).

The inner portion of the inner cylindrical portion 90 is divided into the return-side area 100, the feed-side area 101, and the communication area 102 by the partition wall 97 (see FIG. 10(*a*)). The return-side area 100 receives a toner from the developing roller 154. The toner is agitated by the return-side agitator 104 and then supplied to the communication area 102, and subsequently supplied from the communication area 102 to the feed-side area 101. In the feed-side area 101, the toner accommodated in the developing agent accommodating portion 88 and the toner supplied from the return-side area 100 through the communication area 102 are received. These toners are agitated by the feed-side agitator 105 and is then supplied to the transport wall 99. The toners thus supplied are transported to the cartridge feed hole 96 by the transport wall 99, and thereafter, is supplied to the developing roller 154 (see FIG. 10(*c*)).

Therefore, the toner received from the developing roller 154 can be reliably circulated, and at the same time, the toner accommodated in the developing agent accommodating portion 88 can be supplied to the developing roller 154.

In the toner cartridge 8, the grip 89 is provided in the front end portion (the downstream end portion in the detachment direction) of the main body casing 2 (see FIG. 8). This allows easy access to the grip 89, and further, the operation of the grip 89 allows the toner cartridge 8 to be easily attached and detached to and from the main body casing 2.

(2) Operations and Effects 2

In the laser printer 1, the toner cartridge 8 is arranged so as to be opposed to the developing roller 154 in the width direction (longitudinal direction of the developing roller 154) (see FIG. 8). This allows the size of the laser printer 1 in the up and down direction to be reduced, as compared with a case where the toner cartridge 8 is arranged in opposed relation to the developing roller 154 in the up and down direction (the intersecting direction that intersects the longitudinal direction of the developing roller 154). Thus, the size of the laser printer 1 can be reduced.

Along with downsizing of the laser printer 1 in the up and down direction, the size of the toner cartridge 8 in the up and down direction is also reduced. However, since the toner cartridge 8 is anteroposteriorly extended from the developing roller 154 to the sheet ejection tray 185, the anteroposterior size of the toner cartridge 8 can be increased. Therefore, a sufficient amount of toner can be kept in the toner cartridge 8.

Further, since the toner cartridge 8 is detachably mountable from the front side (the side of the sheet ejection tray 185) which is accessible for a user, the toner cartridge 8 can be easily replaced. Thus, the operability of the laser printer 1 can be improved (see FIG. 8).

Since the sheet feeding tray 51 is detachably mountable (see FIG. 1) to the main body casing 2 from the front side accessible for a user that is on the same side where the toner cartridge 8 is detachably mounted, the sheet feeding tray 51 can be easily attached/detached. Thus, the operability of the laser printer 1 can be further improved.

In the laser printer 1, the front-side portion of the sheet feeding tray 51 overlaps with the sheet ejection tray 185 in the up and down direction, so that the laser printer 1 can eject the sheet 3 from the middle of the up and down direction of the main body casing 2, which is called an internal sheet ejection.

Therefore, the size of the laser printer 1 in the anteriposterior direction and the width direction can be reduced, thereby achieving further miniaturization of the laser printer 1.

Since the operation panel 13 is provided on the front side accessible for a user that is on the same side where the toner cartridge 8 is detachably mounted, the operation panel 13 can be operated easily. Thus, the operability of the laser printer 1 can be further improved.

The cartridge mounting port 16 is provided in the position anteroposteriorly opposed to the toner cartridge 8 on the front side of the main body casing 2. The toner cartridge 8 can be attached and detached to and from the main body casing 2 through the cartridge mounting port 16 (see FIG. 8).

The cover 17 that openably covers the cartridge mounting port 16 is provided in the laser printer 1. By closing the cartridge mounting port 16 with the cover 17, the toner cartridge 8 mounted in the main body casing 2 can be reliably accommodated in the main body casing 2.

Further, the toner cartridge 8 is extended to a position adjacent to the cover 17 in the state of closing the cartridge mounting port 16 (in the cover closed position). Therefore, an even more sufficient amount of toner can be kept in the toner cartridge 8. Further, when the cover 17 is opened to open the cartridge mounting port 16, the toner cartridge 8 is exposed from the cartridge mounting port 16. This allows an immediate access to the toner cartridge 8, thereby achieving further improvement in operability of the laser printer 1.

The toner cartridge 8 also has the grip 89 provided in the position opposed to the cover 17 in the cover closed position, so that when the cover 17 is opened, the grip 89 is accessibly exposed, and by grasping the grip 89, the toner cartridge 8 can be easily attached/detached. Thus, the operability of the laser printer 1 can be further improved.

The image information of a document read by the scanning unit 7 can be formed into an image on a sheet 3, so that the laser printer 1 can be used as a multifunction machine which also serves as a reproducing unit (see FIG. 1).

Besides, in the laser printer 1, although the scanning unit 7 is provided above the main body casing 2, the toner cartridge 8 is anteroposteriorly attached/detached. Therefore, although the laser printer 1 is a multifunction machine, it is formed compact in the up and down direction, and at the same time, the toner cartridge 8 is formed larger in the front and rear direction, thereby allowing the toner cartridge 8 to keep an even more sufficient amount of toner. During attachment/detachment of the toner cartridge 8, the scanning unit 7 above the toner cartridge 8 does not need to be retracted, so that the operability of the laser printer 1 can be improved. Further, the upper portion of the toner cartridge 8 is positioned close to the scanning unit 7, thereby enabling increase of the toner capacity of the toner cartridge 8.

(3) Operations and Effects 3

In the laser printer 1, when the casing shutter 37 and the outer cylindrical portion 91 are opened (the casing shutter 37 is pivoted to the casing shutter open position, and the outer cylindrical portion 91 is pivoted to the cartridge shutter open position), the casing feed hole 33 and the cartridge feed hole 96 are opened to communicate with each other (see FIG. 10(*c*)). Thus, through the casing feed hole 33 and the cartridge feed hole 96, the toner accommodated in the toner cartridge 8 can be supplied to the developing roller 154. On the other hand, when the casing shutter 37 and the outer cylindrical portion 91 are closed (the casing shutter 37 is pivoted to the casing shutter closed position, and the outer cylindrical portion 91 is pivoted to the cartridge shutter closed position), the casing feed hole 33 and the cartridge feed hole 96 are closed (see FIGS. 6(*b*) and 11(*a*)). This can restrict the movement of the toner between the main body casing 2 and the toner cartridge 8. Therefore, when the toner cartridge 8 is attached and detached to and from the main body casing 2, toner leakage from the main body casing 2 and the toner cartridge 8 can be prevented. Further, in a state where the cover 17 is opened, the casing shutter 37 and the outer cylindrical portion 91 are always closed, so that toner leakage can be reliably prevented.

Then, when the cover 17 that openably covers the cartridge mounting port 16 is opened/closed, the casing shutter 37 and the outer cylindrical portion 91 are opened/closed (see FIGS. 6 and 13) in conjunction with the opening/closing operation of the cover 17. That is, the casing shutter 37 and the outer cylindrical portion 91 can be opened and closed by simply opening and closing the cover 17. Therefore, the casing shutter 37 and the outer cylindrical portion 91 can be easily opened and closed.

The opening of the outer cylindrical portion 91 in the toner cartridge 8 opens the casing shutter 37 of the main body casing 2, while the closing of the outer cylindrical portion 91 closes the casing shutter 37. Therefore, since the opening and closing of the casing shutter 37 and the outer cylindrical portion 91 are linked to each other, the casing shutter 37 and the outer cylindrical portion 91 can be reliably opened/closed. Thus, even if the cover 17 is opened/closed in a state where the toner cartridge 8 is not mounted in the main body casing 2, the casing shutter 37 is not opened, so that the toner leakage from the main body casing 2 can be reliably prevented.

In the toner cartridge 8, when the outer cylindrical portion 91 is opened/closed, the cartridge projection 116 engaged with the casing shutter 37 opens/closes the casing shutter 37 in conjunction with the opening/closing operation of the outer cylindrical portion 91 (see FIGS. 6 and 13).

Thus, with such a simple structure that only the cartridge projection 116 is provided in the toner cartridge 8, the casing shutter 37 can be opened/closed reliably in conjunction with the outer cylindrical portion 91.

The cartridge projection 116 is provided in the outer cylindrical portion 91, so that the structure can be simplified.

Further, the outer cylindrical portion 91 and the cover 17 are coupled through the transmission member 25, so that a power generated during the opening/closing operation of the cover 17 is transmitted to the outer cylindrical portion 91, whereby the outer cylindrical portion 91 can be reliably opened/closed with the power (see FIGS. 8 and 9).

Therefore, it is not necessary to provide a member for operating the opening/closing of the outer cylindrical portion 91 in the toner cartridge 8, so that a possibility that the outer cylindrical portion 91 is accidentally opened while the toner cartridge 8 is not mounted in the main body casing 2 can be reduced. As a result, the toner leakage from the toner cartridge 8 can be reliably prevented.

The transmission member 25 makes it possible to arrange the outer cylindrical portion 91 and the cover 17 in spaced relation to each other, thereby improving flexibility in design (see FIG. 7).

In the toner cartridge 8, when the cover 17 is opened/closed, the cartridge ridge 117 in engagement with the transmission member 25 opens/closes the outer cylindrical portion 91 (see FIGS. 8 and 9) by means of a power that is generated during the opening/closing operation of the cover 17 and is then transmitted by the transmission member 25.

Therefore, with such a simple structure that only the cartridge ridge 117 is provided in the toner cartridge 8, the outer cylindrical portion 91 can be reliably opened/closed in conjunction with the opening/closing operation of the cover 17. In a state where the outer cylindrical portion 91 is opened, the cartridge ridge 117 is positioned perpendicular to the attachment/detachment direction of the toner cartridge 8, thereby preventing the toner cartridge 8 from moving to the attachment/detachment direction. This can also prevent the casing feed hole 33 and the cartridge feed hole 96 from shifting their positions during mounting of the toner cartridge 8.

Further, since the cartridge ridge 117 is provided in the outer cylindrical portion 91, the structure can be simplified.

Second Embodiment

In the embodiment described above, the operation panel 13 is provided on the upper wall 10 of the main body casing 2. However, it may be provided on the document board 192. In this case, the operation panel 13 moves together with the scanning unit 7, so that the processing section mounting port 11 becomes widely openable, thereby making easier the replacement of the toner cartridge 8.

In the embodiment described above, the processing section 9 integrally includes the drum section 133 and the developing section 134, and is detachably mounted to the main body casing 2. In addition to this, in the laser printer 1, for example, in a state where the drum section 133 is mounted in the main body casing 2, the developing section 134 may be detachably mounted to the drum section 133.

In the aforementioned embodiment, the sheet feeding tray 51 was detachably mountable to the main body casing 2. However, the sheet feeding tray 51 may be integrally formed with the main body casing 2. In that case, a frontal side wall is not formed in the sheet feeding tray 51, and the inner portion of the sheet feeding tray 51 is opened to the front side, and the sheet 3 is accommodated in the sheet feeding tray 51 through the sheet feeding tray mounting port 15.

On the other hand, the sheet ejection tray 185 is integrally formed with the main body casing 2. However, the sheet ejection tray 185 may employ a detachably mountable mode such as in the sheet feeding tray 51.

Third Embodiment (1) Toner Cartridge

FIG. 15 shows perspective views of a toner cartridge according to a third embodiment seen from obliquely above in the rear left thereof: (*a*) illustrates a state where a developing agent accommodating portion is in a cartridge shutter closed position; and (*b*) illustrates a state where the developing agent accommodating portion is in a cartridge shutter open position. FIG. 16 shows right-side sectional views of the toner cartridge according to the third embodiment: (*a*) illustrates a state where the developing agent accommodating portion is in the cartridge shutter closed position; and (*b*) illustrates a state where the developing agent accommodating portion is in the cartridge shutter open position. FIG. 17 shows right side views of the toner cartridge according to the third embodiment: (*a*) illustrates a state where the developing agent accommodating portion is in the cartridge shutter closed position; and (*b*) illustrates a state where the developing agent accommodating portion is in the cartridge shutter open position. FIG. 18 shows left side views of the toner cartridge according to the third embodiment: (*a*) illustrates a state where the developing agent accommodating portion is in the cartridge shutter closed position; and (*b*) illustrates a state where the developing agent accommodating portion is in the cartridge shutter open position.

The toner cartridge 8 according to the third embodiment includes a developing agent passing portion 202 and a developing agent accommodating portion 203 both respectively having different structures from the developing agent passing portion 87 and the developing agent accommodating portion 88 in the embodiment described above.

As shown in FIG. 16(*a*), the developing agent accommodating portion 203 is formed in a hollow cylindrical shape longer in the front and rear direction. Both end surfaces of the developing agent accommodating portion 203 in the axial direction (front and rear direction) are each closed by a side wall having a circular shape in front view. The front-side side wall of the developing agent accommodating portion 203 is formed flat along the vertical direction, and the rear-side side wall thereof is formed so as to be rearwardly convex-curved. A grip 204 having a generally inverted U-shape is integrally attached to the front-side side wall of the developing agent accommodating portion 203.

Specifically, the grip 204 passes the circle center of the front-side side wall of the developing agent accommodating portion 203, and distal end portions thereof are connected to the front-side side wall so as to be opposed to each other across the circle center of the front-side side wall of the developing agent accommodating portion 203.

An agitator rotating shaft 205 anteroposteriorly extending along the axis of the developing agent accommodating portion 203 is provided in the developing agent accommodating portion 203. The agitator rotating shaft 205 is rotatably supported on both anteroposteiror side walls of the developing agent accommodating portion 203. A driving force transmission portion 227 is provided in the rear end portion of the agitator rotating shaft 205. The driving force transmission portion 227 is formed in a generally "8" shape in rear view (see FIG. 15), and is exposed to the outside on the rear side from the rear-side side wall of the developing agent accommodating portion 203. The agitator rotating shaft 205 includes an agitator support portion 209 that anteroposteriorly extends so as to be equidistantly spaced from the agitator rotating shaft 205 on the radially outside thereof. The agitator support portion 209 is provided with a plurality of agitators 210. Each agitator 210 is formed in a generally rectangular shape made of a film having flexibility, and the radially outer end edge thereof is formed so as to be inclined radially outward to the rear side. Among these agitators 210, respective agitators 210 radially opposed to a cartridge feed hole 96 and a cartridge return hole 112, which are described later, have different structures from the other agitators 210. The agitator 210 corresponding to the cartridge feed hole 96 is provided on the agitator rotating shaft 205, and formed in a generally isosceles trapezoidal shape tapering radially outward. The agitator 210 corresponding to the cartridge return hole 112 is provided on the agitator support portion 209, and formed in a shape of a generally triangular frame with wire or the like.

As shown in FIG. 15(*a*), the cartridge feed hole 96 and the cartridge return hole 112, both described above, are formed and anteroposteriorly aligned in the rear end portion of the receiving section cylindrical wall 206 that forms the circumference surface of the developing agent accommodating portion 203. The cartridge feed hole 96 is positioned on the rear side of the cartridge return hole 112. In the receiving section cylindrical wall 206, a radial projection 207 protruded radially outward is provided in a position shifted from the cartridge feed hole 96 and the cartridge return hole 112 about 90° clockwise in rear view.

As shown in FIG. 16, in the outer circumferential surface of the receiving section cylindrical wall 206, an engaging groove 225 is formed in a position on the front side from the radial projection 207. The engaging groove 225 circumferentially extends along the receiving section cylindrical wall 206, and is formed annularly. As shown in FIG. 15(*a*), in the rear-side side wall of the developing agent accommodating portion 203, an axial projection 208 protruded rearward is provided in the same circumferential position as the radial projection 207.

The developing agent passing portion 202 is formed in a generally hollow cylindrical shape having a slightly larger diameter than the developing agent accommodating portion 203, with both axial (the front and rear direction) ends thereof opened.

A passing portion cylindrical wall 211 forming the circumference surface of the developing agent passing portion 202 is anteroposteriorly formed over a range from the rear-side side wall of the developing agent accommodating portion 203 to the engaging groove 225 (see FIG. 16). The cartridge shutter feed hole 118 and the cartridge shutter return hole 119, both described above, are formed and anteroposteriorly aligned in the rear end portion of the passing portion cylindrical wall 211. The cartridge shutter feed hole 118 is positioned on the rear side of the cartridge shutter return hole 119. In the passing portion cylindrical wall 211, a radial ridge 212 protruded radially outward is provided in a position on the opposite side to the cartridge shutter feed hole 118 and the cartridge shutter return hole 119 across the rotating shaft. The radial ridge 212 is extended over the front end portion to the rear end portion of the passing portion cylindrical wall 211 (see FIG. 17). In the passing portion cylindrical wall 211, a radial projection receiving groove 213 radially penetrating the passing portion cylindrical wall 211 is formed over a range from a forward position of the cartridge shutter return hole 119 to a position shifted about 90° clockwise on the same circumference in rear view (see FIG. 18).

As shown in FIG. 16, the front end edge and the rear end edge of the passing portion cylindrical wall 211 are entirely bent toward the axial center.

The developing agent passing portion 202 is attached to the developing agent accommodating portion 203 so that the passing portion cylindrical wall 211 covers the rear end portion of the outer peripheral surface of the receiving section cylindrical wall 206. Specifically, the front end edge of the passing portion cylindrical wall 211 comes into engagement with the engaging groove 225 of the receiving section cylindrical wall 206. On the other hand, the rear end edge of the passing portion cylindrical wall 211 comes into engagement with the peripheral portion of the rear-side side wall of the developing agent accommodating portion 203.

The driving force transmission portion 227 and the axial projection 208 of the developing agent accommodating portion 203 are exposed rearward from an opening portion on the rear side of the developing agent passing portion 202 described above (see FIG. 15). The radial projection 207 of the developing agent accommodating portion 203 is exposed radially outward from the radial projection receiving groove 213 of the developing agent passing portion 202 (see FIG. 18).

The developing agent accommodating portion 203 is supported on the developing agent passing portion 202 so as to be pivotable between the cartridge shutter closed position (see FIG. 16(*a*)) and the cartridge shutter open position (see FIG. 16(*b*)) by circumferentially sliding the outer circumferential surface of the receiving section cylindrical wall 206 on the inner circumferential surface of the passing portion cylindrical wall 211 in a state where the developing agent passing portion 202 is attached to the developing agent accommodating portion 203. When the developing agent accommodating portion 203 is in the cartridge shutter closed position, the cartridge feed hole 96 and the cartridge return hole 112 are closed from the radially outside by a portion of the passing portion cylindrical wall 211 of the developing agent passing portion 202 other than the cartridge shutter feed hole 118 and the cartridge shutter return hole 119 (see FIG. 15(*a*)). A grip 204 is longer in the up and down direction. On the other hand, a position in which the developing agent accommodating portions 203 is pivoted from the cartridge shutter closed position about 90° counterclockwise in front view is the cartridge shutter open position (see FIG. 15(*b*)). When the developing agent accommodating portion 203 is in the cartridge shutter open position, the cartridge feed hole 96 and the cartridge shutter feed hole 118 are opposed to and in communication with each other in the width direction. At the same time, the cartridge return hole 112 and the cartridge shutter return hole 119 are opposed to and in communication with each other in the width direction. The grip 204 is longer in the width direction.

The radial projection 207 of the developing agent accommodating portion 203 moves inside the radial projection receiving groove 213, along with the pivot of the developing agent accommodating portion 203. The radial projection 207 abuts against an upper end edge of the radial projection receiving groove 213 when the developing agent accommodating portion 203 is in the cartridge shutter closed position (see FIG. 18(*a*)), while it abuts against a lower end edge of the radial projection receiving groove 213 when the developing agent accommodating portion 203 is in the cartridge shutter open position (see FIG. 18(*b*)).

(2) Cartridge Receiving Space

FIG. 19 shows a front view of a laser printer to which a cartridge receiving space according to the third embodiment is applied. FIG. 20 shows views along a line A-A in FIG. 19: (*a*) illustrates a state where the toner cartridge is accommodated in the cartridge receiving space and a cover is in a cover closed position; and (*b*) illustrates a state where the toner cartridge is not accommodated in the cartridge receiving space and the cover is in a cover open position.

In the laser printer 1 of the third embodiment, the transmission member 25 is not mounted corresponding to the toner cartridge 8, and the inner portion of the cartridge receiving space 27 is also changed.

Specifically, as shown in FIG. 19, the cartridge receiving space 27 is divided in a generally circular shape in front view, and the left guide groove 28 and the right guide groove 30 are extended to the rear-end side of the cartridge receiving space 27 (see FIG. 20(*b*)). Corresponding to the frontal shape of the cartridge receiving space 27, the receiving section upper side wall 18, the receiving section lower side wall 19, the receiving section left side wall 20, and the receiving section right side wall 21 are each curved in front view. In the cartridge receiving space 27, as shown in FIG. 20(*b*), the casing feed hole 33 and the casing return hole 34 both described above are formed and anteroposteriorly aligned in the rear end portion of the receiving section left side wall 20. The casing feed hole 33 is positioned on the rear side of the casing return hole 34. In the receiving section left side wall 20, a guide groove 229 circumferentially extending along the receiving section left side wall 20 is formed in a position forward of the casing feed hole 33 and the casing return hole 34.

A casing shutter 226 having a structure different from the casing shutter 37 is provided instead of the casing shutter 37 described above. As shown in FIG. 19, the casing shutter 226 integrally includes a circular-arc wall 228 and a rear end wall 214. The circular-arc wall 228 is formed in a shape of a generally circular-arc thin plate in front view along the frontal shape of the cartridge receiving space 27. The front end edge of the circular-arc wall 228 is bent radially outward, and as shown in FIG. 20(*b*), a notch 215 recessed rearward is formed in the circumferentially center position thereof. The rear end wall 214 having a generally gibbous-like shape in front view is connected to the rear end edge of the circular-arc wall 228 (see FIG. 19). The rear end wall 214 is rearwardly convex-curved along the rear-side side wall of the developing agent accommodating portion 203 of the toner cartridge 8. The rear end wall 214 has an axial projection fitting hole 216 formed in the vicinity of the notch 215 in the circular-arc wall 228 in front view (see FIG. 19).

The front end edge of the circular-arc wall 228 is fitted in the guide groove 229 of the receiving section left side wall 20, whereby the casing shutter 226 is circumferentially slidably supported on the receiving section left side wall 20 in the cartridge receiving space 27. Specifically, the casing shutter 226 is pivotable between the casing shutter closed position and the casing shutter open position. When the casing shutter 226 is in the casing shutter closed position, the circular-arc wall 228 closes the casing feed hole 33 and the casing return hole 34 from the right side (see FIG. 20(*b*)). On the other hand, a position in which the casing shutter 226 is pivoted from the casing shutter closed position about 90° counterclockwise in front view is the casing shutter open position. When the casing shutter 226 is in the casing shutter open position, the circular-arc wall 228 is positioned below the casing feed hole 33 and the casing return hole 34 and opens these holes to the right side.

In the cartridge receiving space 27, the driving force input gear 36 (see FIG. 6) is omitted, and a driving mechanism 217 is instead provided rearward of the casing shutter 226.

The driving mechanism 217 includes a gear support portion 218, a first gear 219, and a second gear 220.

The gear support portion 218 is formed in a shape of a generally inverted L-shaped thin plate in plan view and integrally includes a first support portion 221 and a second support portion 222.

The first support portion 221 is formed in a generally rectangular shape in right side view anteroposteriorly extending, with its left side surface fixed to the receiving section left side wall 20. A first support hole (not shown) penetrating the first support portion 221 and the receiving section left side wall 20 in the width direction is formed in the middle of the first support portion 221 in the up and down direction.

The second support portion 222 has a generally rectangular shape in front view extending in the width direction, the left end portion of which is connected to the rear end portion of the first support portion 221. A second support hole 223 having a circular shape in front view anteroposteriorly penetrating the second support portion 222 is formed in the middle of the second support portion 222 in the right-and-left and up-and-down directions.

The first gear 219 is a bevel gear, a gear-teeth-formed portion (toothed portion) of which is exposed inside the cartridge receiving space 27.

The rotating shaft of the first gear 219 is inserted through the first support hole (not shown) of the first support portion 221 along the width direction, and the first gear 219 is rotatably supported by the first support portion 221. A portion of the first gear 219 on the opposite side of the toothed portion in the rotating shaft direction thereof is arranged on the left side from the receiving section left side wall 20, and is coupled to a drive motor (not shown).

The second gear 220 is a bevel gear, the rotating shaft of which is anteroposteriorly inserted through the second support hole 223 of the second support portion 222. The second gear 220 is rotatably supported by the second support portion 222. In the second gear 220, a gear-teeth-formed portion (toothed portion) is arranged on the rear side from the second support portion 222, and meshes with the first gear 219 so as to be generally orthogonal to the toothed portion of the first gear 219 in plan view. Of the rotating shaft of the second gear 220, a portion on the front side from the second support portion 222 is formed in a cylindrical shape having a larger diameter than the second support hole 223, and a coupling hole 224 recessed rearward is formed on the front side surface thereof. The coupling hole 224 is formed in an "8" in the front view (see FIG. 19).

In the driving mechanism 217, when a drive motor (not shown) is driven, the first gear 219 rotates in a clockwise direction in right side view, and the second gear 220 rotates in a counterclockwise direction in rear view along with the rotation of the first gear 219.

(3) Attachment/Detachment of Toner Cartridge to and from Main Body Casing

First, the cover 17 of the main body casing 2 is pivoted to the cover open position described above, so that the cartridge mounting port 16 opens. Then, the grip 204 of the toner cartridge 8, in which the developing agent accommodating portion 203 is in the cartridge shutter closed position, is held (see FIG. 16(*a*)), and the radial ridge 212 (see FIG. 17(*a*)) is made to be received in the right guide groove 30 of the receiving section right side wall 21, while the toner cartridge 8 is kept in a horizontal posture. At the same time, the radial projection 207 (see FIG. 15(*a*)) is made to be received in the left guide groove 28 of the receiving section left side wall 20.

The toner cartridge 8 is then pushed into the rear side and is inserted into the cartridge receiving space 27. At this time, the radial ridge 212 (see FIG. 17(*a*)) is guided along the right guide groove 30, and the radial projection 207 (see FIG.

15(*a*)) is guided along the left guide groove 28. Thus, the toner cartridge 8 horizontally moves rearward in the cartridge receiving space 27.

When the toner cartridge 8 is further pushed into the rear side, the radial ridge 212 contacts the rear end edge of the right guide groove 30. At the same time, the radial projection 207 fits in the notch 215 of the casing shutter 226 in the casing shutter closed position, and the axial projection 208 (see FIG. 15(*a*)) fits in the axial projection fitting hole 216 (see FIG. 19) of the casing shutter 226. As shown in FIG. 20(*a*), the driving force transmission portion 227 of the toner cartridge 8 then fits in the coupling hole 224 of the driving mechanism 217 and comes into engagement therewith. This completes the receiving of the toner cartridge 8 into the cartridge receiving space 27.

In this completed state, the grip 204 is held to be twisted, and the developing agent accommodating portion 203 in the cartridge shutter closed position is pivoted to the cartridge shutter open position. In a state where the radial projection 207 of the developing agent accommodating portion 203 fits in (comes in engagement with) the notch 215 and the axial projection 208 is fitted in (in engagement with) the axial projection fitting hole 216, the casing shutter 226 is pivoted to the casing shutter open position in conjunction with the pivot of the developing agent accommodating portion 203 to the cartridge shutter open position.

In this state, the casing feed hole 33 (see FIG. 20(*b*)) of the main body casing 2 communicates with the cartridge feed hole 96 of the toner cartridge 8 through the cartridge shutter feed hole 118. Also, the casing return hole 34 (see FIG. 20(*b*)) of the main body casing 2 communicates with the cartridge return hole 112 of the toner cartridge 8 through the cartridge shutter return hole 119. As this time, when the cover 17 is pivoted to the cover closed position, the mounting of the toner cartridge 8 to the main body casing 2 is completed. At this time, the grip 204 of the toner cartridge 8 is anteroposteriorly opposed to and adjacent to the cover 17 in the cover closed position.

In this state, when the drive motor (not shown) is driven, the driving force thereof is transmitted to the driving force transmission portion 227 of the toner cartridge 8 through the first gear 219 of the driving mechanism 217 and the coupling hole 224 of the second gear 220, and the driving force transmission portion 227 is rotated. Along with the rotation of the driving force transmission portion 227, the agitator rotating shaft 205 and the agitator 210 are rotated in a counterclockwise direction in rear view. The rotation of the agitator 210 moves the toner rearward in the developing agent accommodating portion 203 while the toner is agitated, and the toner is then supplied to the cartridge feed hole 96. Thus, as described above, the toner is supplied to the developing-section 134 side. Further, the toner from the developing-section 134 side is received in the developing agent accommodating portion 203 through the cartridge return hole 112. In the developing section 134, the developer feed hole 171 and the developer return hole 174 (see FIG. 14) are anteroposteriorly aligned in the same manner as the cartridge shutter feed hole 118 and the cartridge shutter return hole 119, and correspond to the cartridge feed hole 96 and the cartridge return hole 112 according to the third embodiment. Therefore, the internal structure of the developing section 134, including the arranged positions of the feed auger 156 and the return auger 157, is also changed so as to correspond to the developer feed hole 171 and the developer return hole 174 according to the third embodiment. As described above, the agitator 210 corresponding to the cartridge return hole 112 is formed in the frame-like shape, thereby preventing the toner from being supplied to the cartridge return hole 112.

On the other hand, when the procedure for accommodating the toner cartridge 8 in the cartridge receiving space 27 is reversed, the cover 17 is first pivoted to the cover open position, so that the cartridge mounting port 16 opens. Then, the grip 89 is held to be twisted, and the developing agent accommodating portion 203 in the cartridge shutter open position is pivoted to the cartridge shutter closed position, so that the casing shutter 226 pivots to the casing shutter closed position. Thereafter, the toner cartridge 8 can be detached from the main body casing 2 by holding the grip 89 and drawing the toner cartridge 8 to the front side.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus comprising:

an image carrier on which an electrostatic latent image is configured to be formed;

a developing agent carrier configured to transform the electrostatic latent image into a visible image by supplying a developing agent to the image carrier, the developing agent carrier having a rotation axis extending in a horizontal direction, and configured to rotate on the rotation axis; and a developing agent cartridge configured to accommodate the developing agent to be supplied to the developing agent carrier, the developing agent cartridge located so as not to overlap with the developing agent carrier in a direction orthogonal to an extending direction of the rotation axis of the developing agent carrier, and the developing agent cartridge being formed with an opening, wherein the developing agent cartridge is positioned to overlap with the developing agent carrier as viewed from the extending direction, and wherein the opening includes a feed-side opening configured to allow passage of the developing agent to the developing agent carrier; and a return-side opening configured to allow passage of the developing agent from the developing agent carrier.

2. The image forming apparatus according to claim 1, wherein the developing agent cartridge comprises:

a developing agent passing portion in which the feed-side opening is formed, allowing passage of the developing agent to the feed-side opening; and a developing agent accommodating portion that is horizontally extended from the developing agent passing portion toward a direction orthogonal to the extending direction, and configured to accommodate the developing agent.

3. The image forming apparatus according to claim 2, wherein the developing agent passing portion comprises:

an inner cylindrical portion comprising an inner cylindrical wall having a generally cylindrical shape, and an inner side wall that closes both axial end portions of the inner cylindrical wall and is formed with the opening, the inner cylindrical portion communicating with the developing agent accommodating portion; and an outer cylindrical portion comprising an outer cylindrical wall formed in a generally cylindrical shape along the inner cylindrical portion, and an outer member provided in both axial end portions of the outer cylindrical wall, the outer cylindrical portion accommodating the inner cylindrical portion and pivotably opening and closing the opening.

4. A developing agent cartridge accommodating a developing agent to be supplied to a developing agent carrier, and configured to be detachably mounted to a main body casing of an image forming apparatus, the developing agent carrier having a rotation axis extending in a horizontal direction, and configured to be held to a casing mounted to the main body casing to rotate on the rotation axis, the developing agent cartridge comprising:

a developing agent passing portion including an opening positioned to overlap with the casing as viewed from an extending direction of the rotation axis of the developing agent carrier and not to overlap with the developing agent carrier as viewed from a direction orthogonal to the extending direction, the developing agent passing portion configured to allow passage of the developing agent to the opening; and a developing agent accommodating portion that is horizontally extended from the developing agent passing portion toward a direction orthogonal to the extending direction, and configured to accommodate the developing agent, wherein the opening includes:

a feed-side opening configured to allow passage of the developing agent to the developing agent carrier; and a return-side opening configured to allow passage of the developing agent from the developing agent carrier, and wherein the developing agent cartridge is located beyond the developing agent carrier in the horizontal direction and the developing agent cartridge is formed with the opening permitting the developing agent to be conveyed out horizontally to a position horizontally and longitudinally juxtaposed to the developing agent carrier.

5. The developing agent cartridge according to claim 4, wherein the developing agent passing portion comprises:

an inner cylindrical portion comprising an inner cylindrical wall having a generally cylindrical shape, and an inner side wall that closes both axial end portions of the inner cylindrical wall and is formed with the opening, the inner cylindrical portion communicating with the developing agent accommodating portion; and an outer cylindrical portion comprising an outer cylindrical wall formed in a generally cylindrical shape along the inner cylindrical portion, and an outer member provided in both axial end portions of the outer cylindrical wall, the outer cylindrical portion accommodating the inner cylindrical portion and configured to open and close the opening by pivoting.

6. The developing agent cartridge according to claim 5, further comprising a transport member configured to transport the developing agent to the feed-side opening.

7. The developing agent cartridge according to claim 6, further comprising:

a partition wall dividing an inner portion of the inner cylindrical portion into a return-side area configured to receive the developing agent from the developing agent carrier, a feed-side area configured to receive the developing agent to be supplied to the developing agent carrier, and a communication area that brings the return-side area and the feed-side area into communication with each other;

a feed-side agitating member configured to agitate the developing agent in the feed-side area and supply the developing agent to the transport member; and a return-side agitating member configured to agitate a developing agent in the return-side area and supply the developing agent to the communication area.

8. The developing agent cartridge according to claim 4, wherein a grip is provided in a downstream end portion in a detachment direction with respect to the casing.

9. An image forming apparatus comprising:

a main body casing;

an image carrier on which an electrostatic latent image is configured to be formed;

a casing;

a developing agent carrier configured to be juxtaposed to the image carrier and configured to form a developing agent image by supplying a developing agent to the image carrier to transform the electrostatic latent image into a visible image, the developing agent carrier having a rotation axis extending in a horizontal direction, and configured to be held to the casing to rotate about the rotation axis;

a transfer member configured to be juxtaposed to the image carrier and configured to transfer the developing agent image to a recording medium;

a fixing unit that is configured to be arranged on an opposite side of the developing agent carrier with respect to the image carrier, and configured to fix the developing agent image transferred on the recording medium, onto the recording medium;

a recording-medium ejecting section which is configured to be arranged on an opposite side of the image carrier with respect to the fixing unit and to which the recording medium is ejected; and a developing agent cartridge configured to be detachably mountable to the main body casing and configured to accommodate the developing agent to be supplied to the developing agent carrier, having an opening formed in a position to overlap with the developer casing as viewed from an extending direction of the rotation axis of the developing agent carrier and not to overlap with the developing agent carrier as viewed from an direction orthogonal to the extending direction, and including a developing agent passing portion allowing passage of the developing agent to the opening; and a developing agent accommodating portion that is horizontally extended from the developing agent passing portion toward a direction orthogonal to the extending direction, and accommodates the developing agent.

10. The image forming apparatus according to claim 9, comprising a recording medium feeding section that is configured to be detachably mountable to the casing from the recording-medium ejecting section side, and configured to accommodate a recording medium to be fed to the transfer member.

11. The image forming apparatus according to claim 10, wherein a portion of the recording medium feeding section overlaps with the recording-medium ejecting section in a direction orthogonal to the first direction and the longitudinal direction.

12. The image forming apparatus according to claim 9, comprising an operation section configured to operate the image forming apparatus, on the recording-medium ejecting section side of the casing.

13. The image forming apparatus according to claim 9, wherein on the recording-medium ejecting section side of the casing, a casing-side opening configured to pass the developing agent cartridge is formed in a position juxtaposed to the developing agent cartridge in the first direction, a cover that, when closed, is configured to cover the casing-side opening is provided, and when the cover is in a state of closing the casing-side opening, the developing agent cartridge is configured to be extended to a position adjacent to the cover.

14. The image forming apparatus according to claim 13, wherein the developing agent cartridge is provided with a grip in a position juxtaposed to the cover in the state of closing the casing-side opening.

15. The image forming apparatus according to claim 9, wherein the first direction is a generally horizontal direction, and the image forming apparatus comprises an image reading unit provided above the casing and capable of reading image information of a document.

16. An image forming apparatus comprising:

an image carrier on which an electrostatic latent image is configured to be formed;

a developing agent carrier configured to transform the electrostatic latent image into a visible image by supplying a developing agent to the image carrier;

a casing configured to accommodate the developing agent carrier and is formed with a first opening;

a first shutter member provided in the casing, and configured to open and close the first opening;

a developing agent cartridge formed with a second opening that is configured to communicate with the first opening, configured to be attached to and detached from the casing, and configured to accommodate the developing agent to be supplied to the developing agent carrier;

a second shutter member provided in the developing agent cartridge, and configured to open and close the second opening;

a cover openably covering a third opening formed in a position juxtaposed to the developing agent cartridge in an attachment/detachment direction of the developing agent cartridge in the casing in order to pass the developing agent cartridge attached to and detached from to the casing, wherein the first shutter member and the second shutter member are opened and closed in conjunction with an opening/closing operation of the cover.

17. The image forming apparatus according to claim 16, wherein the first shutter member is opened and closed by opening and closing the second shutter member.

18. The image forming apparatus according to claim 17, wherein the developing agent cartridge comprises a first projection that comes into engagement with the first shutter member, and opens and closes the first shutter member in conjunction with opening and closing of the second shutter member.

19. The image forming apparatus according to claim 18, wherein the first projection is provided in the second shutter member.

20. The image forming apparatus according to claim 16, comprising a transmission member that couples the second shutter member and the cover and transmits a power generated at the opening/closing operation of the cover to the second shutter member to open and close the second shutter member.

21. The image forming apparatus according to claim 20, wherein the developing agent cartridge comprises a second projection that comes into engagement with the transmission member, and opens and closes the second shutter member by the power which is transmitted by the transmission member.

22. The image forming apparatus according to claim 21, wherein the second projection is provided in the second shutter member.

23. A developing agent cartridge accommodating a developing agent to be supplied to a developing agent carrier outside of the developing agent cartridge, and configured to be detachably mounted to a main body casing of an image forming apparatus, the developing agent carrier having a rotation axis extending in a horizontal direction, the rotation axis being configured to be held to a casing mounted to the main body casing, the developing agent cartridge comprising:

a developing agent passing portion including a feed-side opening positioned to overlap with the casing as viewed from an extending direction of the rotation axis of the developing agent carrier and not to overlap with the developing agent carrier as viewed from a direction orthogonal to the extending direction, the developing agent passing portion configured to allow horizontal movement of the developing agent to the feed-side opening; and a developing agent accommodating portion configured to accommodate the developing agent, wherein the feed-side opening is configured to permit passage of the developing agent to the developing agent carrier, and wherein the developing agent cartridge includes a return-side opening configured to permit passage of the developing agent into the developing agent cartridge.

24. The developing agent cartridge according to claim 23, wherein the return-side opening is located on the developing agent passing portion, and the return-side opening is configured to permit passage of the developing agent from the developing agent carrier into the developing agent passing portion, and wherein the developing agent passing portion is configured to permit the developing agent received from the return-side opening to be supplied to the feed-side opening.

25. An image forming apparatus comprising:

a main body casing;

an image carrier disposed in the main body casing;

a developing agent carrier configured to supply the developing agent to the image carrier, the developing agent carrier having a rotation axis extending in a horizontal direction, the rotation axis being configured to be held to a casing mounted to the main body casing; and a developing agent cartridge configured to be detachably mounted to the main body casing, wherein the developing agent cartridge includes:

a developing agent passing portion including a feed-side opening positioned to overlap with the casing as viewed from an extending direction of the rotation axis of the developing agent carrier and not to overlap with the developing agent carrier as viewed from a direction orthogonal to the extending direction, the developing agent passing portion configured to allow passage of the developing agent to the feed-side opening; and a developing agent accommodating portion configured to accommodate the developing agent, wherein the feed-side opening is configured to permit passage of the developing agent to the developing agent carrier, and wherein the developing agent cartridge includes a return-side opening configured to permit passage of the developing agent into the developing agent cartridge.

26. The image forming apparatus according to claim 25, wherein the return-side opening is located on the developing agent passing portion, and the return-side opening is configured to permit passage of the developing agent from the developing agent carrier into the developing agent passing portion, and wherein the developing agent passing portion is configured to permit the developing agent received from the return-side opening to be supplied to the feed-side opening.

* * * * *